US012571554B2

(12) United States Patent
Du et al.

(10) Patent No.: US 12,571,554 B2
(45) Date of Patent: Mar. 10, 2026

(54) BUILDING MANAGEMENT SYSTEM WITH CLEAN AIR FEATURES

(71) Applicant: Johnson Controls Tyco IP Holdings LLP, Milwaukee, WI (US)

(72) Inventors: Fang Du, Milwaukee, WI (US); Michael J. Wenzel, Grafton, WI (US); Anas W.I. Alanqar, Milwaukee, WI (US); Jonathan D. Douglas, Mequon, WI (US); Sean Aaron Finn-Samuels, Milwaukee, WI (US); Michael J. Risbeck, Milwaukee, WI (US); Mohammad Elbsat, Milwaukee, WI (US); Kirk H. Drees, Cedarburg, WI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 350 days.

(21) Appl. No.: 18/105,710

(22) Filed: Feb. 3, 2023

(65) Prior Publication Data

US 2023/0250987 A1 Aug. 10, 2023

Related U.S. Application Data

(60) Provisional application No. 63/347,949, filed on Jun. 1, 2022, provisional application No. 63/308,114, filed on Feb. 9, 2022.

(51) Int. Cl.
*F24F 11/63* (2018.01)
*F24F 110/32* (2018.01)
(Continued)

(52) U.S. Cl.
CPC ..... *F24F 11/63* (2018.01); *F24F 2110/32* (2018.01); *F24F 2110/64* (2018.01); *F24F 2120/10* (2018.01)

(58) Field of Classification Search
CPC ..... F24F 11/0001; F24F 2011/0002; F24F 11/63; F24F 11/64; F24F 11/62;
(Continued)

(56) References Cited

U.S. PATENT DOCUMENTS 5,402,367 A * 3/1995 Sullivan ..... G03F 7/70516 702/85
6,699,120 B1 * 3/2004 Darum ..... F24F 11/30 454/239
(Continued)

FOREIGN PATENT DOCUMENTS

EP 1 156 286 A2 11/2001
WO WO-2012/161804 A1 11/2012
(Continued)

OTHER PUBLICATIONS

Goyal et al. Indoor air quality modeling for PM10, PM2.5, and PM1.0 in naturally ventilated classrooms of an urban Indian school building ) (Year: 2010).*
(Continued)

*Primary Examiner* — Darrin D Dunn
(74) *Attorney, Agent, or Firm* — Foley & Lardner LLP

(57) ABSTRACT

Systems and methods for controlling building equipment based on an indoor air quality (IAQ) ventilation analysis of a building. One system includes a controller including memory and one or more processors configured to continuously collect IAQ data from one or more sensors within the building, estimate a plurality of outdoor airflow rates for an area of the building during a plurality of transient periods using the IAQ data as input, generate a time series outdoor airflow rate includes the plurality of estimated outdoor airflow rates, and modify a control strategy for the area of the building based on the time series outdoor airflow rate and a ventilation schedule for the area of the building.

18 Claims, 32 Drawing Sheets

(51) Int. Cl.
*F24F 110/64* (2018.01)
*F24F 120/10* (2018.01)

(58) Field of Classification Search
CPC ..... F24F 2110/50; F24F 11/65; F24F 11/74; F24F 2130/10; F24F 2110/30; F24F 2110/00; F24F 2110/64; F24F 2140/40; G05B 19/042; G05B 15/02; G05B 2219/2614; G05B 13/048; G06F 2119/08; G06F 30/13
See application file for complete search history.

(56) References Cited

U.S. PATENT DOCUMENTS

| | | | | |
|---|---|---|---|---|
| 9,447,983 | B2 * | 9/2016 | Smith | F24F 11/38 |
| 9,551,218 | B2 * | 1/2017 | Masse | E21F 1/003 |
| 10,359,748 | B2 | 7/2019 | Elbsat et al. | |
| 11,156,978 | B2 * | 10/2021 | Johnson, Jr. | F24F 11/76 |
| 2003/0055798 | A1 | 3/2003 | Hittle et al. | |
| 2015/0316907 | A1 * | 11/2015 | Elbsat | G05B 19/418 |
| 2016/0187896 | A1 * | 6/2016 | Jones | F24F 11/62 700/276 |
| 2017/0081707 | A1 | 3/2017 | Dillon et al. | |
| 2018/0238572 | A1 * | 8/2018 | Murugesan | F24F 11/30 |
| 2018/0285800 | A1 | 10/2018 | Wenzel et al. | |
| 2018/0357365 | A1 | 12/2018 | Meadow et al. | |
| 2018/0357577 | A1 | 12/2018 | Elbsat et al. | |
| 2018/0375444 | A1 | 12/2018 | Gamroth | |
| 2019/0340709 | A1 | 11/2019 | Elbsat et al. | |
| 2019/0347622 | A1 | 11/2019 | Elbsat et al. | |
| 2020/0348038 | A1 | 11/2020 | Risbeck et al. | |
| 2021/0010701 | A1 | 1/2021 | Nesler et al. | |
| 2021/0011444 | A1 | 1/2021 | Risbeck et al. | |
| 2021/0222231 | A1 | 7/2021 | Dillon et al. | |
| 2021/0356153 | A1 | 11/2021 | Nesler et al. | |
| 2022/0057099 | A1 | 2/2022 | Clement et al. | |
| 2022/0058545 | A1 | 2/2022 | Warake et al. | |
| 2022/0058556 | A1 | 2/2022 | Warake et al. | |
| 2022/0065479 | A1 | 3/2022 | Douglas et al. | |
| 2022/0082280 | A1 | 3/2022 | Douglas et al. | |
| 2022/0100918 | A1 | 3/2022 | Ploegert et al. | |
| 2022/0153320 | A1 * | 5/2022 | Liu | G06N 3/08 |
| 2022/0154956 | A1 * | 5/2022 | Maruyama | F24F 11/52 |
| 2022/0203287 | A1 | 6/2022 | Wenger et al. | |
| 2022/0203288 | A1 | 6/2022 | Wenger et al. | |
| 2022/0205962 | A1 | 6/2022 | Vanderkoy | |
| 2022/0207215 | A1 | 6/2022 | Liu et al. | |
| 2022/0221184 | A1 * | 7/2022 | Gupta | F24F 11/47 |
| 2022/0222402 | A1 * | 7/2022 | Okawachi | G06N 20/10 |
| 2022/0228756 | A1 | 7/2022 | Gupta et al. | |
| 2022/0254483 | A1 | 8/2022 | Boisvert et al. | |
| 2022/0277851 | A1 | 9/2022 | Wellig | |
| 2022/0282886 | A1 | 9/2022 | Hriljac et al. | |
| 2022/0293261 | A1 | 9/2022 | Mcbrady et al. | |
| 2022/0305438 | A1 | 9/2022 | Wenger et al. | |
| 2022/0305881 | A1 | 9/2022 | Neu et al. | |
| 2023/0042065 | A1 | 2/2023 | Douglas et al. | |
| 2023/0070313 | A1 | 3/2023 | Douglas et al. | |
| 2024/0011658 | A1 * | 1/2024 | Tsuruzono | F24F 11/0001 |
| 2024/0119190 | A1 * | 4/2024 | Kawasaki | G06Q 10/04 |
| 2024/0263816 | A1 * | 8/2024 | Ishida | F24F 11/63 |

FOREIGN PATENT DOCUMENTS

| | | | |
|---|---|---|---|
| WO | WO-2013/130956 | A1 | 9/2013 |
| WO | WO-2022/120158 | A1 | 6/2022 |

OTHER PUBLICATIONS

U.S. Appl. No. 17/541,119, filed Dec. 2, 2021.
U.S. Appl. No. 17/959,139, filed Oct. 3, 2022.
U.S. Appl. No. 17/972,454, filed Oct. 24, 2022.
U.S. Appl. No. 18/105,710, filed Feb. 3, 2023.
U.S. Appl. No. 18/106,932, filed Feb. 7, 2023.
U.S. Appl. No. 18/106,934, filed Feb. 7, 2023.
U.S. Appl. No. 18/114,127, filed Feb. 24, 2023, Smith et al.
Afram et al., "Theory and Application of HVAC Control Systems—A review of Model Predictive Control (MPC)," Building and Environment, Feb. 2014, vol. 72 (pp. 343-355).
Ahn et al., "Optimal Control Development for Chilled Water Plants Using a Quadratic Representation," Energy and Buildings, Apr. 2001, vol. 33, No. 4 (pp. 371-378).
Alvarado et al., "A Methodology to Monitor Airborne PM10 Dust Particles Using a Small Unmanned Aerial Vehicle," Sensors, 2017, vol. 17 (25 pages).
Burer et al., "Non-convex Mixed-Integer Nonlinear Programming: A Survey," Surveys in Operations Research and Management Science, Jul. 2012, vol. 17, No. 2 (pp. 97-106).
Cantoni, A., "Optimal Curve Fitting with Piecewise Linear Functions," IEEE Transactions on Computers, Jan. 1971, vol. 20, No. (pp. 59-67).
Corbin et al., "A Model Predictive Control Optimization Environment for Real-Time Commercial Building Application," Journal of Building Performance Simulation, 2013, (Published online: Jan. 11, 2012) vol. 6, No. 3 (pp. 159-174).
Drgona et al., "All you Need to Know about Model Predictive Control for Buildings," Annual Reviews in Control, 2020, vol. 50 (pp. 190-232).
EPO Notice of Opposition to a European Patent issued in Appl. Ser. No. EP 16165681.4 dated May 2, 2023 (48 pages).
U.S. Appl. No. 18/114,129, filed Feb. 24, 2023.
EPO Notice of Opposition to a European Patent issued in Appl. Ser. No. EP 16165681.4 dated May 2, 2023 (51 pages).
EPO Notice of Opposition to a European Patent with Consolidated List issued in EP Appl. Ser. No. 16165681.4 dated May 2, 2023 (4 pages).
EPO Office Action on EP Appl. Ser. No. 16165681.4 dated Apr. 6, 2021 (7 pages).
EPO Search Opinion EP Appl. Ser. No. EP 22177772.5 dated Sep. 26, 2022 (6 pages).
Extended European Search Report on EP Appl. Ser. No. 16165681.4 dated Oct. 20, 2016 (5 pages).
Extended European Search Report on EP Appl. Ser. No. 22177772.5 dated Sep. 26, 2022 (11 pages).
Hackner, J.R., "HVAC system dynamics and energy use in existing buildings," Doctoral Dissertation, University of Madison, Wisconsin, 1984 (174 pages).
Haves et al., "Model Predictive Control of HVAC Systems: Implementation and Testing at the University of California, Merced," Technical Report, U.S. Department of Energy Office of Scientific and Technical Information, Jun. 29, 2010 (140 pages).
Huang et al., "A New Model Predictive Control Scheme for Energy and Cost Savings in Commercial Buildings: An Airport Terminal Building Case Study," Building and Environment, Jul. 2015, vol. 89 (pp. 203-216).
Kelman et al., "Analysis of Local Optima in Predictive Control for Energy Efficient Buildings," Journal of Building Performance Simulation, Apr. 16, 2012, vol. 6, No. 3 (pp. 236-255).
Koehler et al., "Building Temperature Distributed Control via Explicit MPC and 'Trim and Respond' Methods," European Control Conference (ECC), Jul. 17-19, 2013, Zurich, Switzerland (pp. 4334-4339).
Kwadzogah et al., "Model Predictive Control for HVAC Systems—A Review," 2013 IEEE International Conference on Automation Science and Engineering, Model Predictive Control for HVAC Systems—A Review, 2013 IEEE International Conference on Automation Science and Engineering (CASE), Madison, WI, United States, Aug. 17-20, 2013 (pp. 442-447).
McKenna et al., "A TRNSYS model of a building HVAC system with GSHP and PCM thermal energy storage—component modelling and validation," Proceedings of BS2013: 13th Conference of International Building Performance Simulation Association, Chambéry, France, Aug. 26-28, 2013 (pp. 3336-3343).
Mossolly et al., "Optimal Control Strategy for a Multizone Air Conditioning System Using a Genetic Algorithm," Energy, Jan. 2009, vol. 34, No. 1 (pp. 58-66).

(56) References Cited

OTHER PUBLICATIONS

Nassif et al., "Optimization of HVAC Control System Strategy Using Two-Objective genetic Algorithm," International Journal of Hva C&R Research, vol. 11, No. 3 (pp. 459-486).
Sourbon et al., "Dynamic Thermal Behaviour of Buildings with Concrete Core Activation," Dissertation, Arenberg Doctoral School of Science, Engineering & Technology, Katholieke Universiteit Leuven—Faculty of Engineering Celestijnenlaan: 300A box 2421, B-3001 Heverlee (Belgium) Sep. 2012 (416 pages).
Stluka et al., "Energy Management for Buildings and Microgrids," 2011 50th IEEE Conference on Decision and Control and European Control Conference (CDCECC) Orlando, FL, USA, Dec. 12-15, 2011 (pp. 5150-5157).
Strurznegger, D., "Model Predictive Building Climate Control, Steps Towards Practice," Doctoral Thesis, Automatic Control Laboratory, Zurich, Switzerland, 2014 (176 pages).
Sun et al., Optimal Control of Building HVAC&R Systems Using Complete Simulation-Based Sequential Quadratic Programming (CSB-SQP), Building and Environment, May 2005, vol. 40, No. 5 (pp. 657-669).
Third Party Observation Report on EP Appl. Ser. No. 16165681.4 dated Jan. 15, 2020 (8 pages).
Third Party Observation Report on EP Appl. Ser. No. 16165681.4 dated Oct. 5, 2018 (6 pages).
Verhelst et al., "Study of the Optimal Control Problem Formulation for Modulating Air-to-Water Heat Pumps Connected to a Residential Floor Heating System," Energy and Buildings, Feb. 2012, vol. 45 (pp. 43-53).
Verhelst, C., "Model Predictive Control of Ground Coupled Heat Pump Systems in Office Buildings," Dissertation, Arenberg Doctoral School of Science, Engineering & Technology, Katholieke Universiteit Leuven—Faculty of Engineering Celestijnenlaan : 300A box 2421, B-3001 Heverlee (Belgium) Apr. 20, 2012 (316 pages).
Wang et al., "Model-Based Optimal Control of VAV Air-Conditioning System Using Genetic Algorithm," Building and Environment, Aug. 2000, vol. 35, No. 6 (pp. 471-487).
Wang et al., "Supervisory and Optimal Control of Building HVAC Systems: A Review," HVAC&R Research, Jan. 2008, vol. 14, No. 1 (pp. 3-32).
Xi et al., "Support Vector Regression Model Predictive Control on a HVAC Plant," Control Engineering Practice, Aug. 2007, vol. 15, No. 8 (pp. 897-908).
Yao et al., "Global Optimization of a Central Air-Conditioning System Using Decomposition-Coordination Method," Energy and Buildings, May 2010, vol. 42, No. 5 (pp. 570-583).

* cited by examiner

1000

| Age (y) | Mean Body Mass (kg) | BMR (MJ/Day) | $CO_2$ Generation Rate (L/s) Level of Physical Activity (Met) 1.0 | 1.2 | 1.4 | 1.6 | 2.0 | 3.0 | 4.0 |
|---|---|---|---|---|---|---|---|---|---|
| **Males** | | | | | | | | | |
| <1 | 8.0 | 1.86 | 0.0009 | 0.0011 | 0.0013 | 0.0014 | 0.0018 | 0.0027 | 0.0036 |
| 1 to <3 | 12.8 | 3.05 | 0.0015 | 0.0018 | 0.0021 | 0.0024 | 0.0030 | 0.0044 | 0.0059 |
| 3 to <6 | 18.8 | 3.90 | 0.0019 | 0.0023 | 0.0026 | 0.0030 | 0.0038 | 0.0057 | 0.0075 |
| 6 to < 11 | 31.9 | 5.14 | 0.0025 | 0.0030 | 0.0035 | 0.0040 | 0.0050 | 0.0075 | 0.0100 |
| 11 to <16 | 57.6 | 7.02 | 0.0034 | 0.0041 | 0.0048 | 0.0054 | 0.0068 | 0.0102 | 0.0136 |
| 16 to <21 | 77.3 | 7.77 | 0.0037 | 0.0045 | 0.0053 | 0.0060 | 0.0075 | 0.0113 | 0.0150 |
| 21 to < 30 | 84.9 | 8.24 | 0.0039 | 0.0048 | 0.0056 | 0.0064 | 0.0080 | 0.0120 | 0.0160 |
| 30 to < 40 | 87.0 | 7.83 | 0.0037 | 0.0046 | 0.0053 | 0.0061 | 0.0076 | 0.0114 | 0.0152 |
| 40 to < 50 | 90.5 | 8.00 | 0.0038 | 0.0046 | 0.0054 | 0.0062 | 0.0077 | 0.0116 | 0.0155 |
| 50 to < 60 | 89.5 | 7.95 | 0.0038 | 0.0046 | 0.0054 | 0.0062 | 0.0077 | 0.0116 | 0.0154 |
| 60 to < 70 | 89.5 | 6.84 | 0.0033 | 0.0040 | 0.0046 | 0.0053 | 0.0066 | 0.0099 | 0.0133 |
| 70 to < 80 | 83.9 | 6.57 | 0.0031 | 0.0038 | 0.0045 | 0.0051 | 0.0064 | 0.0095 | 0.0127 |
| ≥ 80 | 76.1 | 6.19 | 0.0030 | 0.0036 | 0.0042 | 0.0048 | 0.0060 | 0.0090 | 0.0120 |
| **Females** | | | | | | | | | |
| < 1 | 7.7 | 1.75 | 0.0008 | 0.0010 | 0.0012 | 0.0014 | 0.0017 | 0.0025 | 0.0034 |
| 1 to < 3 | 12.3 | 2.88 | 0.0014 | 0.0017 | 0.0020 | 0.0022 | 0.0028 | 0.0042 | 0.0056 |
| 3 to < 6 | 18.3 | 3.59 | 0.0017 | 0.0021 | 0.0024 | 0.0028 | 0.0035 | 0.0052 | 0.0070 |
| 6 to < 11 | 31.7 | 4.73 | 0.0023 | 0.0027 | 0.0032 | 0.0037 | 0.0046 | 0.0069 | 0.0092 |
| 11 to < 16 | 55.9 | 6.03 | 0.0029 | 0.0035 | 0.0041 | 0.0047 | 0.0058 | 0.0088 | 0.0117 |
| 16 to < 21 | 65.9 | 6.12 | 0.0029 | 0.0036 | 0.0042 | 0.0047 | 0.0059 | 0.0089 | 0.0119 |
| 21 to < 30 | 71.9 | 6.49 | 0.0031 | 0.0038 | 0.0044 | 0.0050 | 0.0063 | 0.0094 | 0.0126 |
| 30 to < 40 | 74.8 | 6.08 | 0.0029 | 0.0035 | 0.0041 | 0.0047 | 0.0059 | 0.0088 | 0.0118 |
| 40 to < 50 | 77.1 | 6.16 | 0.0029 | 0.0036 | 0.0042 | 0.0048 | 0.0060 | 0.0090 | 0.0119 |
| 50 to < 60 | 77.5 | 6.17 | 0.0030 | 0.0036 | 0.0042 | 0.0048 | 0.0060 | 0.0090 | 0.0120 |
| 60 to < 70 | 76.8 | 5.67 | 0.0027 | 0.0033 | 0.0038 | 0.0044 | 0.0055 | 0.0082 | 0.0110 |
| 70 to < 80 | 70.8 | 5.45 | 0.0026 | 0.0032 | 0.0037 | 0.0042 | 0.0053 | 0.0079 | 0.0106 |
| ≥ 80 | 64.1 | 5.19 | 0.0025 | 0.0030 | 0.0035 | 0.0040 | 0.0050 | 0.0075 | 0.0101 |

FIG. 10

1100

| Age | Mean Body Mass (kg) | BMR (MJ/Day) | CO2 Generation Rate(L/s) | | | | | | |
|---|---|---|---|---|---|---|---|---|---|
| | | | Level of Physical Activity(Met) | | | | | | |
| | | | 1.0 | 1.2 | 1.4 | 1.6 | 2.0 | 3.0 | 4.0 |
| **Males** | | | | | | | | | |
| 6 to <11 | 31.9 | 5.14 | 0.0025 | 0.0030 | 0.0035 | 0.0040 | 0.0050 | 0.0075 | 0.0100 |
| 11 to <16 | 57.6 | 7.02 | 0.0034 | 0.0041 | 0.0048 | 0.0054 | 0.0068 | 0.0102 | 0.0136 |
| 16 to < 60 | 89.0 | 8.00 | 0.0037 | 0.0046 | 0.0053 | 0.0061 | 0.0076 | 0.0114 | 0.0152 |
| ≥ 60 | 80.0 | 6.50 | 0.0033 | 0.0040 | 0.0046 | 0.0053 | 0.0066 | 0.0099 | 0.0133 |
| **Females** | | | | | | | | | |
| 6 to <11 | 31.7 | 4.73 | 0.0023 | 0.0027 | 0.0032 | 0.0037 | 0.0046 | 0.0069 | 0.0092 |
| 11 to <16 | 55.9 | 6.03 | 0.0029 | 0.0035 | 0.0041 | 0.0047 | 0.0058 | 0.0088 | 0.0117 |
| 16 to < 60 | 77.0 | 6.16 | 0.0029 | 0.0035 | 0.0041 | 0.0047 | 0.0059 | 0.0088 | 0.0118 |
| ≥ 60 | 72.0 | 5.45 | 0.0027 | 0.0033 | 0.0038 | 0.0044 | 0.0055 | 0.0082 | 0.0110 |

FIG. 11

1300

| Occupancy Category | Air Rate cfm/person | Air Rate L/(s·person) | Air Rate cfm/ft$^2$ | Air Rate L/(s·m$^2$) |
|---|---|---|---|---|
| Office Space | 5 | 2.5 | 0.06 | 0.3 |
| Reception Areas | 5 | 2.5 | 0.06 | 0.3 |
| Day Care | 10 | 5 | 0.18 | 0.9 |
| Classroom | 10 | 5 | 0.12 | 0.6 |
| Lecture Classroom | 7.5 | 3.8 | 0.06 | 0.3 |
| Art Classroom | 10 | 5 | 0.18 | 0.9 |
| Science Lab | 10 | 5 | 0.18 | 0.9 |
| University Lab | 10 | 5 | 0.18 | 0.9 |
| Computer Lab | 10 | 5 | 0.12 | 0.6 |
| Music/Theater/Dance | 10 | 5 | 0.06 | 0.3 |
| Multiuse Assembly | 7.5 | 3.8 | 0.06 | 0.3 |
| Cafeteria | 7.5 | 3.8 | 0.18 | 0.9 |
| Break Room | 5 | 2.5 | 0.06 | 0.3 |
| Conference/Meeting | 5 | 2.5 | 0.06 | 0.3 |

FIG. 13

1500

| IECC | Type | City |
|---|---|---|
| 1A | Very Hot, Humid | Miami, FL<br>Honolulu, HI |
| 2A | Hot, Humid | Houston, TX |
| 2B | Hot, Dry | Phoenix, AZ |
| 3A | Mixed, Humid | Oklahoma City, OK<br>Charlotte, NC |
| 3A | Warm, Humid | Atlanta, GA |
| 3A | Hot, Humid | Charleston, SC |
| 3B | Mixed, Dry | Los Angeles, CA |
| 3B | Warm, Dry | Las Vegas, NV |
| 3C | Marine | San Francisco, CA |
| 4A | Mixed, Humid | Baltimore, MD<br>New York, NY |
| 4B | Mixed, Dry | Albuquerque, NM |
| 4C | Mixed, Marine | Seattle, WA |
| 5A | Cold, Humid | Chicago, IL<br>Boston, MA<br>Kansas City, KS |
| 5B | Cold, Dry | Boulder, CO<br>Salt Lake City, UT |
| 6A | Cold Humid | Minneapolis, MN<br>Milwaukee, WI |
| 6B | Cold Dry | Helena, MT |
| 7 | Very Cold | Duluth, MN |
| 8 | Subarctic | Fairbanks, AK |

FIG. 15

2400

| Cluster Index | Room Number | Cluster Index | Room Number |
|---|---|---|---|
| 1 | 23 25 19 11 1 2 20 24 9 | 8 | 22 |
| 2 | 17 | 9 | 15 |
| 3 | 7 | 10 | 12 |
| 4 | 4 6 5 | 11 | 13 |
| 5 | 3 | 12 | 16 |
| 6 | 18 | 13 | 14 |
| 7 | 21 | 14 | 10 |

FIG. 24

2600

| Cluster Index | Room Number |
|---|---|
| 1 | 23 25 19 11 1 2 20 24 8 9 17 7 4 6 5 3 18 21 22 15 12 13 16 |
| 2 | 14 |
| 3 | 10 |

FIG. 26

2800

| Romm Cluster | Sunday | Monday | Tuesday | Wednesday | Thursday | Friday | Saturday |
|---|---|---|---|---|---|---|---|
| 1 | N/A, N/A | 6.5, 19.5 | 6.5, 19.5 | 10, 12.75 | 6.5, 19.5 | 10, 12.75 | N/A, N/A |
| 2 | N/A, N/A | 7.25, 15.75 | 7.25, 15.75 | 7.25, 15.75 | 7.25, 15.75 | 7.25, 15.75 | N/A, N/A |
| 3 | N/A, N/A | 7.5, 20.75 | 7.5, 20.75 | 7.5, 20.75 | 7.5, 20.75 | 7.5, 20.75 | N/A, N/A |

FIG. 28

BUILDING MANAGEMENT SYSTEM WITH CLEAN AIR FEATURES

CROSS-REFERENCE TO RELATED PATENT APPLICATIONS

This application claims the benefit of and priority to U.S. Provisional Application No. 63/308,114, filed Feb. 9, 2022, and U.S. Provisional Application No. 63/347,949 filed Jun. 1, 2022, both of which are incorporated by reference herein in their entireties for all purposes.

BACKGROUND

The present disclosure relates generally to HVAC systems for a building and more particularly to clean air features in a building HVAC system. Generally indoor air quality (IAQ) data can be collected to enable controllers and HVAC systems to make more informed determinations on ventilation, scheduling, and HVAC equipment operations. In particular, the determinations can be directed towards improve the overall air quality and energy efficiency of the building.

SUMMARY

Some embodiments relate to a building management system (BMS) for controlling building equipment based on an indoor air quality (IAQ) ventilation analysis of a building, the BMS including, a controller including memory and one or more processors configured to collect IAQ data from one or more sensors within the building, estimate a plurality of outdoor airflow rates for an area of the building during a plurality of transient periods using the IAQ data as input, generate a time series outdoor airflow rate includes the plurality of estimated outdoor airflow rates, and modify a control strategy for the area of the building based on the time series outdoor airflow rate and a ventilation schedule for the area of the building.

In some embodiments, the one or more processors further configured to determine a transient period of the plurality of transient periods based on analyzing the IAQ data and identifying at least one of (1) a period of time longer than a minimum length of time (2) a peek-to-peek concentration change greater than a minimum peek-to-peek concentration change, (3) a decay rate greater than a minimum decay rate, and (4) a derivative peek in the first half of the period of time.

In some embodiments, determining the transient period is further based on detecting, from the one or more sensors, at least one occupant previously entered or previously left one or more areas of the building based on the continuously collected IAQ data.

In some embodiments, the one or more processors further configured to determine an estimated outdoor airflow rate of the plurality of estimated outdoor airflow rates during the transient period based on analyzing a relationship between each of a plurality of possible outdoor airflow rates and a corresponding regression error of a plurality of regression errors of a regression model, and selecting a possible outdoor airflow rate of the plurality of possible outdoor airflow rates as the estimated outdoor airflow rate for the transient period based on identifying a minimum regression error of the relationship.

In some embodiments, the one or more processors further configured to in response to the estimated outdoor airflow rate including an uncertainty above an uncertainty threshold, select a default outdoor airflow rate as the estimated outdoor airflow rate for the transient period.

In some embodiments, the uncertainty is calculated based on defining an objective function based on mapping the plurality of outdoor airflow rates to a scaler value, minimizing the objective function based on determining an outdoor airflow rate of the plurality of outdoor airflow rates that results in a minimum objective value, and determining a range of outdoor airflow rates less than a threshold based on the minimum objective value, wherein the range of outdoor airflow rates is centered around the minimum objective value, and wherein a width of the range is a measure of the uncertainty associated with the minimum objective value.

In some embodiments, wherein an occupancy estimate and particle generation rate are back calculated based on calculating a time series particle disturbance based on the time series outdoor airflow rate and the IAQ data, wherein an increase in a portion of the time series particle disturbance indicates an increase in occupancy of the area of the building, and calculating a particle generation rate based on an occupancy dataset including occupant ages and occupant metabolic rates.

In some embodiments, wherein modifying the control strategy causes the BMS to implement the control strategy to control HVAC equipment of the building, wherein the control strategy further includes adjusting at least one control of the HVAC equipment based on one or more instructions, and wherein the one or more processors are further configured to calculate an operating cost of the time series outdoor airflow rate according to the ventilation schedule, and optimize the ventilation schedule based either (1) maintaining the time series outdoor airflow rate to one or more HVAC standards or code and minimizing the operating cost, or (2) maximizing the time series outdoor airflow rate and maintaining the operating cost below a predefined threshold.

In some embodiments, the area is an HVAC zone of the building, and wherein the IAQ data includes at least indoor $CO_2$ concentrations and outdoor $CO_2$ concentrations.

In some embodiments, the one or more processors further configured to determine an area occupancy schedule based on executing an occupancy schedule model, wherein the area occupancy schedule includes a plurality of occupied periods, and modify the control strategy for the area of the building based on the area occupancy schedule.

In some embodiments, the one or more processors further configured to execute the occupancy schedule model by determining a time series $CO_2$ disturbance based on the time series outdoor airflow rate and the IAQ data, filtering the time series $CO_2$ disturbance to generate a filtered time series $CO_2$ disturbance, calculating a first derivative of the filtered time series $CO_2$ disturbance, calculating a daily $CO_2$ disturbance range of the filtered time series $CO_2$ disturbance to determine one or more outlier days, determining a first data point of the filtered time series $CO_2$ disturbance and a second data point of the filtered first derivative time series $CO_2$ disturbance, wherein the first data point of the filtered time series $CO_2$ disturbance is a $CO_2$ disturbance threshold, and wherein the second data point of the filtered first derivative time series $CO_2$ disturbance is a first derivative $CO_2$ disturbance threshold, wherein determining the first data point and the second data point is based on executing a regression model excluding the one or more outlier days, identifying, using the filtered time series $CO_2$ disturbance, a first occupied time range for a day, the first occupied time range for the day includes a first start time from the filtered time series $CO_2$ disturbance that is greater than the $CO_2$ disturbance threshold and a first end time from the filtered time series CO2 disturbance that is less than the CO2 disturbance threshold, wherein the first end time is after the first start time, identifying, using the filtered first derivative time series CO2 disturbance, a second occupied time range for the day, the second occupied time range for the day includes a second start time from the filtered first derivative time series CO2 disturbance that is greater than the first derivative CO2 disturbance threshold and a second end time from the filtered first derivative time series CO2 disturbance that is less than the first derivative CO2 disturbance threshold, wherein the second end time is after the second start time, combining the first occupied time range and the second occupied time range for the day based on overlapping occupied time ranges to create the area occupancy schedule, and updating the ventilation schedule based on the combined occupied time ranges.

In some embodiments, the one or more processors further configured to cluster a plurality of area occupancy schedules that includes the area occupancy schedule based on a plurality of clustering indexes, wherein the plurality of clustering indexes are determined based on calculating a plurality of similar disturbances between the plurality of area occupancy schedules, plotting the plurality of similar disturbances based on applying hierarchical clustering to the calculated plurality of similar disturbances, determining a third data point of the plotted plurality of similar disturbances based on executing the regression model, wherein the third data point of the plotted plurality of similar disturbances is an area cluster separation threshold, clustering each of the plurality of area occupancy schedules into one of the plurality of clustering indexes based on the area cluster separation threshold, and in response to a number of the plurality of clustering indexes being above a scheduling threshold, re-clustering each of plurality of area occupancy schedules into one of the plurality of clustering indexes based on a maximum area cluster separation threshold.

In some embodiments, the one or more processors further configured to determine a weekly schedule of each of the clustered plurality of area occupancy schedules for each of the plurality of clustering indexes, wherein the weekly schedule is determined based on calculating each distance of a plurality of distances between each day of the clustered plurality of area occupancy schedules for one of the plurality of clustering indexes, plotting the plurality of distances based on applying the hierarchical clustering to the calculated plurality of distances, determining a fourth data point of the plotted plurality of distances based on executing the regression model, wherein the fourth data point of the plotted plurality of distances is a schedule cluster separation threshold, clustering each of the clustered plurality of area occupancy schedules into one of a plurality of schedule clustering indexes based on the schedule cluster separation threshold, modify the control strategy for a plurality of areas of the building based on the clustered plurality of area occupancy schedules and the plurality of schedule clustering indexes.

Some embodiments relate to a computer-implemented method for controlling building equipment based on an indoor air quality (IAQ) ventilation analysis of a building, the computer-implemented method including determining, by a processing circuit, an area occupancy schedule based on executing an occupancy schedule model, wherein the area occupancy schedule includes a plurality of occupied periods, and wherein executing the occupancy schedule model includes determining, by the processing circuit, a time series particle disturbance based on a time series outdoor airflow rate and IAQ data, determining, by the processing circuit, one or more data points of the time series particle disturbance, wherein each of the one or more data points is a particle disturbance threshold, wherein determining the one or more data points is based on executing a regression model, identifying, by the processing circuit using the time series particle disturbance, a plurality of occupied time ranges for a day, wherein each of the plurality of occupied time ranges includes a start time from that is greater than the particle disturbance threshold and an end time from that is less than the particle disturbance threshold, combining, by the processing circuit, the plurality of occupied time ranges for the day based on overlapping occupied time ranges to create the area occupancy schedule, and modifying, by the processing circuit, a control strategy for an area of the building based on the area occupancy schedule.

In some embodiments, the computer-implemented method further includes clustering, by the processing circuit, a plurality of area occupancy schedules that includes the area occupancy schedule based on a plurality of clustering indexes, wherein the plurality of clustering indexes are determined based on calculating, by the processing circuit, a plurality of similar disturbances between the plurality of area occupancy schedules, plotting, by the processing circuit, the plurality of similar disturbances based on applying hierarchical clustering to the calculated plurality of similar disturbances, determining, by the processing circuit, a third data point of the plotted plurality of similar disturbances based on executing the regression model, wherein the third data point of the plotted plurality of similar disturbances is an area cluster separation threshold, clustering, by the processing circuit, each of the plurality of area occupancy schedules into one of the plurality of clustering indexes based on the area cluster separation threshold, and in response to a number of the plurality of clustering indexes being above a scheduling threshold, re-clustering, by the processing circuit, each of plurality of area occupancy schedules into one of the plurality of clustering indexes based on a maximum area cluster separation threshold.

In some embodiments, calculating the plurality of similar disturbances includes calculating at least one of (1) a hamming distance, (2) a CO2 correlation, (3) a cosine similarity, or (4) a tanimoto coefficient between the area occupancy schedule and at least another area occupancy schedule.

In some embodiments, the computer-implemented method further includes determining, by the processing circuit, a weekly schedule of each of the clustered plurality of area occupancy schedules for each of the plurality of clustering indexes, wherein the weekly schedule is determined based on calculating, by the processing circuit, each distance of a plurality of distances between each day of the clustered plurality of area occupancy schedules for one of the plurality of clustering indexes, plotting, by the processing circuit, the plurality of distances based on applying the hierarchical clustering to the calculated plurality of distances, determining, by the processing circuit, a fourth data point of the plotted plurality of distances based on executing the regression model, wherein the fourth data point of the plotted plurality of distances is a schedule cluster separation threshold, clustering, by the processing circuit, each of the clustered plurality of area occupancy schedules into one of a plurality of schedule clustering indexes based on the schedule cluster separation threshold, and modifying, by the processing circuit, the control strategy for a plurality of areas of the building based on the clustered plurality of area occupancy schedules and the plurality of room clustering indexes.

Some embodiments relate to abuilding management system (BMS) for controlling building equipment based on an indoor air quality (IAQ) ventilation analysis of a building, the BMS including a controller including memory and one or more processors configured to collect IAQ data from one or more sensors within the building, use the IAQ data to (i) identify a transient time period and (ii) estimate an outdoor airflow rate for an area of the building during the transient time period, and modify a control strategy for the area of the building in response to detecting a deviation between (i) the outdoor airflow rate estimated using the IAQ data and (ii) a ventilation schedule for the area of the building.

In some embodiments, the one or more processors further configured to determine the transient period based on analyzing the IAQ data and identifying at least one of (1) a period of time longer than a minimum length of time (2) a peek-to-peek concentration change greater than a minimum peek-to-peek concentration change, (3) a decay rate greater than a minimum decay rate, and (4) a derivative peek in the first half of the period of time.

In some embodiments, the one or more processors further configured to determine the estimated outdoor airflow rate during the transient period based on analyzing a relationship between each of a plurality of possible outdoor airflow rates and a corresponding regression error of a plurality of regression errors of a regression model, and selecting a possible outdoor airflow rate of the plurality of possible outdoor airflow rates as the estimated outdoor airflow rate for the transient period based on identifying a minimum regression error of the relationship.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements

FIG. 10 depicts a table regarding estimating average $CO_2$ generation rate per person, according to some embodiments.

FIG. 11 depicts another table regarding estimating average $CO_2$ generation rate per person, according to some embodiments.

FIG. 13 depicts a table including American Society of Heating, Refrigerating and Air-Conditioning Engineers (ASHRAE) recommended outdoor airflow rates based on the zone area, according to some embodiments.

FIG. 15 depicts a table of weather data, according to some embodiments.

FIG. 24 depicts cluster indexes associated with one or more rooms grouped together, according to some embodiments.

FIG. 26 depicts cluster indexes associated with one or more rooms grouped together, according to some embodiments.

FIG. 28 depict room clusters associated a weekly schedule for a plurality rooms of the cluster, according to some embodiments.

It will be recognized that some or all of the figures are schematic representations for purposes of illustration. The figures are provided for the purpose of illustrating one or more embodiments with the explicit understanding that they will not be used to limit the scope or the meaning of the claims.

DETAILED DESCRIPTION

Referring generally to the FIGURES, systems and methods are provided by monitoring air quality in a building within multiple spaces or areas. According to various example embodiments, a building management system can monitor aspects of indoor air quality (IAQ) and/or controlling aspects of building equipment, such as heating, ventilation, and/or air conditioning (HVAC) equipment, using IAQ data. Some aspects of the present disclosure relate to estimation of outdoor airflow rates, energy savings, and room occupied schedule analysis from IAQ data. In some embodiments, outdoor airflow rates for particular spaces or areas within a building may be estimated using a regression model that incorporates IAQ data and determined transient periods or windows. In some embodiments, energy savings can be determined for different ventilation control strategies. In some embodiments, room occupied schedule analysis can be performed such that spaces or areas can be clustered with specific daily schedules unique to each cluster.

Additionally, the disclosure describes various methods and systems for estimating outdoor airflow rates and determining transient periods, as well as clustering, occupancy schedules, infection risk, and other characteristics. The methods and systems include using IAQ data, such as $CO_2$, temperature, humidity, volatile organic compounds (VOCs), particulate matter (e.g., PM2.5), and other data, to determine scheduling and zones. The disclosure also describes systems and methods for identifying zones that should be given attention and for rebalancing for efficient demand control ventilation. Other systems and methods include using model predictive control (MPC) for demand control ventilation, and using other types of environment data for calculating infection risk, $CO_2$ disturbance, and other characteristics. Additionally, the disclosure describes systems and methods for calculating uncertainty in outdoor airflow rate, occupancy estimate, and other characteristics, and for calculating potential savings from demand controlled ventilation and cost to bring to standard.

Building HVAC Systems and Building Management Systems

Figure 1:
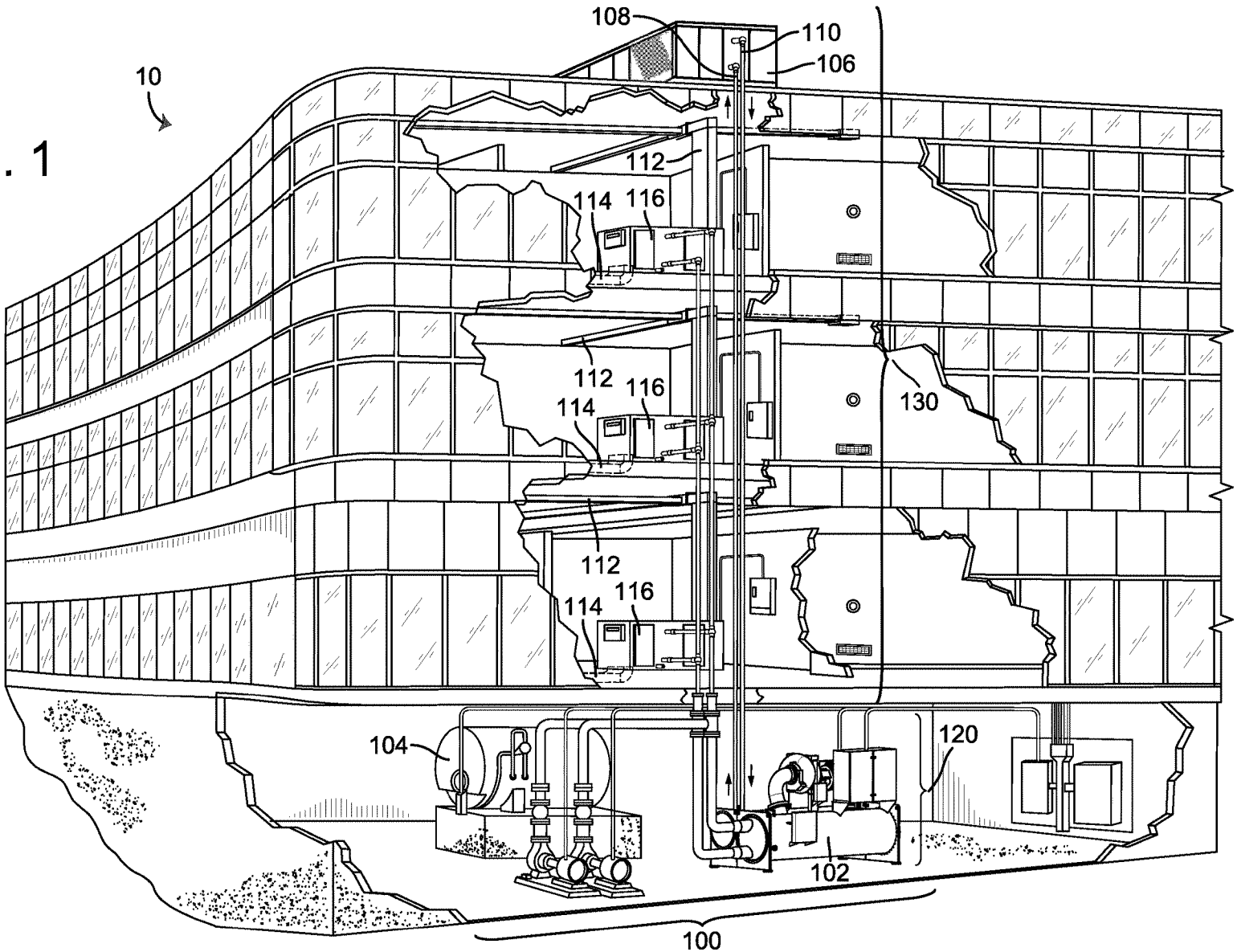
FIG. 1 is a drawing of a building equipped with a HVAC system, according to some embodiments.
Figure 2:
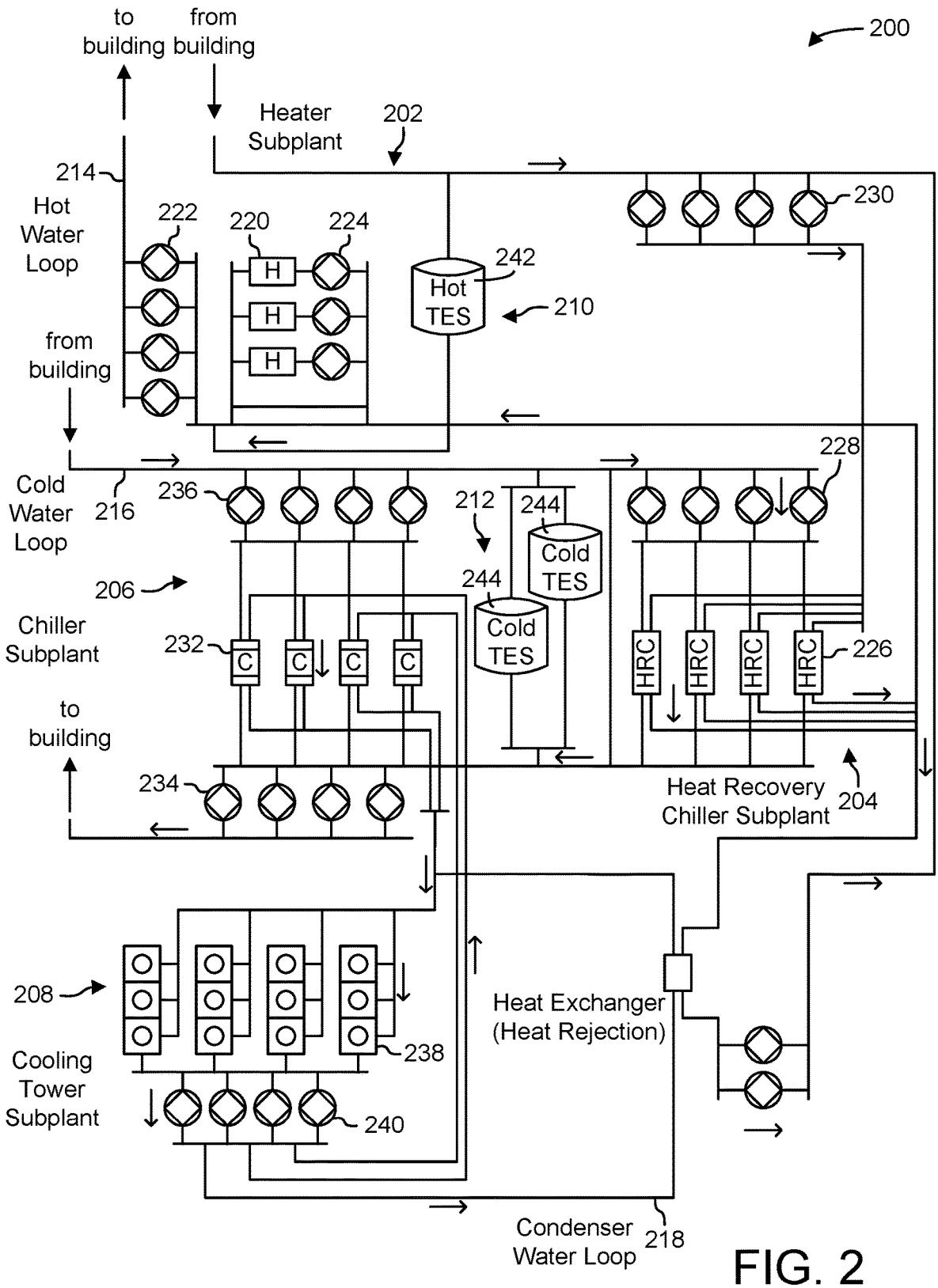
FIG. 2 is a schematic diagram of a waterside system which can be used in conjunction with the building of FIG. 1, according to some embodiments.
Figure 3:
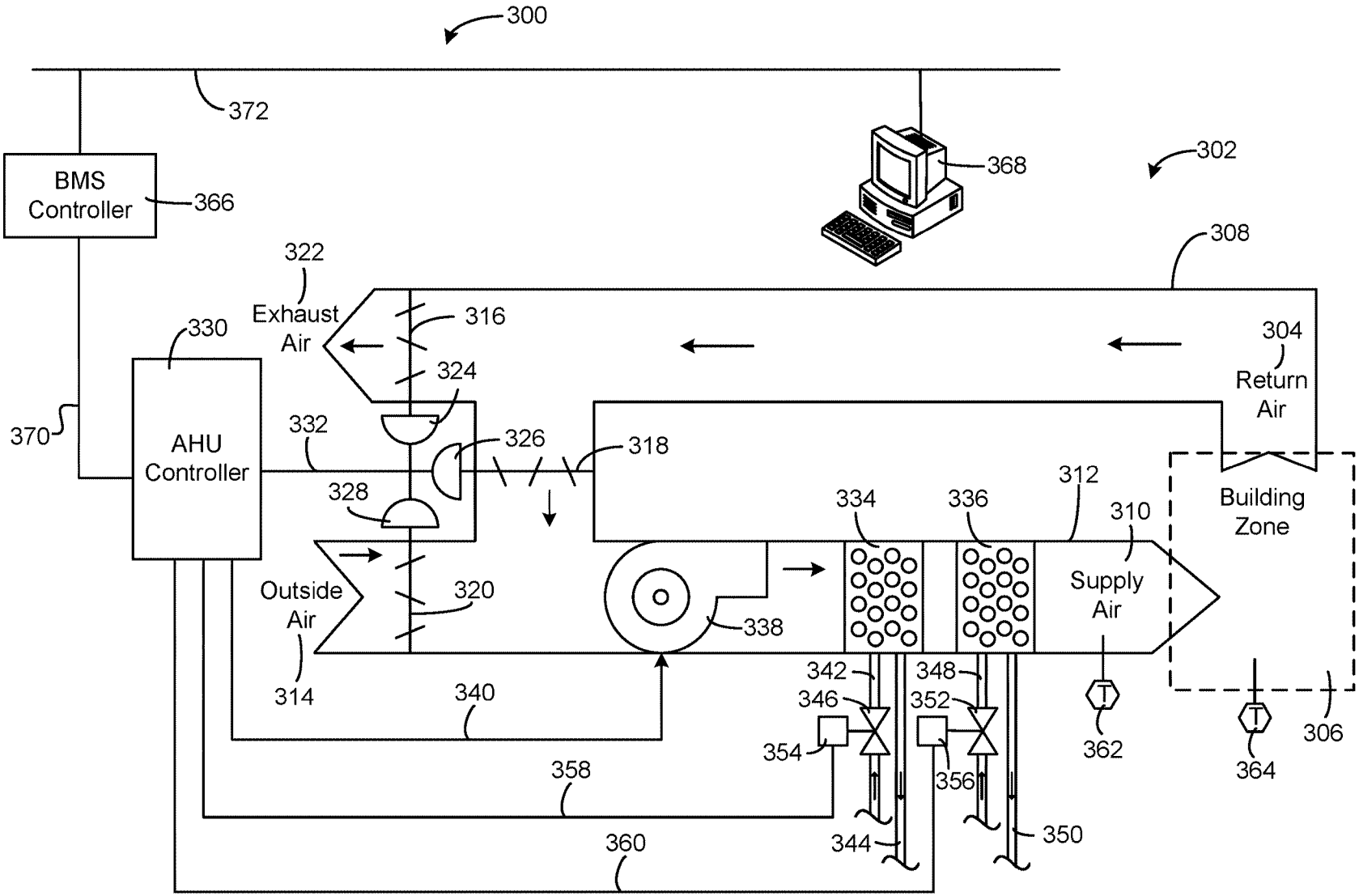
FIG. 3 is a schematic diagram of an airside system which can be used in conjunction with the building of FIG. 1, according to some embodiments.
Figure 4:
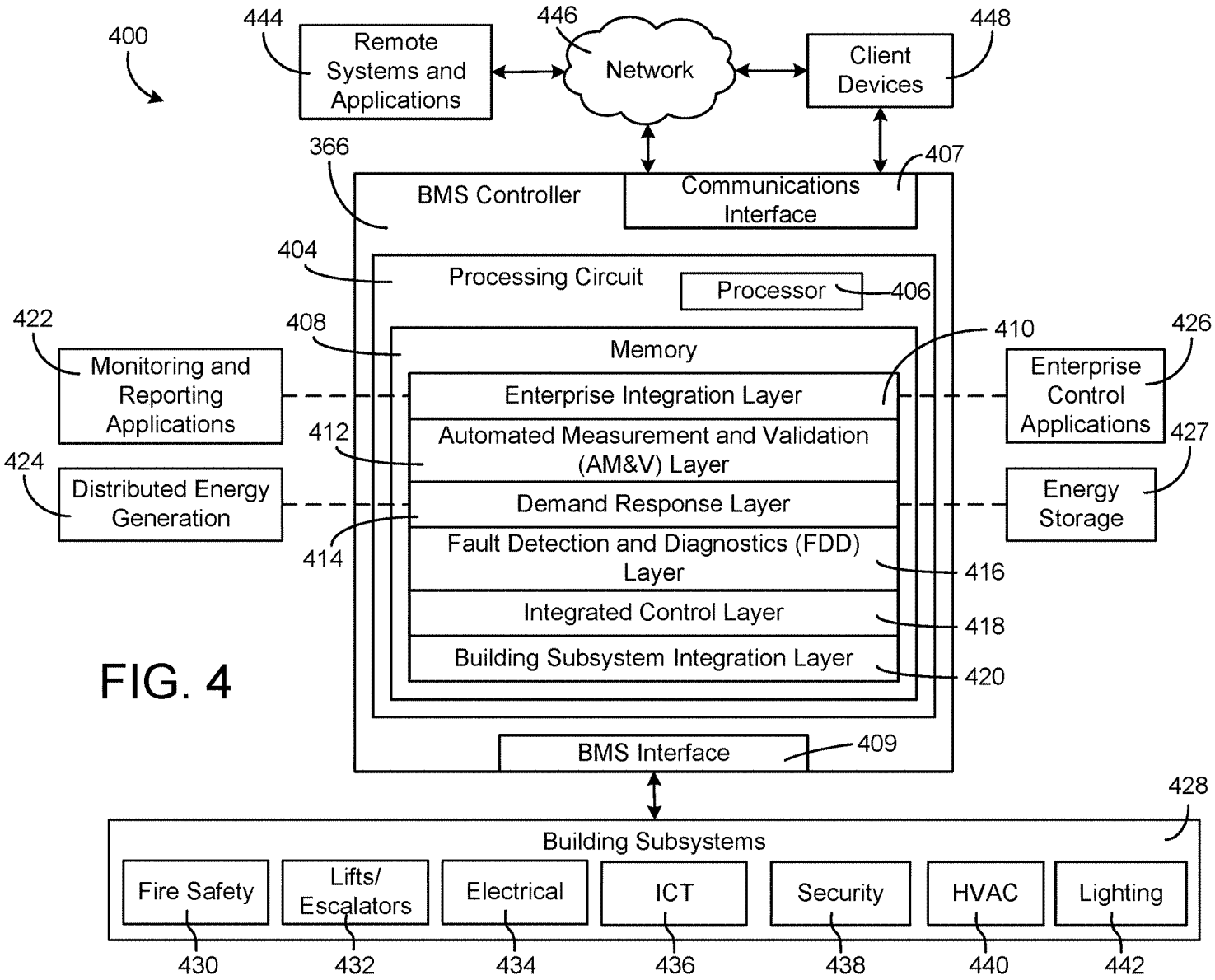
FIG. 4 is a block diagram of a building management system (BMS) which can be used to monitor and control the building of FIG. 1, according to some embodiments.
Figure 5:
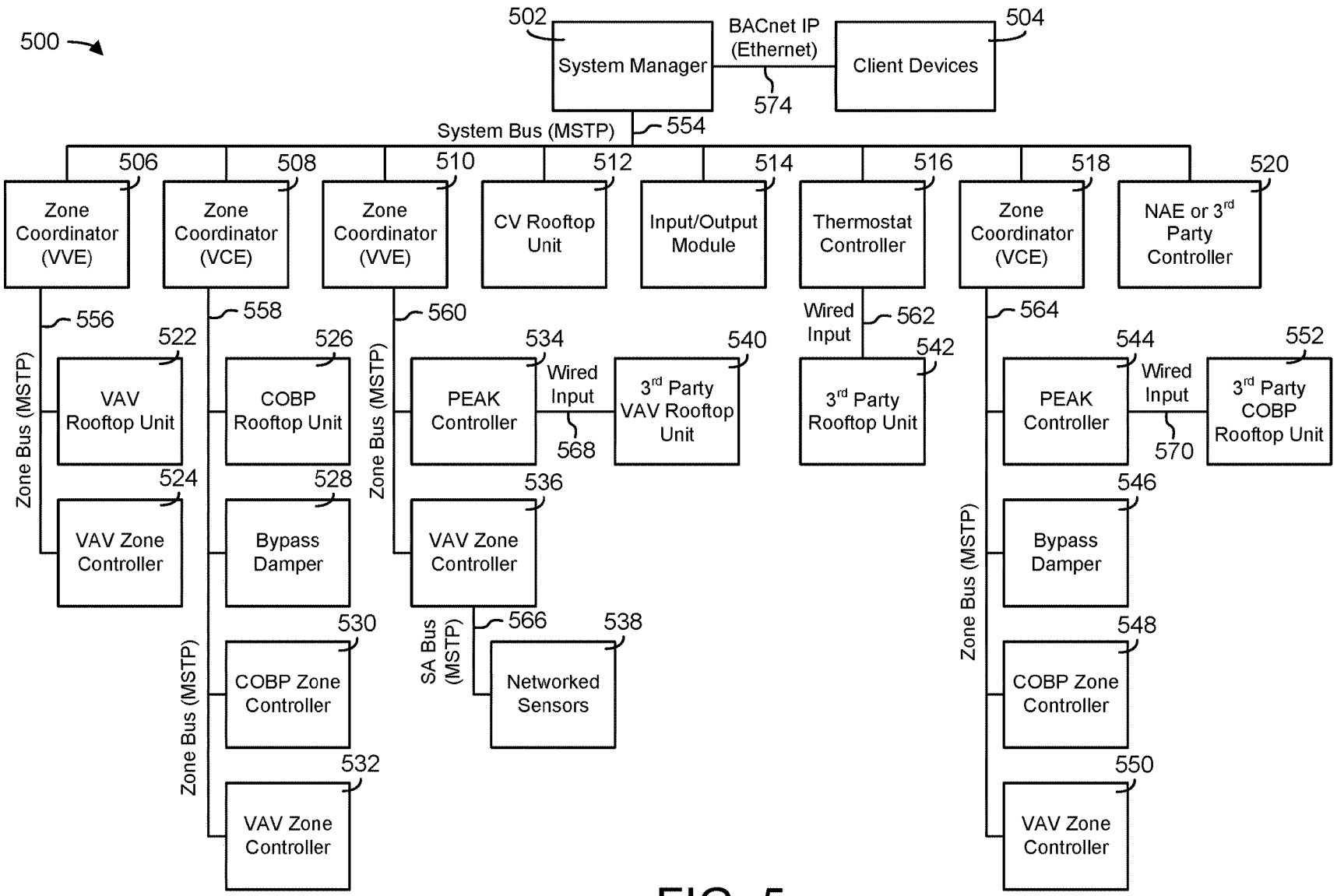
FIG. 5 is a block diagram of another BMS which can be used to monitor and control the building of FIG. 1, according to some embodiments.

Referring now to FIGS. 1-5, several building management systems (BMS) and HVAC systems in which the systems and methods of the present disclosure can be implemented are shown, according to some embodiments. In brief overview, FIG. 1 shows a building 10 equipped with a HVAC system 100. FIG. 2 is a block diagram of a waterside system 200 which can be used to serve building 10. FIG. 3 is a block diagram of an airside system 300 which can be used to serve building 10. FIG. 4 is a block diagram of a BMS which can be used to monitor and control building 10. FIG. 5 is a block diagram of another BMS which can be used to monitor and control building 10.

Building and HVAC System

Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes a HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10. An exemplary waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 may place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 may transfer heat between the airflow and the working fluid to provide heating or cooling for the airflow. For example, AHU 106 can include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, gas sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Waterside System

Referring now to FIG. 2, a block diagram of a waterside system 200 is shown, according to some embodiments. In various embodiments, waterside system 200 may supplement or replace waterside system 120 in HVAC system 100 or can be implemented separate from HVAC system 100. When implemented in HVAC system 100, waterside system 200 can include a subset of the HVAC devices in HVAC system 100 (e.g., boiler 104, chiller 102, pumps, valves, etc.)

and may operate to supply a heated or chilled fluid to AHU 106. The HVAC devices of waterside system 200 can be located within building 10 (e.g., as components of waterside system 120) or at an offsite location such as a central plant.

In FIG. 2, waterside system 200 is shown as a central plant having a plurality of subplants 202-212. Subplants 202-212 are shown to include a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources (e.g., water, natural gas, electricity, etc.) from utilities to serve thermal energy loads (e.g., hot water, cold water, heating, cooling, etc.) of a building or campus. For example, heater subplant 202 can be configured to heat water in a hot water loop 214 that circulates the hot water between heater subplant 202 and building 10. Chiller subplant 206 can be configured to chill water in a cold water loop 216 that circulates the cold water between chiller subplant 206 building 10. Heat recovery chiller subplant 204 can be configured to transfer heat from cold water loop 216 to hot water loop 214 to provide additional heating for the hot water and additional cooling for the cold water. Condenser water loop 218 may absorb heat from the cold water in chiller subplant 206 and reject the absorbed heat in cooling tower subplant 208 or transfer the absorbed heat to hot water loop 214. Hot TES subplant 210 and cold TES subplant 212 may store hot and cold thermal energy, respectively, for subsequent use.

Hot water loop 214 and cold water loop 216 may deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air can be delivered to individual zones of building 10 to serve thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, CO2, etc.) can be used in place of or in addition to water to serve thermal energy loads. In other embodiments, subplants 202-212 may provide heating and/or cooling directly to the building or campus without requiring an intermediate heat transfer fluid. These and other variations to waterside system 200 are within the teachings of the present disclosure.

Each of subplants 202-212 can include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 may also include one or more pumps or valves configured to control the flow rate of the hot water into or out of hot TES tank 242. Cold TES subplant 212 is shown to include cold TES tanks 244 configured to store the cold water for later use. Cold TES subplant 212 may also include one or more pumps or valves configured to control the flow rate of the cold water into or out of cold TES tanks 244.

In some embodiments, one or more of the pumps in waterside system 200 (e.g., pumps 222, 224, 228, 230, 234, 236, and/or 240) or pipelines in waterside system 200 include an isolation valve associated therewith. Isolation valves can be integrated with the pumps or positioned upstream or downstream of the pumps to control the fluid flows in waterside system 200. In various embodiments, waterside system 200 can include more, fewer, or different types of devices and/or subplants based on the particular configuration of waterside system 200 and the types of loads served by waterside system 200.

Airside System

Referring now to FIG. 3, a block diagram of an airside system 300 is shown, according to some embodiments. In various embodiments, airside system 300 may supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, ducts 112-114, fans, dampers, etc.) and can be located in or around building 10. Airside system 300 may operate to heat or cool an airflow provided to building 10 using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 may receive return air 304 from building zone 306 via return air duct 308 and may deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 may communicate with an AHU controller 330 via a communications link 332. Actuators 324-328 may receive control signals from AHU controller 330 and may provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 may communicate with fan 338 via communications link 340 to control a flow rate of supply air 310. In some embodiments, AHU controller 330 controls an amount of heating or cooling applied to supply air 310 by modulating a speed of fan 338.

Cooling coil 334 may receive a chilled fluid from waterside system 200 (e.g., from cold water loop 216) via piping 342 and may return the chilled fluid to waterside system 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 may receive a heated fluid from waterside system 200 (e.g., from hot water loop 214) via piping 348 and may return the heated fluid to waterside system 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 may communicate with AHU controller 330 via communications links 358-360. Actuators 354-356 may receive control signals from AHU controller 330 and may provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 may also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and may correlate with the amount of energy consumed to achieve a desired supply air temperature. AHU 330 may control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 can include one or more computer systems (e.g., servers, supervisory controllers, subsystem controllers, etc.) that serve as system level controllers, application or data servers, head nodes, or master controllers for airside system 300, waterside system 200, HVAC system 100, and/or other controllable systems that serve building 10. BMS controller 366 may communicate with multiple downstream building systems or subsystems (e.g., HVAC system 100, a security system, a lighting system, waterside system 200, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 may provide BMS controller 366 with temperature measurements from temperature sensors 362-364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of user interface device. Client device 368 can be a stationary terminal or a mobile device. For example, client device 368 can be a desktop computer, a computer server with a user interface, a laptop computer, a tablet, a smartphone, a PDA, or any other type of mobile or non-mobile device. Client device 368 may communicate with BMS controller 366 and/or AHU controller 330 via communications link 372.

Building Management Systems

Referring now to FIG. 4, a block diagram of a building management system (BMS) 400 is shown, according to some embodiments. BMS 400 can be implemented in building 10 to automatically monitor and control various building functions. BMS 400 is shown to include BMS controller 366 and a plurality of building subsystems 428. Building subsystems 428 are shown to include a building electrical subsystem 434, an information communication technology (ICT) subsystem 436, a security subsystem 438, a HVAC subsystem 440, a lighting subsystem 442, a lift/escalators subsystem 432, and a fire safety subsystem 430. In various embodiments, building subsystems 428 can include fewer, additional, or alternative subsystems. For example, building subsystems 428 may also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 428 include waterside system 200 and/or airside system 300, as described with reference to FIGS. 2-3.

Each of building subsystems 428 can include any number of devices, controllers, and connections for completing its individual functions and control activities. HVAC subsystem 440 can include many of the same components as HVAC system 100, as described with reference to FIGS. 1-3. For example, HVAC subsystem 440 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 442 can include any number of light fixtures, ballasts, lighting sensors, dimmers, or other devices configured to controllably adjust the amount of light provided to a building space. Security subsystem 438 can include occupancy sensors, video surveillance cameras, digital video recorders, video processing servers, intrusion detection devices, access control devices and servers, or other security-related devices.

Still referring to FIG. 4, BMS controller 366 is shown to include a communications interface 407 and a BMS interface 409. Interface 407 may facilitate communications between BMS controller 366 and external applications (e.g., monitoring and reporting applications 422, enterprise control applications 426, remote systems and applications 444, applications residing on client devices 448, etc.) for allowing user control, monitoring, and adjustment to BMS controller 366 and/or subsystems 428. Interface 407 may also facilitate communications between BMS controller 366 and client devices 448. BMS interface 409 may facilitate communications between BMS controller 366 and building subsystems 428 (e.g., HVAC, lighting security, lifts, power distribution, business, etc.).

Interfaces 407, 409 can be or include wired or wireless communications interfaces (e.g., jacks, antennas, transmitters, receivers, transceivers, wire terminals, etc.) for conducting data communications with building subsystems 428 or other external systems or devices. In various embodiments, communications via interfaces 407, 409 can be direct (e.g., local wired or wireless communications) or via a communications network 446 (e.g., a WAN, the Internet, a cellular network, etc.). For example, interfaces 407, 409 can include an Ethernet card and port for sending and receiving data via an Ethernet-based communications link or network. In another example, interfaces 407, 409 can include a Wi-Fi transceiver for communicating via a wireless communications network. In another example, one or both of interfaces 407, 409 can include cellular or mobile phone communications transceivers. In one embodiment, communications interface 407 is a power line communications interface and BMS interface 409 is an Ethernet interface. In other embodiments, both communications interface 407 and BMS interface 409 are Ethernet interfaces or are the same Ethernet interface.

Still referring to FIG. 4, BMS controller 366 is shown to include a processing circuit 404 including a processor 406 and memory 408. Processing circuit 404 can be communicably connected to BMS interface 409 and/or communications interface 407 such that processing circuit 404 and the various components thereof can send and receive data via interfaces 407, 409. Processor 406 can be implemented as a general purpose processor, an application specific integrated circuit (ASIC), one or more field programmable gate arrays (FPGAs), a group of processing components, or other suitable electronic processing components.

Memory 408 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 408 can be or include volatile memory or non-volatile memory. Memory 408 can include database components, object code components, script components, or any other type of information structure for supporting the various activities and information structures described in the present application. According to some embodiments, memory 408 is communicably connected to processor 406 via processing circuit 404 and includes computer code for executing (e.g., by processing circuit 404 and/or processor 406) one or more processes described herein.

In some embodiments, BMS controller 366 is implemented within a single computer (e.g., one server, one housing, etc.). In various other embodiments BMS controller 366 can be distributed across multiple servers or computers (e.g., that can exist in distributed locations). Further, while FIG. 4 shows applications 422 and 426 as existing outside of BMS controller 366, in some embodiments, applications 422 and 426 can be hosted within BMS controller 366 (e.g., within memory 408).

Still referring to FIG. 4, memory 408 is shown to include an enterprise integration layer 410, an automated measurement and validation (AM&V) layer 412, a demand response (DR) layer 414, a fault detection and diagnostics (FDD) layer 416, an integrated control layer 418, and a building subsystem integration later 420. Layers 410-420 can be configured to receive inputs from building subsystems 428 and other data sources, determine optimal control actions for building subsystems 428 based on the inputs, generate control signals based on the optimal control actions, and provide the generated control signals to building subsystems 428. The following paragraphs describe some of the general functions performed by each of layers 410-420 in BMS 400.

Enterprise integration layer 410 can be configured to serve clients or local applications with information and services to support a variety of enterprise-level applications. For example, enterprise control applications 426 can be configured to provide subsystem-spanning control to a graphical user interface (GUI) or to any number of enterprise-level business applications (e.g., accounting systems, user identification systems, etc.). Enterprise control applications 426 may also or alternatively be configured to provide configuration GUIs for configuring BMS controller 366. In yet other embodiments, enterprise control applications 426 can work with layers 410-420 to optimize building performance (e.g., efficiency, energy use, comfort, or safety) based on inputs received at interface 407 and/or BMS interface 409.

Building subsystem integration layer 420 can be configured to manage communications between BMS controller 366 and building subsystems 428. For example, building subsystem integration layer 420 may receive sensor data and input signals from building subsystems 428 and provide output data and control signals to building subsystems 428. Building subsystem integration layer 420 may also be configured to manage communications between building subsystems 428. Building subsystem integration layer 420 translate communications (e.g., sensor data, input signals, output signals, etc.) across a plurality of multi-vendor/multi-protocol systems.

Demand response layer 414 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 424, from energy storage 427 (e.g., hot TES 242, cold TES 244, etc.), or from other sources. Demand response layer 414 may receive inputs from other layers of BMS controller 366 (e.g., building subsystem integration layer 420, integrated control layer 418, etc.). The inputs received from other layers can include environmental or sensor inputs such as temperature, carbon dioxide levels, relative humidity levels, air quality sensor outputs, occupancy sensor outputs, room schedules, and the like. The inputs may also include inputs such as electrical use (e.g., expressed in kWh), thermal load measurements, pricing information, projected pricing, smoothed pricing, curtailment signals from utilities, and the like.

According to some embodiments, demand response layer 414 includes control logic for responding to the data and signals it receives. These responses can include communicating with the control algorithms in integrated control layer 418, changing control strategies, changing setpoints, or activating/deactivating building equipment or subsystems in a controlled manner. Demand response layer 414 may also include control logic configured to determine when to utilize stored energy. For example, demand response layer 414 may determine to begin using energy from energy storage 427 just prior to the beginning of a peak use hour.

In some embodiments, demand response layer 414 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 414 uses equipment models to determine an optimal set of control actions. The equipment models can include, for example, thermodynamic models describing the inputs, outputs, and/or functions performed by various sets of building equipment. Equipment models may represent collections of building equipment (e.g., subplants, chiller arrays, etc.) or individual devices (e.g., individual chillers, heaters, pumps, etc.).

Demand response layer 414 may further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 418 can be configured to use the data input or output of building subsystem integration layer 420 and/or demand response later 414 to make control decisions. Due to the subsystem integration provided by building subsystem integration layer 420, integrated control layer 418 can integrate control activities of the subsystems 428 such that the subsystems 428 behave as a single integrated supersystem. In some embodiments, integrated control layer 418 includes control logic that uses inputs and outputs from a plurality of building subsystems to provide greater comfort and energy savings relative to the comfort and energy savings that separate subsystems could provide alone. For example, integrated control layer 418 can be configured to use an input from a first subsystem to make an energy-saving control decision for a second subsystem. Results of these decisions can be communicated back to building subsystem integration layer 420.

Integrated control layer 418 is shown to be logically below demand response layer 414. Integrated control layer 418 can be configured to enhance the effectiveness of demand response layer 414 by enabling building subsystems 428 and their respective control loops to be controlled in coordination with demand response layer 414. This configuration may advantageously reduce disruptive demand response behavior relative to conventional systems. For example, integrated control layer 418 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 418 can be configured to provide feedback to demand response layer 414 so that demand response layer 414 checks that constraints (e.g., temperature, lighting levels, etc.) are properly maintained even while demanded load shedding is in progress. The constraints may also include setpoint or sensed boundaries relating to safety, equipment operating limits and performance, comfort, fire codes, electrical codes, energy codes, and the like. Integrated control layer 418 is also logically below fault detection and diagnostics layer 416 and automated measurement and validation layer 412. Integrated control layer 418 can be configured to provide calculated inputs (e.g., aggregations) to these higher levels based on outputs from more than one building subsystem.

Automated measurement and validation (AM&V) layer 412 can be configured to verify that control strategies commanded by integrated control layer 418 or demand response layer 414 are working properly (e.g., using data aggregated by AM&V layer 412, integrated control layer 418, building subsystem integration layer 420, FDD layer 416, or otherwise). The calculations made by AM&V layer 412 can be based on building system energy models and/or equipment models for individual BMS devices or subsystems. For example, AM&V layer 412 may compare a model-predicted output with an actual output from building subsystems 428 to determine an accuracy of the model.

Fault detection and diagnostics (FDD) layer 416 can be configured to provide on-going fault detection for building subsystems 428, building subsystem devices (i.e., building equipment), and control algorithms used by demand response layer 414 and integrated control layer 418. FDD layer 416 may receive data inputs from integrated control layer 418, directly from one or more building subsystems or devices, or from another data source. FDD layer 416 may automatically diagnose and respond to detected faults. The responses to detected or diagnosed faults can include providing an alert message to a user, a maintenance scheduling system, or a control algorithm configured to attempt to repair the fault or to work-around the fault.

FDD layer 416 can be configured to output a specific identification of the faulty component or cause of the fault (e.g., loose damper linkage) using detailed subsystem inputs available at building subsystem integration layer 420. In other exemplary embodiments, FDD layer 416 is configured to provide "fault" events to integrated control layer 418 which executes control strategies and policies in response to the received fault events. According to some embodiments, FDD layer 416 (or a policy executed by an integrated control engine or business rules engine) may shut-down systems or direct control activities around faulty devices or systems to reduce energy waste, extend equipment life, or assure proper control response.

FDD layer 416 can be configured to store or access a variety of different system data stores (or data points for live data). FDD layer 416 may use some content of the data stores to identify faults at the equipment level (e.g., specific chiller, specific AHU, specific terminal unit, etc.) and other content to identify faults at component or subsystem levels. For example, building subsystems 428 may generate temporal (i.e., time-series) data indicating the performance of BMS 400 and the various components thereof. The data generated by building subsystems 428 can include measured or calculated values that exhibit statistical characteristics and provide information about how the corresponding system or process (e.g., a temperature control process, a flow control process, etc.) is performing in terms of error from its setpoint. These processes can be examined by FDD layer 416 to expose when the system begins to degrade in performance and alert a user to repair the fault before it becomes more severe.

Referring now to FIG. 5, a block diagram of another building management system (BMS) 500 is shown, according to some embodiments. BMS 500 can be used to monitor and control the devices of HVAC system 100, waterside system 200, airside system 300, building subsystems 428, as well as other types of BMS devices (e.g., lighting equipment, security equipment, etc.) and/or HVAC equipment.

BMS 500 provides a system architecture that facilitates automatic equipment discovery and equipment model distribution. Equipment discovery can occur on multiple levels of BMS 500 across multiple different communications busses (e.g., a system bus 554, zone buses 556-560 and 564, sensor/actuator bus 566, etc.) and across multiple different communications protocols. In some embodiments, equipment discovery is accomplished using active node tables, which provide status information for devices connected to each communications bus. For example, each communications bus can be monitored for new devices by monitoring the corresponding active node table for new nodes. When a new device is detected, BMS 500 can begin interacting with the new device (e.g., sending control signals, using data from the device) without user interaction.

Some devices in BMS 500 present themselves to the network using equipment models. An equipment model defines equipment object attributes, view definitions, schedules, trends, and the associated BACnet value objects (e.g., analog value, binary value, multistate value, etc.) that are used for integration with other systems. Some devices in BMS 500 store their own equipment models. Other devices in BMS 500 have equipment models stored externally (e.g., within other devices). For example, a zone coordinator 508 can store the equipment model for a bypass damper 528. In some embodiments, zone coordinator 508 automatically creates the equipment model for bypass damper 528 or other devices on zone bus 558. Other zone coordinators can also create equipment models for devices connected to their zone busses. The equipment model for a device can be created automatically based on the types of data points exposed by the device on the zone bus, device type, and/or other device attributes. Several examples of automatic equipment discovery and equipment model distribution are discussed in greater detail below.

Still referring to FIG. 5, BMS 500 is shown to include a system manager 502; several zone coordinators 506, 508, 510 and 518; and several zone controllers 524, 530, 532, 536, 548, and 550. System manager 502 can monitor data points in BMS 500 and report monitored variables to various monitoring and/or control applications. System manager 502 can communicate with client devices 504 (e.g., user devices, desktop computers, laptop computers, mobile devices, etc.) via a data communications link 574 (e.g., BACnet IP, Ethernet, wired or wireless communications, etc.). System manager 502 can provide a user interface to client devices 504 via data communications link 574. The user interface may allow users to monitor and/or control BMS 500 via client devices 504.

In some embodiments, system manager 502 is connected with zone coordinators 506-510 and 518 via a system bus 554. System manager 502 can be configured to communicate with zone coordinators 506-510 and 518 via system bus 554 using a master-slave token passing (MSTP) protocol or any other communications protocol. System bus 554 can also connect system manager 502 with other devices such as a constant volume (CV) rooftop unit (RTU) 512, an input/output module (TOM) 514, a thermostat controller 516 (e.g., a TEC5000 series thermostat controller), and a network automation engine (NAE) or third-party controller 520. RTU 512 can be configured to communicate directly with system manager 502 and can be connected directly to system bus 554. Other RTUs can communicate with system manager 502 via an intermediate device. For example, a wired input 562 can connect a third-party RTU 542 to thermostat controller 516, which connects to system bus 554.

System manager 502 can provide a user interface for any device containing an equipment model. Devices such as zone coordinators 506-510 and 518 and thermostat controller 516 can provide their equipment models to system manager 502 via system bus 554. In some embodiments, system manager 502 automatically creates equipment models for connected devices that do not contain an equipment model (e.g., IOM 514, third party controller 520, etc.). For example, system manager 502 can create an equipment model for any device that responds to a device tree request. The equipment models created by system manager 502 can be stored within system manager 502. System manager 502 can then provide a user interface for devices that do not contain their own equipment models using the equipment models created by system manager 502. In some embodiments, system manager 502 stores a view definition for each type of equipment connected via system bus 554 and uses the stored view definition to generate a user interface for the equipment.

Each zone coordinator 506-510 and 518 can be connected with one or more of zone controllers 524, 530-532, 536, and 548-550 via zone buses 556, 558, 560, and 564. Zone coordinators 506-510 and 518 can communicate with zone controllers 524, 530-532, 536, and 548-550 via zone busses 556-560 and 564 using a MSTP protocol or any other communications protocol. Zone busses 556-560 and 564 can also connect zone coordinators 506-510 and 518 with other types of devices such as variable air volume (VAV) RTUs 522 and 540, changeover bypass (COBP) RTUs 526 and 552, bypass dampers 528 and 546, and PEAK controllers 534 and 544.

Zone coordinators 506-510 and 518 can be configured to monitor and command various zoning systems. In some embodiments, each zone coordinator 506-510 and 518 monitors and commands a separate zoning system and is connected to the zoning system via a separate zone bus. For example, zone coordinator 506 can be connected to VAV RTU 522 and zone controller 524 via zone bus 556. Zone coordinator 508 can be connected to COBP RTU 526, bypass damper 528, COBP zone controller 530, and VAV zone controller 532 via zone bus 558. Zone coordinator 510 can be connected to PEAK controller 534 and VAV zone controller 536 via zone bus 560. Zone coordinator 518 can be connected to PEAK controller 544, bypass damper 546, COBP zone controller 548, and VAV zone controller 550 via zone bus 564.

A single model of zone coordinator 506-510 and 518 can be configured to handle multiple different types of zoning systems (e.g., a VAV zoning system, a COBP zoning system, etc.). Each zoning system can include a RTU, one or more zone controllers, and/or a bypass damper. For example, zone coordinators 506 and 510 are shown as Verasys VAV engines (VVEs) connected to VAV RTUs 522 and 540, respectively. Zone coordinator 506 is connected directly to VAV RTU 522 via zone bus 556, whereas zone coordinator 510 is connected to a third-party VAV RTU 540 via a wired input 568 provided to PEAK controller 534. Zone coordinators 508 and 518 are shown as Verasys COBP engines (VCEs) connected to COBP RTUs 526 and 552, respectively. Zone coordinator 508 is connected directly to COBP RTU 526 via zone bus 558, whereas zone coordinator 518 is connected to a third-party COBP RTU 552 via a wired input 570 provided to PEAK controller 544.

Zone controllers 524, 530-532, 536, and 548-550 can communicate with individual BMS devices (e.g., sensors, actuators, etc.) via sensor/actuator (SA) busses. For example, VAV zone controller 536 is shown connected to networked sensors 538 via SA bus 566. Zone controller 536 can communicate with networked sensors 538 using a MSTP protocol or any other communications protocol. Although only one SA bus 566 is shown in FIG. 5, it should be understood that each zone controller 524, 530-532, 536, and 548-550 can be connected to a different SA bus. Each SA bus can connect a zone controller with various sensors (e.g., temperature sensors, humidity sensors, pressure sensors, light sensors, occupancy sensors, etc.), actuators (e.g., damper actuators, valve actuators, etc.) and/or other types of controllable equipment (e.g., chillers, heaters, fans, pumps, etc.).

Each zone controller 524, 530-532, 536, and 548-550 can be configured to monitor and control a different building zone. Zone controllers 524, 530-532, 536, and 548-550 can use the inputs and outputs provided via their SA busses to monitor and control various building zones. For example, a zone controller 536 can use a temperature input received from networked sensors 538 via SA bus 566 (e.g., a measured temperature of a building zone) as feedback in a temperature control algorithm. Zone controllers 524, 530-532, 536, and 548-550 can use various types of control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control a variable state or condition (e.g., temperature, humidity, airflow, lighting, etc.) in or around building 10.

Zone Ventilation Operations

Referring generally to FIGS. 6-32, humans take about 20,000 breaths daily and spend 90% of their time indoors. Reducing exposure to the indoor air with threatening pollutants can lead to a higher quality of life and a lower risk of respiratory and other illnesses. Some health effects may appear shortly after a single exposure or repeated exposure to a pollutant. These include irritation of the eyes, nose, and throat, headaches, dizziness, and fatigue. Other health effects may show up either years after exposure has occurred or only after long or repeated periods of exposure. These effects can be severely debilitating or fatal, including respiratory diseases, heart disease, and cancer.

There are two primary causes of air problems. They are indoor pollution and inadequate ventilation. Common pollutants sources indoors include volatile organic compounds (VOC), indoor particles matter (PM), nitrogen dioxide ($NO_2$), and secondhand smoke. Some sources such as building materials and furnishings can release pollutants continuously. Other sources related to activities like smoking, cleaning, and redecorating release pollutants intermittently. Malfunctioning appliances or improperly used products can release higher and sometimes dangerous pollutants indoors. With reference to inadequate ventilation, according to the U.S. Environmental Protection Agency (EPA), outdoor air pollutants are often 2 to 5 times lower than indoor levels. Bringing fresh outdoor air indoors helps to reduce indoor pollutants. If too little outdoor air enters indoors, pollutants can accumulate to levels that can cause health and comfort problems; on the other hand, bringing too much outdoor fresh air indoors will cause energy waste.

Indoor air quality (IAQ) is a parameter that indicates the air quality within and around buildings, especially concerning the health and comfort of building occupants. Pandemics can highlight the importance of good IAQ. In some embodiments, indoor air quality can be improved using increased ventilation. In particular, increasing the outdoor airflow rate will increase the amount of outdoor air coming indoors. Ensuring proper ventilation with outside air can help reduce dirt, dust, allergens, chemicals, biological gases, viruses, and bacteria. Improving ventilation benefits indoor air quality and reduces airborne infectious diseases. In some embodiments, indoor air quality can be improved using filtration. In particular, HVAC filtration can help reduce dust, allergens, viruses, and bacteria, but it may not reduce air pollution like chemicals and biological. Regular cleaning or replacement is sometimes performed to ensure filtration efficiency. In some embodiments, indoor air quality can be improved using disinfection. In particular, disinfection or air purification can be used to reduce the killing of the airborne virus through methods like ultraviolet germicidal irradiation (UVGI) systems.

In some embodiments, a direct outdoor airflow rate measurement usually includes professional equipment or access to HVAC equipment data. Although it can get an accurate result, the direct method is challenging and expensive, especially in a large building. Additionally, some indirect estimation methods can be used. However, the accuracy of the indirect methods remain poor and the performance of such methods can be power consumption heavy and costly. Thus, the systems and methods described herein provide improved outdoor airflow rate estimations and improved room and day ventilation scheduling that can optimize performance while simultaneously providing energy savings.

In some embodiments, the IAQ data can be collected from one or more sensors installed throughout building 10. For example, zone controllers 524, 530-532, 536, and 548-550 can communicate with individual sensors. In some embodiments, a sensor can be a CO2 sensor configured to obtain (e.g., measure, sense, detect, etc.) and provide measurements of CO2 in the zones or areas (e.g., such as a room, many rooms, spaces, an area of the building, etc.) to a controller, according to some embodiments. In some embodiments, sensors can also be, but is not limited to, total volatile organic compounds (TVOC) sensors, particulate matter (PM) sensors, etc. In some embodiments, the controller is configured to obtain (e.g., from a network system, collected from the sensors over a time period, from a database, from a system administrator, etc.) historical IAQ data of zones and/or areas. In some embodiments, the controller is configured to use the historical data of the zones to train a model to forecast, predict, or estimate CO2 concentrations in the zones. In general, the controller or controllers can be one system or multiple system that are located at one site or distributed across multiple sites and interconnected by a communication network.

In some embodiments, a single zone outdoor airflow rate can be calculated based on collecting and/or receiving IAQ data. The IAQ data can include, but is not limited to, $CO_2$ concentration measurements (e.g., indoor and outdoor), TVOC measurements, PM measurements, etc. In some embodiments, $CO_2$ concentrations can be collected and/or received and used to determine indoor $CO_2$ concentration changes in ppm/hr. In particular, indoor $CO_2$ concentration changes in ppm/hr is determined by (Equation 1):

$$\dot{\varphi}_{CO2,z}=-\dot{\tilde{v}}\varphi_{CO2,z}+\dot{\tilde{v}}\varphi_{CO2,OA}+\dot{\varphi}_{CO2,dist}$$

where $\dot{\varphi}_{CO2,z}$ is the indoor $CO_2$ concentration changes in ppm/hr (i.e., the rate of change of the indoor air $CO_2$ concentration), $\dot{\tilde{v}}_{oa}$ is the outdoor air outdoor airflow rate in air change/hr (i.e., the rate at which outdoor air is introduced into the building zone), $\varphi_{CO2,z}$ is the indoor $CO_2$ concentration in ppm $\varphi_{CO2,OA}$ is the outdoor $CO_2$ concentration in ppm, and $\dot{\varphi}_{CO2,dist}$ is the indoor $CO_2$ concentration disturbance in ppm/hr. Although specific units are provided here (e.g., concentration in ppm, time in hours, volume in liters, etc.), it should be understood that these units are merely examples and other units could be used for the corresponding variable types.

In some embodiments, the majority of the disturbance can come from occupants. Thus, $\dot{\varphi}_{CO2,dist}$ of Equation 1 can be replaced by $N\dot{\varphi}_{CO2,genperperson}$, where $N\dot{\varphi}_{CO2,genperperson}$ is the average $CO_2$ generation rate of an occupancy (or human), and N is the number of people. In some embodiments, Equation 1 can be converted from continuous-time to discrete time (Equation 2):

$$\varphi_{CO2,z}[n+1]-\varphi_{CO2,OA}[n]=e^{-\dot{\tilde{v}}_{oa}\Delta}(\varphi_{CO2,z}[n]-\varphi_{CO2,OA}[n])+\frac{1-e^{-\dot{\tilde{v}}_{oa}\Delta}}{\dot{\tilde{v}}_{oa}}\dot{\varphi}_{CO2,dist}[n]$$

In some embodiments, Equation 2 can be simplified during unoccupied periods, where $\dot{\varphi}_{CO2,dist}=0$ (Equation 3):

$$\varphi_{CO2,z}[n+1]-\varphi_{CO2,OA}[n]=e^{-[\$]\$^{-}\$\$[[\$]\$^{-}A\dot{P}[\$]\$^{-}g\dot{n}_{oa}\Delta}(\varphi_{CO2,z}[n]-\varphi_{CO2,OA}[n])$$

In some embodiments, during the unoccupied period, the indoor $CO_2$ concentration starts to decay exponentially, and the decay rate is the estimated ventilation air changes. Furthermore, when $CO_2$ concentration is in a steady state during an occupied period, the indoor $CO_2$ concentration disturbance is constant during a transient period (occupants number increasing), the average ventilation air changes can be estimated. Thus, if good transient periods (e.g., occupants enter and leave the room) are detected, the average outdoor airflow rate can be estimated using a regression model. In some embodiments, the regression models assumes that the outdoor airflow rate and indoor $CO_2$ disturbance stay constant during the transient period. Equation 2 can be simplified with different variables (Equation 4):

$$y=e^{-[\$]\$^{-}\$\$[[\$]\$^{-}A\dot{P}[\$]\$^{-}g\dot{n}_{oa}\Delta}x+b_i$$

where $y=\varphi_{CO2,z}[n+1]-\varphi_{CO2,OA}[n]$ in ppm, $x=\varphi_{CO2,z}[n]-\varphi_{CO2,OA}[n]$ in ppm, $b_i$ is a constant number in ith transient period, and $\Delta$ is the sampling rate.

In some embodiments, if the occupants leave the room in ith transient period, $b_i$ is or close to 0 (e.g., decreases), and if occupants enter the room in ith transient period, $b_i$ is a positive number (e.g., increases). In some embodiments, the sampling rate can be set by the BMS controller 366 based on a user setting or a granularity desired. For example, $\Delta$ can be equal to 1/60 hour. The transient period or window can be a period of data where IAQ data can be continuously collected. The IAQ data can be used as input by a regression model to estimate a plurality of outdoor airflow rates for an area (e.g., such as a zone) of the building for each of the plurality of transient periods. In some embodiments, the BMS controller 366 can estimate an outdoor airflow rate for each transient period determined.

In general, transient periods can be selected or identified based on one or more parameters (selected or identified transient periods referred to herein as "good transient periods"). In some embodiments, one or more parameters of the transient periods can include, but are not limited to, being longer than the minimum length (e.g., 2 minutes, 15 minutes, 1 hour, 4 hours, etc.), peak-peak during the transient period being greater than minimum concentration changes (e.g., 15 ppm, 50 ppm, 200 ppm, etc.), the decay rate of the transient period being greater than a minimum decay rate (e.g., exp(−1)/hr) (see Equation 5 below), the $2^{nd}$ derivate peak is located in the first half of a plotted raw $CO_2$ concentrations. In some embodiments, the decay rate of the transient period is greater than a minimum decay rate when (Equation 5):

$$\frac{\varphi'_{CO2,z}[n_{endofWindow}]}{\varphi'_{CO2,z}[n_{startofWindow}]}<decayRate_{min}$$

where $\varphi_{CO2,z}'$ the first derivative of indoor CO2 concentration in PPM/Hr/Time, $n_{endofWindow}$ is the end position index of the selected transient period, $n_{startofWindow}$ is the start position index of the selected transient period, and $decayRate_{min}$ is defined minimum decay rate in air change per hour.

In some embodiments, the exponential decay refers to a situation where the value of a quantity decreases rapidly over time following an exponential trend. In particular, the value of the quantity is high at the start of a certain time window and low at the end. The rate of decrease is determined by the ratio of the value at the end of the window to the value at the start. If this ratio is small enough, it can imply that the exponential decay is substantial, meaning that the value decreases significantly over the duration of the time window. For example, exponential decay can be seen in the release and decay of carbon dioxide ($CO_2$) in a building. When $CO_2$ is released or produced in the building, it begins to disperse and mix with the surrounding air. Over time, the concentration of $CO_2$ in the air of the buildings, and in particular areas, decreases as it reacts with other substances and re-circulated or released out of the building. This decrease follows an exponential trend, where the rate of decay is determined by the ratio of the concentration of $CO_2$ at the end of a time window to the concentration at the start.

Figure 6:
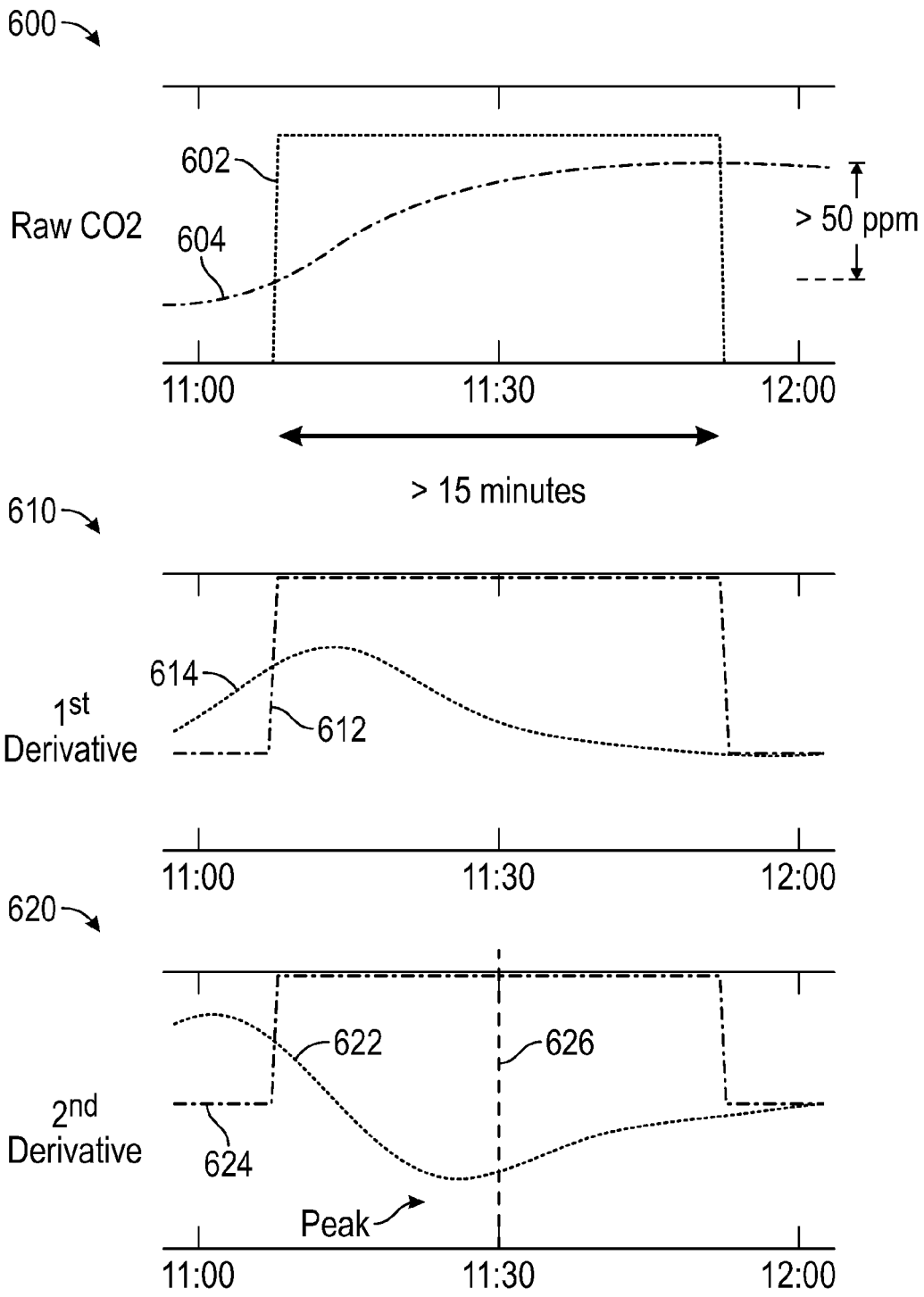
FIG. 6 depicts graphs illustrating a selected transient period, according to some embodiments.

Referring to FIG. 6, graphs 300, 310, and 320 illustrating a selected transient period based on satisfying the one or more parameters above, according to some embodiments. In particular, the BMS controller 366 can continuously collect the IAQ data from one or more sensors in zones and determine one or more transient periods that satisfy the one or more parameters. In some embodiments, the BMS controller 366 can analyze and plot the raw $CO_2$ data (e.g., stored in the IAQ data) and the $1^{st}$ and $2^{nd}$ derivative of the plotted raw $CO_2$ data to determine if the one or more parameters are satisfied. For example, graph 600 depicts a plotted raw $CO_2$ concentration 604 with a minimum concentration change of 50 ppm. In another example, graph 610 depicts a plotted first derivative $CO_2$ concentration 614. In yet another example, graph 620 depicts a plotted second derivative $CO_2$ concentration 624. As shown in graph 620, the peak is located in the first half of the transient period. In general, plots 602, 612 and 622 are the same period in different representations. For example, plot 602 is the raw $CO_2$ plot, plot 612 is the first derivative of plot 602, and plot 622 is the second derivative of plot 602. Decay rate of graphs of FIG. 6 can be determined using Equation 4. For example, the BMS controller 366 can determine the first and last value in the selected transient period in plot 612, and calculate the ratio.

In some embodiments, the BMS controller 366 can perform a data analysis of the IAQ data from a period of time (e.g., last day, last week, between two particular days, etc.). Accordingly, the BMS controller 366 can perform an analysis of potential transient periods for selection on the entire period of time. In particular, the BMS can analyze different periods of time that can be plotted to determine if the potential transient period satisfies one or more parameters. If the potential transient period satisfies the one or more parameters, the transient period can be stored to perform future analysis (e.g., calculate outdoor airflow rate, room occupied scheduling analysis, etc.).

Referring in more detail to detecting and identifying transient periods. The BMS controller 366 can, for each given zone, identify and/or collect indoor $CO_2$ concentrations and associated time stamps (e.g., where the unit of $CO_2$ concentration is ppm, and the sample rate is 1 minute), and outdoor $CO_2$ concentrations and associated time stamps. The $CO_2$ concentrations can be stored or labeled as IAQ data. In some embodiments, the length of concentrations and data can be greater than seven days (e.g., greater than one day, greater than a month, etc.).

In some embodiments, the $1^{st}$ derivative plot (graph 610) and $2^{nd}$ derivative plot (graph 620) can be calculated on the indoor $CO_2$ concentration using a Savitzky-Golay (SG) filter (or another digital filter) with 20 minute windows. In some embodiments, the $1^{st}$ derivative plot (graph 610) and $2^{nd}$ derivative plot (graph 620) can be calculated on the indoor $CO_2$ concentration using an infinite impulse repose (IIR) filter or a finite impulse response (FIR) filter. The BMS controller 366 can determine a local maximum (or first local maximum) of the $1^{st}$ derivative indoor $CO_2$ concentration plot and select the local maximum data point as the start of the transient period (i.e., the starting point). In some embodiments, the BMS controller 366 can determine a next local maximum (after the local maximum) of the raw $CO_2$ concentrations and the $1^{st}$ derivative $CO_2$ concentrations to select an end time of the transient period. In some embodiments, the end point is selected from one of the next local maximums based on which next local maximum (e.g., raw $CO_2$ concentrations and the $1^{st}$ derivative $CO_2$ concentrations) is closer to the start position (i.e., the first found local maximum found first). In some embodiments, the end point is selected from one of the next local maximums based on which next local maximum (e.g., raw $CO_2$ concentrations and the $1^{st}$ derivative $CO_2$ concentrations) is farther from the start position. FIG. 6 depicts the end point as the next local maximum closest to the starting point. In some embodiments, the BMS controller 366 determines after the transient period is selected with a start point and end point that satisfies the one or more parameters. If the transient period does not satisfy one, some, or all of the parameters the BMS controller 366 will remove the transient period from further analysis.

After determining all the determined transient periods, the BMS controller 366 can truncate the transient periods to meet a user-defined input schedule. For example, the user-defined input schedule can be the ventilation schedule set by the user. The selected transient period can be the common period between the transient period and the ventilation schedule set by the user. Accordingly, in some embodiments, any transient period that does not satisfy the user-defined input schedule are removed from further analysis. In some embodiments, if a user-defined input schedule may be set or present (e.g., newer install, new upgrade, etc.) the BMS controller 366 may maintain or keep all the determined transient periods for future analysis.

In general, the BMS controller 366 can use various techniques calculate the uncertainty (e.g., regression error) of the outdoor airflow rate, occupancy estimate, and other parameters. One approach is to select a period of time associated with the data, and then bin the data, meaning to group it into smaller, manageable chunks. The BMS controller 366 then applies a mathematical model, such as a sinusoid or pulse function, to the IAQ data to determine the outdoor airflow rate and occupancy (function multipliers) based on minimizing the Root Mean Squared Error (RMSE) between the model and the data. In this process, the BMS controller 366 can also use the output of the model, such as the outdoor airflow rate, to back-calculate an occupancy estimate. By varying the outdoor airflow rate and refitting the model for each period with different occupancy estimates, the system can determine new outdoor airflow rates that cause a certain increase in the objective function (RMSE). This allows the system to calculate the uncertainty in the outdoor airflow rate. In some embodiments, another approach is to use regression analysis to determine the uncertainty. The system inputs the output of the model, such as the outdoor airflow rate, into a regression model, which then determines the uncertainty by analyzing the relationship between different possible outdoor airflow rates and corresponding regression errors. This approach allows the BMS controller 366 to quantify the uncertainty of the outdoor airflow rate and other parameters, and can help ensure that the control strategy is based on accurate and reliable data.

Still referring to uncertainty generally, the method of calculating uncertainty in outdoor airflow rate and occupancy estimate involves selecting a period of time associated with IAQ data, such as $CO_2$, temperature, humidity, volatile organic compounds (VOCs), particulate matter (e.g., PM2.5), and binning the data. The method then uses this IAQ data to model parameter identifications by minimizing the irregularity of the back-calculated occupancy. The output of this model is an outdoor airflow rate that is used to back-calculate an occupancy estimate. To calculate the uncertainty in outdoor airflow rate, the BMS controller 366 inputs the output into a regression model and vary outdoor airflow rate and refit each period with different occupancy and determine new outdoor airflow rates that cause a certain increase in objective function. In particular, uncertainty can be determined by (1) defining an objective function based on mapping the plurality of outdoor airflow rates to an objective value (e.g., such as mean squared error (MSE) value which is a minimization objective function), (2) minimizing the objective function based on determining an outdoor airflow rate of the plurality of outdoor airflow rates that results in a minimum objective value (e.g., MSE), and (3) determining a range of outdoor airflow rates less than a threshold based on the minimum MSE value, wherein the range of outdoor airflow rates is centered around the minimum objective value, and wherein a width of the range is a measure of the uncertainty associated with the minimum objective value. Accordingly, this allows the BMS controller 366 to determine the new outdoor airflow rate that causes a certain increase in the objective function and as such, an uncertainty in outdoor airflow rate can be calculated. The estimated occupancy graph can also be used to depict when there is a well-chosen outdoor airflow rate, an outdoor airflow rate that is too high, and an outdoor airflow rate that is too low.

In some embodiments of calculating uncertainty in outdoor airflow rate, the BMS controller 366 uses data collected from IAQ sensors such as $CO_2$ levels, temperature, and humidity. The BMS controller 366 can then use this data to identify a period of time associated with the data, which can then be binned. The BMS controller 366 can then use this data to model parameter identifications based on minimizing the root mean square error (RMSE) by using functions like sinusoids, pulse functions, or triangle functions to represent occupancy and $CO_2$ generation. The output of the model can include the outdoor airflow rate and occupancy, which can be used to generate an objective function as a function of the scaling factor on ventilation and occupancy. In some embodiments, the BMS controller 366 can then compare the percentage increase in the generated objective function to a threshold to calculate the uncertainty in the outdoor airflow rate. This process allows for the detection of patterns and dynamics in the IAQ data, which can improve the accuracy of the outdoor airflow rate calculation and increase overall building energy efficiency.

Figure 7:
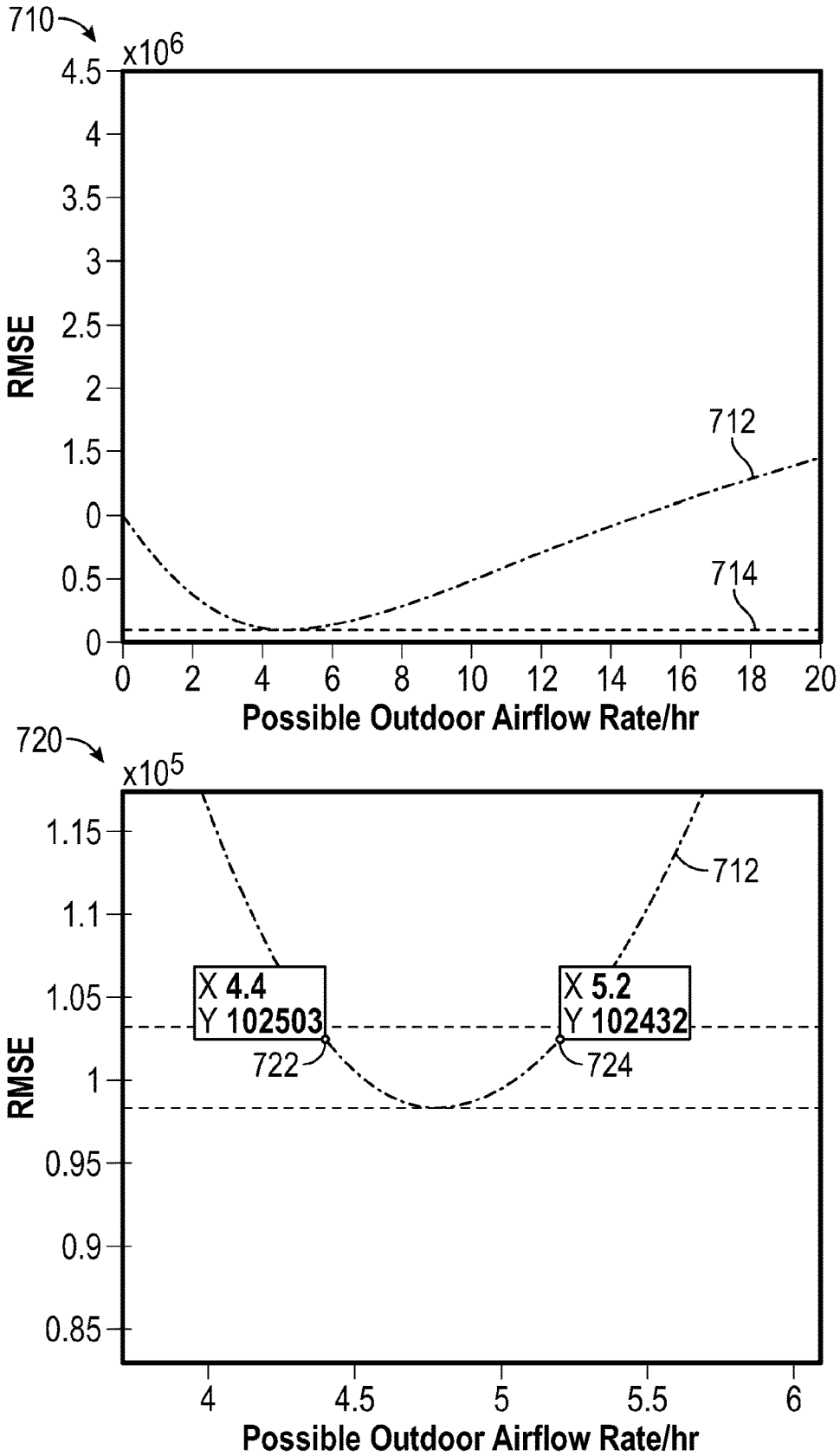
FIG. 7 depicts graphs illustrating a relationship between possible outdoor airflow rates and regression error, according to some embodiments.

Referring now to FIG. 7, graphs 410 and 420 illustrating a relationship between possible outdoor airflow rates and regression error, according to some embodiments. In some embodiments, the BMS controller 366 can execute a regression model on the determined transient periods (e.g., not removed based on the truncation, see FIG. 6) to determine a plurality of outdoor airflow rates for each of the transient periods. Executing the regression model can include preparing x and y data using $CO_2$ concentrations within each of the transient periods. In some embodiments, the regression target function is Equation 4. For example, x can be time that starts from 0 and the steps can be 1/60 hour. The end of x can depend on the length of the transient period. In another example, y can be the raw $CO_2$ concentration in ppm. By substituting different $V_{oa}$ values, calculate the regression coefficient (bi) using regression. Different transient periods have different bi values, which can be used by BMS controller 366 to calculate the overall regression error (e.g., summation of all transient periods regression error). Furthermore, executing the regression can include looping (e.g., repeating a sequence of instructions), by the BMS controller 366, the possible outdoor airflow rates (e.g., from 0.1 to 20/hr, step size 0.1/hr) where a relationship can be identified between the outdoor airflow rate and a regression error. Graph 710 depicts the relationship between the outdoor airflow rate and a regression error 712. Additionally, a minimum value 714 (e.g., used to estimate $V_{oa}$) of regression error 712 is shown. In some embodiments, the estimated outdoor airflow rate for the particular transient period may selected based on the outdoor airflow rate with the minimum regression error (RMSE). Additionally, executing the regression model can include determining 105% outdoor airflow rate (or 110%, or 115%, etc.) of the minimum regression error. As shown, graph 720 is a zoomed-in version of graph 710 where the x-axis and y-axis are zoomed-in focusing the minimum error region. The determined percentages of outdoor airflow rate can be set as the lower and upper bound of the estimated outdoor airflow rate. This can be visualized by plotting the relationship between possible outdoor airflow rate and regression error. As shown in graph 720 of FIG. 7, the lower bound outdoor airflow rate 722 is 4.4 air changes/hr and the upper bound outdoor airflow rate 724 is 5.2/hr. In some embodiments, the BMS controller 366 can select the average (or middle) of the upper bound outdoor airflow rate and lower bound outdoor airflow rate as the estimated outdoor airflow rate. For example, the estimated outdoor airflow rate for FIG. 7 could be 4.8/hr.

In some embodiments, the modeling using the regression mode can be extended to find a time varying outdoor airflow rate (sometimes referred to herein as a "time series outdoor airflow rate"). In particular, the steps above can be repeated on each good transient window, and the outdoor airflow rate is held until the start of the next good transient window. Thus, a time varying outdoor airflow rate can be determined over a period of time (e.g., 1 hour, 12 hours, 1 day, 1 week, etc.). Accordingly, this allows for a more detailed understanding of how the outdoor airflow rate changes over time. In some embodiments, the regression model can be used in building energy management, indoor air quality monitoring and control systems, and other related fields. Furthermore, the regression model can provide improvements to the energy efficiency of a building and provide a more detailed understanding of how the outdoor airflow rate changes over time. In some embodiments, one or more estimated outdoor airflow rates can be analyzed to determine if the estimation is good quality or if there may be issues with the result. For example, a first check can be performed by BMS controller 366 to determine if the upper and lower bounds of the estimated outdoor airflow rate are both greater or less than the estimated outdoor airflow rate. If this is the case, it indicates a "HighUncertainty_EstimatedOutOfBounds" and the estimation result may be considered poor. In another example, a second check is to determine if the number of good transient windows periods is smaller than a minimum threshold (e.g., 5, 10 (default), 20, 30). If this is the case, it indicates "InsufficientData_NumberOfWindows" and the estimation result may be considered poor. In yet another example, a third check is to determine if the total good transient period length is smaller than a minimum threshold (e.g., 180 minutes, 360 minutes, 900 minutes, 1,440 minutes, etc.). If this is the case, it indicates "InsufficientData_SamplesInWindows" and the estimation result may be considered poor. In yet another example, a fourth check is to determine if the difference between upper and lower bound over estimated outdoor airflow rate is greater than a constant (e.g., 0.5/hr, 1/hr, 4/hr). If this is the case, it indicates "HighUncertainty" and the estimation result may be considered poor. Thus, any of these conditions are met, the estimation result should be considered poor and may not be reliable. In some embodiments, when an estimation is considered poor the BMS controller 366 may exclude or remove the estimation from the time varying outdoor airflow rate. In some embodiments, when an estimation is considered poor the BMS controller 366 may include the estimation in the time varying outdoor airflow rate with an indication or notification that one or more estimated outdoor airflow rates may change in the future after additional IAQ data is collected and new transient periods are computed (as described above).

Figure 8:
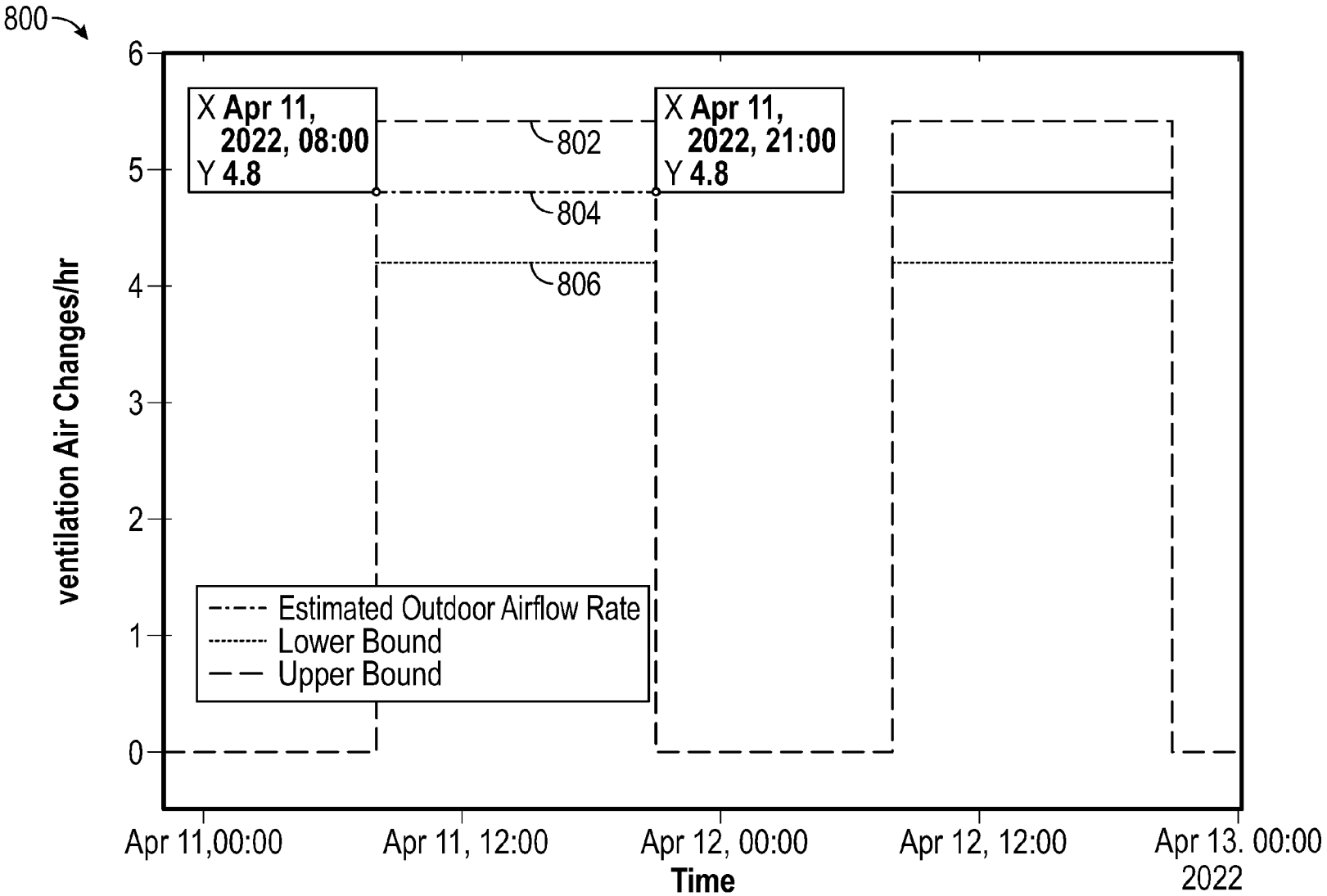
FIG. 8 depicts a graph illustrating a time series outdoor airflow rate, according to some embodiments.

Referring now to FIG. 8, a graph 800 illustrating a time series outdoor airflow rate, according to some embodiments. In some embodiments, a user-defined schedule can be used by the BMS controller 366 to control when the outdoor airflow rate is active and when it should be zero. That is, the outdoor airflow rate can follow a user-defined occupancy schedule. For example, during the user-defined occupied hours, the outdoor airflow rate stays at the estimated value. This means that during the hours when people are expected to be in the building, the HVAC system will maintain the outdoor airflow rate that was estimated using the $CO_2$ concentration data (e.g., part of the IAQ data). At all other times, when the building is assumed to be unoccupied, the outdoor airflow rate is set to zero. The detection of a transient period can be selected or identified based on one or more parameters (described above). The results of this initial detection are then compared to the occupied periods in the building. The overlapping period between the initially selected transient period and the occupied period is then used as the final transient period. In some embodiments, the final transient period represents the time during which the outdoor airflow rate is being estimated and used to modify the control strategy of the building's HVAC system. In some embodiments, the purpose of this process is to ensure that the outdoor airflow rate being estimated and used to adjust the control strategy is relevant to the current occupancy and usage of the building. An example of this can be seen in FIG. 8, which shows a time series of the outdoor airflow rate. The user-defined schedule in this example is from 8:00 am to 9:00 pm every weekday. Plotted line 804 in the FIG. represents the estimated outdoor airflow rate, plotted line 806 represents the lower bound of the estimated outdoor airflow rate, and plotted line 802 represents the upper bound of the estimated outdoor airflow rate. Thus, this implementation allows the BMS controller 366 to use the estimated outdoor airflow rate to control the HVAC system and equipment in a way that is energy efficient and also aligned with the occupancy schedule of the building, which reduces energy costs and improves indoor air quality.

In some embodiments, when the building is considered occupied, the BMS controller 366 and other equipment of the HVAC system can maintain the outdoor airflow rate, and when the building is considered unoccupied it may maintain a default outdoor airflow rate (i.e., a non-zero outdoor airflow rate). Additionally, when the building is considered occupied, the BMS controller 366 and other equipment of the HVAC system can maintain an outdoor airflow rate between the upper and lower bound of the estimated outdoor airflow rate (e.g., when power is desired to be saved, the lower bound may be selected, when increased ventilation to reduce infectious disease spread is desired, the upper bound may be selected), and when the building is considered unoccupied it may maintain a default outdoor airflow rate (e.g., ½ or ¼ of the estimated outdoor airflow rate).

Figure 9:
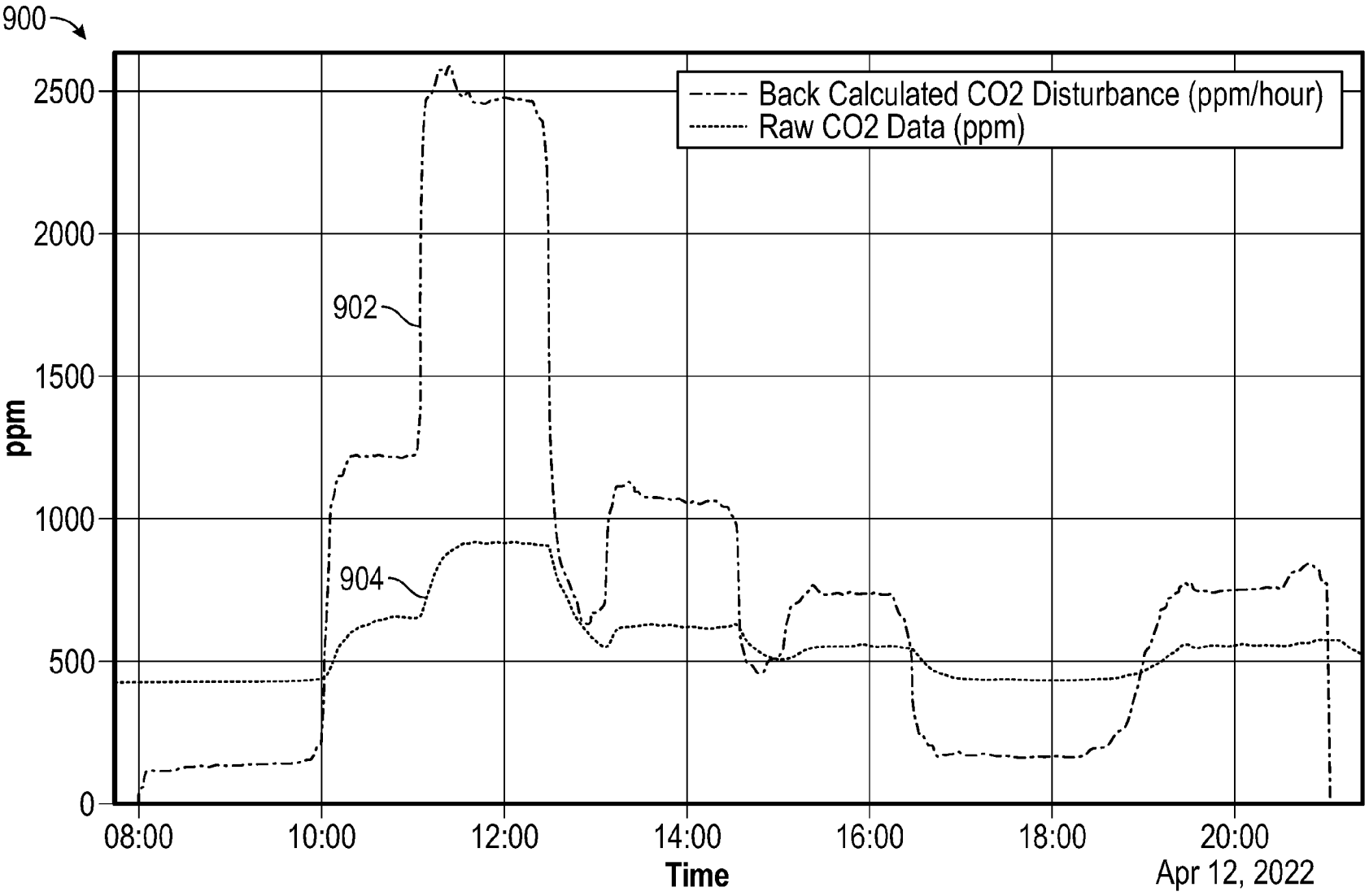
FIG. 9 depicts a graph illustrating a relationship between $CO_2$ disturbance and raw $CO_2$ data, according to some embodiments.

Referring now to FIG. 9, a graph 900 illustrating a relationship between $CO_2$ disturbance and raw $CO_2$ data, according to some embodiments. In some embodiments, a number of occupants in a space can be back determined (or back calculated) using the time series outdoor airflow rate and previously collected IAQ data. Using Equation 2 and the time series outdoor airflow rate, a $CO_2$ disturbance ($\dot{\varphi}_{CO2,dist}$) can be calculated (Equation 6):

$$\dot{\varphi}_{CO2,dist}[n] = \frac{\varphi_{CO2,z}[n+1] - \varphi_{CO2,OA}[n] - e^{-\dot{\tilde{v}}_{oa}\Delta}(\varphi_{CO2,z}[n] - \varphi_{CO2,OA}[n])}{\frac{1 - e^{-\dot{\tilde{v}}_{oa}\Delta}}{\dot{\tilde{v}}_{oa}}}$$

where $\dot{\varphi}_{CO2,z}$ is the indoor $CO_2$ concentration changes in ppm/hr, $\dot{\tilde{v}}_{oa}$ is the outdoor airflow rate in air changes/hr, $\varphi_{CO2,z}$ is the indoor $CO_2$ concentration in ppm $\varphi_{CO2,OA}$ is the outdoor $CO_2$ concentration in ppm $\dot{\varphi}_{CO2,dist}$ is the indoor $CO_2$ concentration disturbance in ppm/hr.

The back calculated $CO_2$ disturbance is shown as plotted line 902 and the raw $CO_2$ data is shown as plotted line 904. Graph 900 is an example of back calculating $CO_2$ disturbance and comparing it to raw $CO_2$ concentration data. The back calculated $CO_2$ disturbance is a measure of the change in $CO_2$ concentration that is due to the presence of people in the room. It is obtained by subtracting the estimated background $CO_2$ concentration from the raw $CO_2$ concentration data. In the example shown in FIG. 9, there is a clear increase in $CO_2$ disturbance from 11:00 am to 11:20 pm. This indicates that a large number of people entered the room during this time period. The corresponding $CO_2$ disturbance increases sharply and stays almost constant around 2500 ppm. This suggests that the number of people in the room remained relatively constant during this time period. On the other hand, between 5:00 μm and 9:00 μm, there is a decrease in $CO_2$ disturbance. This indicates that the occupants left the room during this time period. The opposite trend happened when occupants left the room. The decrease in $CO_2$ disturbance suggests that the number of people in the room decreased during this time period. Accordingly, this information can be used by the BMS controller 366 to understand occupancy patterns (e.g., to generate reports and trends for presentation on an interface or provided in push-notifications to a user device of a building manager) in the building and to improve building energy management and IAQ.

Additionally, the $CO_2$ disturbance can be approximated as (Equation 7):

$$\dot{\varphi}_{CO2,dist} = N\dot{\varphi}_{CO2,genperperson}$$

Given the approximation, the average $CO_2$ generation rate can be estimated based on various factors, such as, but not limited to, occupants' average age, metabolic rate (e.g., basal metabolic rate (BMR) or resting metabolic rate (RMR)), exercise physiology, body size and composition, etc. For example, this generation rate is a measure of the amount of $CO_2$ that is produced by a person, and can be based on the average age and metabolic rate of the occupants.

For example, table 1000 of FIG. 10 provides detailed information on how to estimate the average $CO_2$ generation rate (L/s) per person based on the average age and metabolic rate of the occupants. The information in the table is based on a set of assumptions and calculation. As shown, the $CO_2$ generation rate is very similar from age 16 to 60. In some embodiments, table 1000 can be modified for particular areas of a zone such as gym (e.g., where instead of BMR, the $VO_2$ max associated with an age can be used) versus a library, or a particular buildings (e.g., spa, school, office building, event center, etc.). In some embodiments, instead of estimating occupants, the BMS controller 366 can estimate another good or item within the building. For example, in a data center, the BMS controller 366 can estimate the number of servers in the data center based on estimating $CO_2$ generation rate (L/s) per server. In another example, in a zoo (e.g., fully indoor, or partially indoor and outdoor zoo), the BMS controller 366 can estimate the number of animals (or particular specifies of animals) in the zoo based on estimating $CO_2$ generation rate (L/s) per animal. In yet another example, in a portion of the ocean or body of water, the BMS controller 366 can estimate the number of animals (or particular specifies of animals) in the body of water based on estimating $CO_2$ generation rate (L/s) per animal. It is understood that any other types of estimations associated with $CO_2$ generation rates can be calculated unique to the particular building or place. Table 1100 of FIG. 11 depicts a simplified version of table 1000 that summarizes the information in table 1000 in a more condensed format. In general, both tables 1000 and 1100 can be used by BMS controller 366 to estimate the total amount of $CO_2$ that is produced by the occupants in a building. This information can be used to improve building energy management and IAQ, as well as to assess the environmental impact of the building.

In some embodiments, other types of environment data besides IAQ data can be used to calculate infection risk, $CO_2$ disturbance, and other characteristics. For example, water data can be used to monitor infection risk by taking samples and testing them for the presence of infectious diseases using devices that sense the presence of RNA/DNA associated with the disease. The water data can also be used to estimate the occupancy of the building or a portion of the building, alone or in combination with other occupancy detection methods, such as flow sensors that sense the flow of water from an outlet of the building and/or at various points within the building, such as the outlet of bathrooms, flow through handwashing stations and/or toilets, etc. The data from the flow sensors can be used to estimate the occupancy of the building or one or more zones by comparing the actual data with reference data regarding the expected volume of flow/number of flushes or handwashing instances expected given a particular occupant population. In some implementations, other types of devices other than water sensors can be used for sensing occupancy/$CO_2$ disturbance and/or infection risk, such as sensors that sense characteristics of the indoor air and/or sense the presence of substances on surfaces. These sensors can be used in combination with the data from the water sensors to improve the accuracy of the occupancy estimates and infection risk calculations.

In some embodiments, the BMS controller 366 can simultaneously estimate the $CO_2$ levels and the occupancy of a space, using various functions (such as piece-wise constant or linear) to model the occupancy. The BMS controller 366 can then use this information to estimate the uncertainty in the outdoor airflow rate by monitoring the squared error as the occupancy and variance are modified. Additionally, the system can estimate the $CO_2$ levels by selecting different time periods and fitting each of these periods with different occupancy levels, while keeping the ventilation constant. In some embodiments, the BMS controller 366 can estimate the $CO_2$ levels by finding the outdoor airflow rate that produces the most "regular" occupancy, which can be an optimization problem where the objective is to estimate an occupancy that doesn't have many changes. The BMS controller 366 can also use standard linear regression techniques or look at the increase in the squared error as a function of the ventilation to estimate the uncertainty in the outdoor airflow rate. Furthermore, the BMS controller 366 can calculate potential savings from DCV by comparing the ASHRAE standard at design occupancy to the ASHRAE standard at estimated occupancy, taking into account the uncertainty in the outdoor airflow rate and occupancy to drive the uncertainty in the savings estimate.

Figure 12:
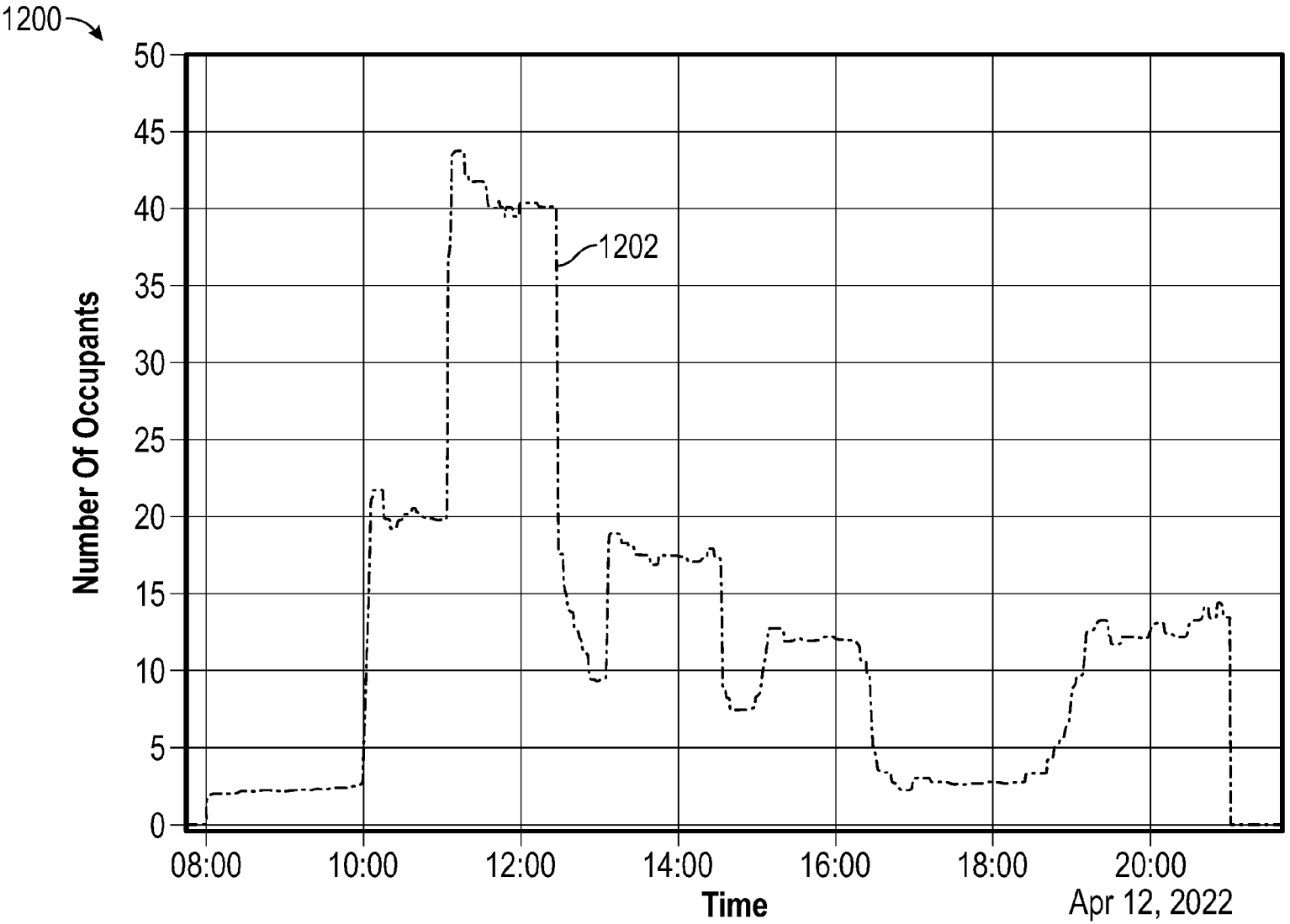
FIG. 12 depicts a graph illustrating an estimated number of occupants, according to some embodiments.

Referring now to FIG. 12, a graph 1200 illustrating an estimated number of occupants, according to some embodiments. Graph 1200 depicts an example of how the estimating $CO_2$ generation rate and back calculating $CO_2$ disturbance can be used to estimate the average $CO_2$ generation rate per person in a specific scenario. Graph 1200 is based on the assumption that the average age of occupants is in the range of 16 to 60 years old. Additionally, the metabolic rate is set to a default value of 1.0 met, which is a common value used in estimating metabolic rate. Using this information, the average $CO_2$ generation rate per person is calculated to be 61.436 ppm/hr. This calculation also takes into account the room or zone size, which is 640 square feet and a height of 10.67 feet. Graph 1200 illustrates the estimated number of occupants in the room based on the $CO_2$ generation rate and room size (and potentially additional conditions such as weather, outdoor airflow rate, etc.). Graph 1200 shows that the peak number of occupants in the room is 43 (plotted line 1202), which is higher than the room capacity of 35. This suggests that the room is overcrowded and may have poor IAQ as a result. Thus, the above example illustrates how the systems and methods described above can be used to estimate the number of occupants in a room based on the $CO_2$ generation rate. This information can be useful for building energy management and IAQ control, as well as for assessing the comfort and safety of occupants in a room.

Referring now to FIG. 13, a table 1300 including American Society of Heating, Refrigerating and Air-Conditioning Engineers (ASHRAE) recommended outdoor airflow rates based on the zone area, according to some embodiments. Table 1300 lists the minimum outdoor airflow rates recommended by ASHRAE for different occupancy categories. Table 1300 includes different outdoor airflow rates for different types of zones and use categories, such as classrooms, offices, and assembly spaces.

Figure 14:
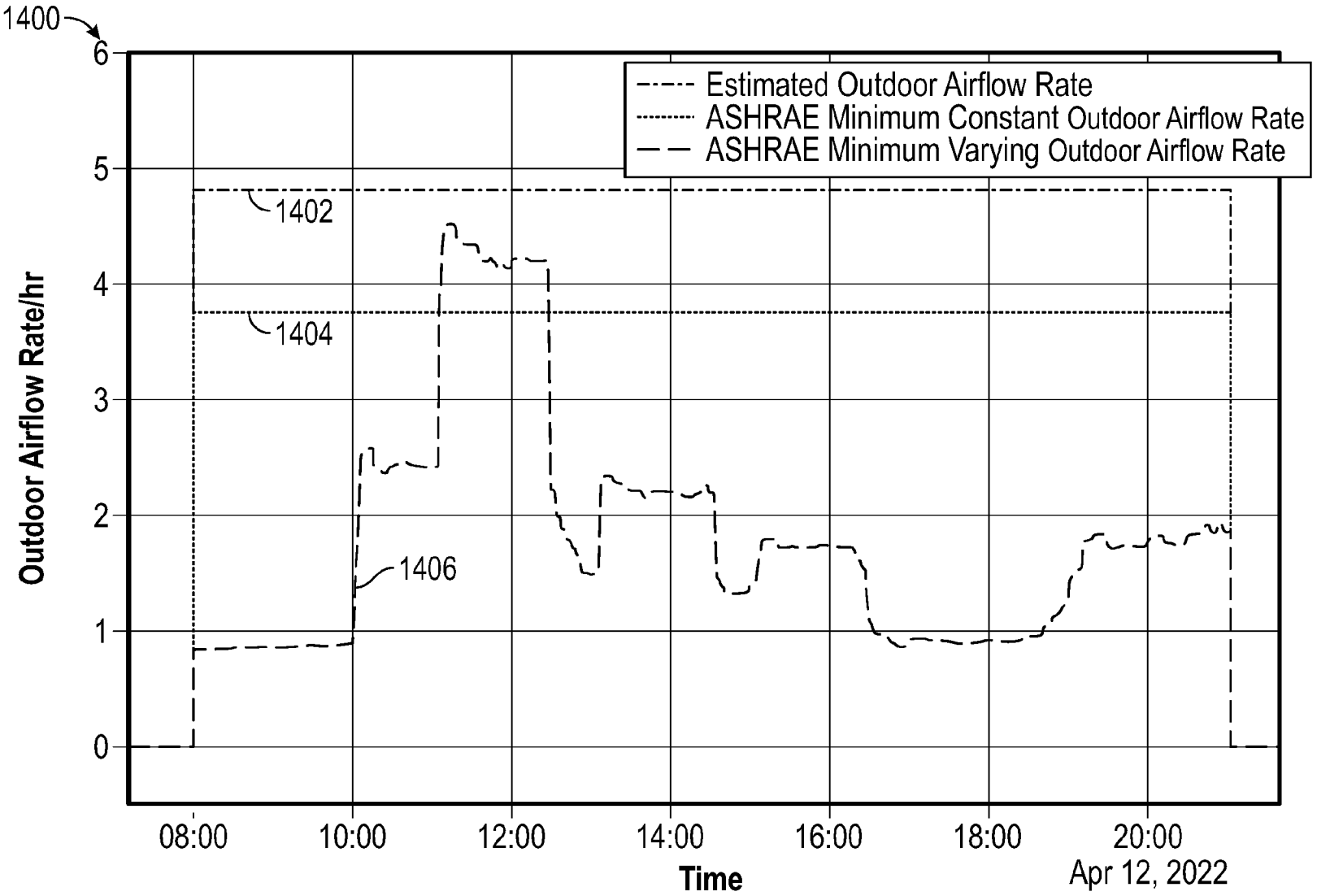
FIG. 14 depicts a graph illustrating a comparison between estimated outdoor airflow rate, ASHRAE minimum constant outdoor airflow rate, and ASHRAE minimum varying outdoor airflow rate (1406), according to some embodiments.

Referring now to FIG. 14, a graph 1400 depicting a comparison between estimated outdoor airflow rate (1402), ASHRAE minimum constant outdoor airflow rate (1404), and ASHRAE minimum varying outdoor airflow rate (1406), according to some embodiments. As shown, two ASHRAE outdoor airflow rates are calculated: the ASHRAE minimum constant outdoor airflow rate (plotted line 1404) and the ASHRAE minimum varying outdoor airflow rate (plotted line 1406). The constant outdoor airflow rate (1404) is based on the room capacity, meaning the number of people the room is designed to accommodate. The varying rate (1406), on the other hand, is based on the time-varying estimated number of occupants. This means that it takes into account the number of people in the room at any given time, as estimated using the method described earlier. The constant outdoor airflow rate (1404) is a fixed value that is calculated using the room capacity and the ASHRAE recommended outdoor airflow rate for the zone and use category. On the other hand, the varying outdoor airflow rate (1406) is dynamic and adapts to the number of occupants in the room at any given time. This allows for more precise control of the ventilation and improved indoor air quality in the building.

In an example scenario, with respect to graph 1400, a varying outdoor airflow rate can be calculated using the estimated number of occupancies (described above) with respect to graph 1200 of FIG. 12. Specifically, the room has an area of 640 square feet, is 10.67 feet in height, and the capacity is 35. In some embodiments, this information is relevant to the example scenario as it is used to calculate the outdoor airflow rate in the room (Equation 8):

$$v_{ASHRAEconstant} = 640 \times 0.12 + 35 \times 10 = 426.8cfm = \frac{426.8\ \text{feet}^3/\text{min}}{640 \times 10.67\ \text{feet}^3} = 3.75/\text{hr}$$

The area and height of the room are used to calculate the outdoor airflow rate based on the ASHRAE recommendations. The room capacity is used to calculate the constant outdoor airflow rate and compare it to the varying outdoor airflow rate that is based on the estimated number of occupants. Thus, plotted line 1406 can be calculated using the estimated number of occupancies with respect to graph 1200 of FIG. 12. Additionally, as shown, the estimated outdoor airflow rate for FIG. 7 of 4.8/hr is depicted in plotted line 1402.

In some embodiments, demand-controller ventilation (DCV) can be implemented by BMS controller 366 operating the HVAC system and equipment. DCV can be implemented to maintain IAQ in response to changes in conditions such as the number of occupants in a room. In general, a goal of using DCV is to reduce energy use compared to constant outdoor airflow rates. The control strategy of DCV is based on a feedback loop, where the system continuously monitors the IAQ and adjusts the outdoor airflow rate accordingly. This allows for the outdoor airflow rate to be adapted to the actual occupancy level, rather than being fixed at a constant rate. In some embodiments, the DCV rate used can be the ASHRAE minimum varying outdoor airflow rate. This rate is based on the time-varying estimated number of occupants in the room, as calculated using the method described above. By using this rate, BMS controller 366 operating the HVAC system and equipment can adjust the outdoor airflow rate in real-time based on the actual occupancy level, resulting in energy savings while still providing good IAQ.

Model predictive control (MPC) is a control strategy that uses a mathematical model of the system being controlled to predict future behavior and optimize control decisions. In the context of DCV, MPC algorithms can be implemented to control the outdoor airflow rate in a building based on the occupancy and air quality in different zones. In some embodiments, the algorithms continuously monitor the indoor air quality (IAQ) data, such as CO2 levels, temperature, and humidity, and use this information to predict the future occupancy and air quality in the building. Based on this prediction, the BMS controller 366 generates control instructions to adjust the outdoor airflow rate in different zones, in order to maintain a comfortable and healthy indoor environment while also reducing energy consumption. The MPC algorithm may also use other information such as historical data, weather forecast, and the building's HVAC system characteristics to generate optimal control decisions.

In some embodiments, the BMS controller 366 uses various data and models to calculate the potential energy savings and cost of implementing demand controlled ventilation in a building. The BMS controller 366 starts by determining an occupancy estimate. Using this occupancy estimate, the BMS controller 366 can calculate the ASHRAE recommended outdoor airflow rate for that level of occupancy. The BMS controller 366 can then use this ASHRAE outdoor airflow rate and/or estimated outdoor airflow rate and compare it to the actual outdoor airflow rate, as well as take into account any uncertainty in the outdoor airflow rate. This information is then used as input into a ventilation cost model, which can calculate the potential savings from implementing DCV by comparing the energy consumption under the current outdoor airflow rate to the energy consumption under the ASHRAE recommended rate.

Additionally, the BMS controller 366 can also use the ASHRAE recommended outdoor airflow rate and/or estimated outdoor airflow rate for varying occupancy levels and use that as input into the ventilation cost model to generate a cost to bring the building to standard. This cost can include the cost of upgrading or adjusting the HVAC equipment, as well as the cost of any additional energy consumption due to increased ventilation. Accordingly, the following model helps building owners and managers to determine the potential energy savings that can be achieved by implementing demand controlled ventilation, as well as understand the cost of upgrading the HVAC system to achieve the recommended ventilation levels based on occupancy. For example, the BMS controller 366 can calculate an operating cost of the time series outdoor airflow rate according to the ventilation schedule and optimize the ventilation schedule based on either (1) maintaining the time series outdoor airflow rate to one or more HVAC standards or code and minimizing the operating cost, or (2) maximizing the time series outdoor airflow rate and maintaining the operating cost below a predefined threshold.

In some embodiments, the BMS controller 366 also has the option to consider an increase in outdoor airflow rate as an additional load brought into the zone, which decreases the benefit of the DCV. The system can also estimate CO2 generation by counting the number of occupants in the building or zone, by analyzing video footage, or by other techniques such as estimating CO2 generation using the outdoor airflow rate and zone supply flows. The BMS controller 366 can also calculate the benefits of DCV on a zone-by-zone basis, and then add them together to give an upper bound on the overall benefit.

In some embodiments, the BMS controller 366 can determine an optimal $CO_2$ setpoint based on Equation 1 and the $CO_2$ disturbance calculated using Equation 6. For example, assuming the HVAC system is running in the steady state, the outdoor airflow rate can be (Equation 9):

$$v = \frac{-\dot{\varphi}_{CO2,dist}}{\dot{\varphi}_{CO2,OA} - \dot{\varphi}_{CO2,z}}$$

where the optimal $CO_2$ setpoint is the indoor $CO_2$ concentration value that makes v have a minimum error compared to the DCV outdoor airflow rate.

Referring now to FIG. 15 and energy savings generally. In some embodiments, energy savings can be achieved by using different ventilation control strategies. The calculation of energy savings can be broken down into two parts: testing period energy savings and estimated yearly energy savings. Testing period energy savings can refer to the energy savings that can be observed during a specific period of time when the ventilation control strategies are tested. This period of time could be a few days, weeks or months depending on the collection timeframe of the IAQ data. Estimated yearly energy savings, on the other hand, refers to the energy savings that are estimated to be achieved over the course of a full year based on the results of the testing period. This estimate is calculated by extrapolating the results of the testing period to a full year. In some embodiments, the energy savings calculations use the same algorithm to calculate power consumption for both the testing period and estimated yearly energy savings. In particular, it involves measuring the amount of energy used by the HVAC system under different ventilation control strategies and comparing the results to calculate the energy savings. Accordingly, a quantitative analysis can be performed by BMS controller 366 of the energy savings that can be achieved by using different ventilation control strategies. This information can be useful for building managers and owners who want to improve energy efficiency and reduce costs In some embodiments, the power consumptions break down into heating and cooling power consumptions (Equation 10):

$$P = \frac{Q}{COP}$$

where P is the total power consumption, COP is the coefficient of performance (e.g., ranging from 2-6), and Q is the heat of the cooling and heating process.

Q can be determined by (Equation 11):

$$Q=\dot{m}\Delta h=C_p\rho\nu\Delta T+h_{we}\rho\nu\Delta w$$

where $\dot{m}$ is the mass flow in kg/s, $\Delta h$ is the enthalpy difference in kJ, $C_p$ is the specific heat of the air (e.g., 1.0006 kJ/kg ° C.), $\rho$ is the density of air (e.g., 1.225 kg/m$^3$), $\nu$ is the air volume flow in m$^3$/s, $\Delta T$ is the temperature difference in ° C., $h_{we}$ is the latent heat evaporization water (e.g., 2454 kJ/kg in the air at atmospheric pressure and 20° C.), $\Delta w$ is humidity ratio difference in kg water/kg dry air.

Equation 11 can be further simplified, where the Q calculation separates into cooling and heating process (e.g., in heating $T_{oa}$<12.78° C., the humidity ratio difference is approximately equal to zero, $h_{we}\rho\nu\Delta\approx 0$) (Equation 12):

$$Q_{heating}=\rho\nu C_p\times(12.78^\circ\text{ C.}-T_{oa})$$

where $T_{oa}$ is the outdoor temperature in ° C., and where the control strategy heats up to 12.78° C. in heating mode. Any higher than 12.78° C. results in $Q_{heating}=0$.

In cooling $T_{oa}\geq 12.78^\circ$ C., the cooling processes is expressed as (Equation 13):

$$Q_{cooling}=C_p\rho\nu(T_z-T_{oa})+h_{we}\rho\nu(w_z-w_{oa})$$

where any $T_{oa}$ greater than $T_z$ results in $C_p\rho\nu(T_z-T_{oa})=0$, and any $w_{oa}$ greater than $w_z$ makes $h_{we}\rho\nu(w_z-w_{oa})=0$, wherein $w_{oa}$ is the outdoor humidity and $w_z$ is the indoor building humidity.

In summary (Equation 14):

$$Q=\begin{cases}\rho\nu C_p\times(12.78^\circ\text{ C.}-T_{oa}), & T_{oa}<12.78^\circ\text{ C.}\\ C_p\rho\nu(T_z-T_{oa})+h_{we}\rho\nu(w_z-w_{oa}), & T_{oa}\geq 12.78^\circ\text{ C.}\end{cases}$$

Accordingly, Equations 10-14 provide a process for calculating the power consumption of different ventilation control strategies. The equations involve collecting IAQ data, sensor measurements, and calculated values, such as, but not limited to, temperature, $CO_2$ measurements (e.g., indoor and outdoor), humidity, and outdoor airflow rate, to the power consumption of the HVAC system. Equation 14, in particular, is used by BMS controller 366 to calculate the power consumption of the ventilation control strategies. In Equation 14, $T_{oa}$, $T_z$, $w_{oa}$, and $w_z$ are sensor measurements or calculated values that are based on sensor measurements. These values could include temperature, humidity, occupancy, or other environmental variables that are relevant to the HVAC system. The variable $\nu$ in equation 14 can represent different outdoor airflow rates, such as the estimated outdoor airflow rate, which is calculated above with reference to Equations 1-3, the ASHRAE minimum outdoor airflow rate, or the DCV rate, which is calculated above. This enables the power consumption of different ventilation control strategies to be compared. The ASHRAE energy savings can be calculated by (Equation 15):

$$\Delta P_{ASHRAE}=P_{Baseline}-P_{ASHRAE}$$

where $\Delta P_{ASHRAE}$ is the energy savings in KW compared to the baseline, $P_{Baseline}$ is the power consumption in KW calculated using the estimated outdoor airflow rate, and $P_{ASHRAE}$ is the power consumption in KW calculated using ASHRAE suggested outdoor airflow rate.

The DCV energy savings can be calculated by (Equation 16):

$$\Delta P_{DCV}=P_{Baseline}-P_{DCV}$$

where $\Delta P_{DCV}$ is the energy savings in KW compared to the baseline, $P_{Baseline}$ is the power consumption in KW calculated using estimated outdoor airflow rate, and $P_{DCV}$ is the power consumption in KW calculated using the DCV rate. Additionally, based on the definition of DCV, it can be expected that the energy savings is positive from the DCV outdoor airflow rate, whereas the savings of the suggested ASHRA outdoor airflow rate may be positive or negative.

In some embodiments, the testing period energy savings can be calculated using Equations 10-16. The testing period can last 2-4 weeks, during which the energy consumption of the HVAC system is measured and recorded. The cost savings is calculated based on energy savings and blended utility price defined by the user. In general, the blended utility price includes the cost of electricity and natural gas, and the cooling process cost uses electricity. The cost of heating may vary depending on the zone-based heating source, which is defined by the user, and the coefficient of performance (COP) of cooling, electric heating, and natural gas heating is also determined by the user or the BMS controller 366.

Referring now to FIG. 15, a table 1500 of weather data, according to some embodiments. For example, to estimate the yearly energy savings, a database of one-year weather data from 25 U.S. cities can be used, shown in table 1500. In some embodiments, the cities are selected based on eight climate zones from the American Society of Heating, Refrigerating and Air-Conditioning Engineers (ASHRAE) and the Building America Best Practices Volume 7.3-2015. The BMS controller 366 may select (or the user) a city with a similar climate type to the testing site, either by finding the city with minimum location difference (latitude & longitude) compared to the testing site, or by finding the city with the most similar weather data during the testing period, or both. In some embodiments, the yearly indoor temperature holds different constants on weekdays and weekends, and the constant number is the mean of indoor temperature on weekdays and weekends during testing. Similarly, the yearly humidity ratio is different and constant during weekdays and weekends. The annual estimated ASHRAE and DCV outdoor airflow rate is a repeated weekly average outdoor airflow rate of the testing period. Yearly energy and cost savings is calculated using Equations 10-16 and the annual indoor and weather data of table 1500 (or another table or dataset with annual indoor and weather data). This enables BMS controller 366 and building managers to obtain valuable information on energy savings, by comparing the energy consumption during a testing period and estimating the energy savings over a full year.

In some embodiments, to determine a rollup value, a weight average is taken of all the costs/savings values per area since some zones may not have user-entered regions. Thus, the rollup value is calculated by taking a weighted average of the costs or savings values for each individual area or zone within the building or site. In some embodiments, first the BMS controller 366 can determine the weighted average of all cost/savings values for zones with known areas. This can be done by dividing the sum of all cost/savings values for zones with known areas by the sum of all known areas. In some embodiments, the calculated value can be given a weight equal to the number of zones with known areas. For example, each value for a zone without a known area is given a weight of 1. The weighted average of zones with corresponding weight is then added to all values of zones without areas, and the sum is divided by the total number of zones. Thus, this provides the overall rollup value for the building or site. The rollup value can then be multiplied by the total area of the site, including both zones used in the analysis and zones not used. However, if the user doesn't enter the entire site area, the rollup value may not be populated. A weighted cost rate can be calculated by (Equation 17):

$$R = \frac{M_{total}}{A_{total} + eps^*} \times \frac{N_{total}}{N_{total} + n_{total}} + \frac{m_{total}}{N_{total} + n_{total}}$$

where the variables $A_{total}$ is the sum of all given areas, $M_{total}$ is the sum of the energy costs of all zones that have user-enter areas, $m_{total}$ is the sum of energy cost per area that doesn't have a user entered, $N_{total}$ is the total number of zones that have a user-enter area, $n_{total}$ is the total number of zones that don't have user entered area, and eps is a floating point relative accuracy in MATLAB (e.g., close to zero).

Thus, the weighted cost rate enables the BMS controller 366 to obtain a single value that represents the overall energy costs or savings for a building or site, by taking a weighted average of the costs or savings values for each individual area or zone within the building or site. The whole site cost can be calculated by (Equation 18):

$$C = R \times A_{total}$$

Referring now to FIGS. 16-30 generally, which are describes when the defined schedules do not match the actual schedules. That is, the calculations discussed above are based on a user-defined schedule of when a room is occupied, and it also acknowledges that in some scenarios, the defined schedule may not be aligned with the actual schedule. However, when the defined schedule does not match the actual schedule, it can have an impact on IAQ and energy savings. For example, if the defined schedule is shorter than the actual schedule, it could mean that the ventilation system is not running for as long as it should be, which could result in poor IAQ. On the other hand, if the defined schedule is longer than the actual schedule, it could mean that the HVAC and ventilation system (e.g., operated by BMS controller 366) is running for longer than it should be, which could result in wasted energy and higher costs. Accordingly, room schedules can be automatically changed in the building management system to improve IAQ or achieve additional energy and cost savings. By making sure the defined schedule matches the actual schedule, the HVAC and ventilation system can be run at the appropriate times, which will result in better IAQ and energy savings.

In some embodiments, a room occupied schedule analysis can be performed by BMS controller 366. First, the analysis can include performing a detection. In some embodiments, performing a detection can include (1) (sometimes referred to as a "step") collecting or receiving IAQ data and BMS data. That is, for each zone, the BMS controller 366 can collect and/or receive indoor $CO_2$ concentration data and associated time stamp (e.g., the unit of $CO_2$ concentration is ppm, and the sample rate being 1 minute), outdoor $CO_2$ concentration data and associated time stamp (e.g., the unit of $CO_2$ concentration is ppm, and the sample rate is 1 minute), and outdoor airflow rate and the associated time stamp (e.g., the outdoor airflow rate can be actual or estimated by using the method described above with reference to Equations 1-3), where the unit of outdoor airflow rate is /hr and the sample rate is 1 minute). In some embodiments the sample rate may be shorter or longer than 1 minute.

Figure 16:
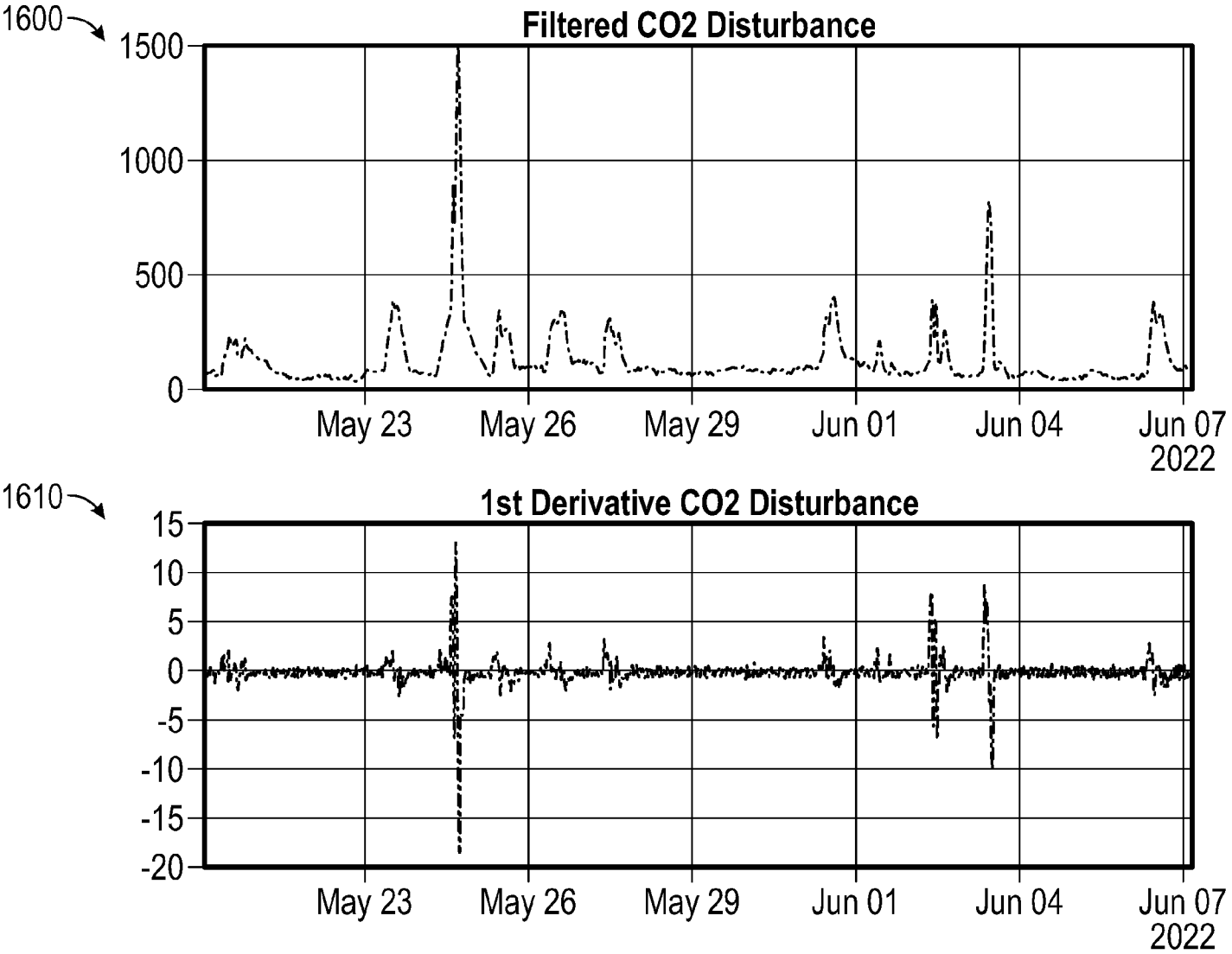
FIG. 16 depicts graphs of time series $CO_2$ disturbances, according to some embodiments.

In some embodiments, performing a detection can further include (2) calculating a time series $CO_2$ disturbance using Equation 6. The values of Equation 6 including $\dot{\varphi}_{CO2,z}$, $\dot{\tilde{v}}_{oa}$, $\varphi_{CO2,z}$, $\varphi_{CO2,OA}$, and $\dot{\varphi}_{CO2,dist}$ can be determined from the IAQ data. In some embodiments, performing a detection can further include (3) filtering the raw $CO_2$ disturbance using a moving-average filter with a 30 minute window (or 15 minutes, or 1 hour, or 4 hours). For example, a moving average filter (or another filter) can be used to smooth out fluctuations in data by removing random noise. In particular, the filter can be implemented by calculating the average of a set of consecutive data points over a specific time window. In the above application, the time window is set at 30 minutes, which corresponds to 30 samples of data. The moving average filter functions by iteratively sliding the time window over the data set, calculating the average for each window and replacing the original data points with the average values. This process continues until the end of the data set is reached, resulting in a smoother representation of the original data that has reduced fluctuations caused by random noise. In some embodiments, performing a detection can further include (4) calculating a $1^{st}$ derivative of the raw $CO_2$ disturbance using a filter (e.g., Savitzky-Golay filter) within 30 minute windows (or 15 minute, 60 minute, or 2 hour windows). FIG. 16 depicts graph 1600 (filtered time series $CO_2$ disturbance) and graph 1610 ($1^{st}$ derivative raw $CO_2$ disturbance). In some embodiments, performing a detection can further include (5) calculating a daily $CO_2$ disturbance range of the filtered time series $CO_2$ disturbance, where the range can be between the $95^{th}$ percentile and $5^{th}$ percentile of the filtered $CO_2$ disturbance. In some embodiments, performing a detection can further include (6) identifying outliers of the daily $CO_2$ disturbance range, where an outlier is any day the $CO_2$ disturbance range exceeds the $85^{th}$ percentile of all daily ranges.

Figure 17:
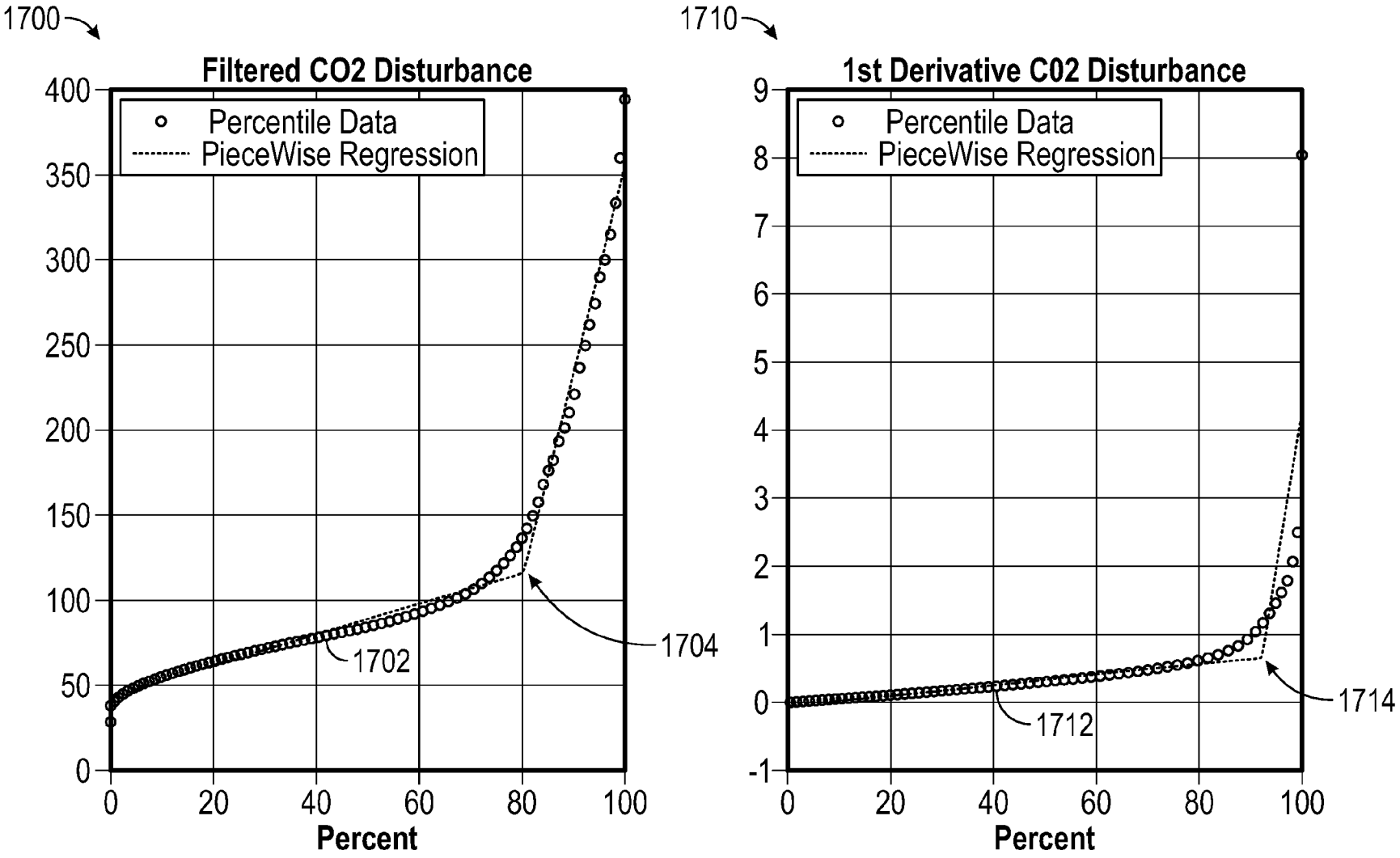
FIG. 17 depicts a graph of the filtered time series $CO_2$ disturbance, according to some embodiments.
Figure 18:
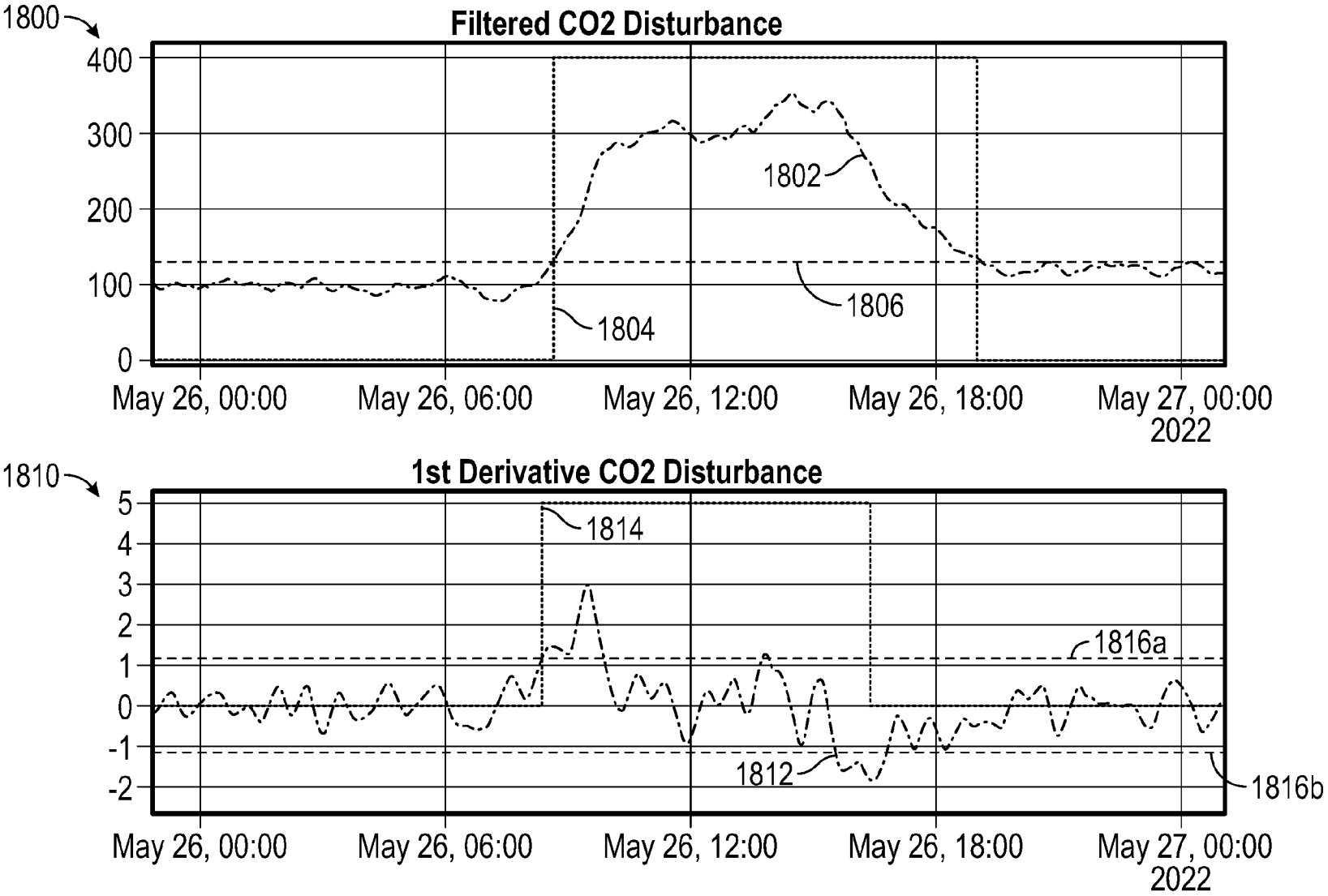
FIG. 18 depicts a graph illustrating occupied time ranges based on the plotted filtered $CO_2$ disturbance, according to some embodiments.

In some embodiments, performing a detection can further include (7) identifying an inflection point (e.g., knee) of the filtered $CO_2$ disturbance and the Pt derivative of $CO_2$ disturbance. Both the filtered and $1^{st}$ derivative $CO_2$ disturbance are all the non-outlier days' data (detected from step 6). In some embodiments, the inflection point can be identified based on determining the $1^{st}$ to $100^{th}$ percentile of the filtered and $1^{st}$ derivative, executing a piecewise linear regression model of the percentile data, and analyzing the plotted data points to identify the inflection point (or knee point) which can be shown as a junction point between two regression lines. For example, as shown with reference to FIG. 17, graph 1700 of the filtered time series $CO_2$ disturbance can be plotted that includes the piecewise regression data points 1702 and an identified inflection point 1704. Additionally, graph 1710 of the Pt derivate raw time series $CO_2$ disturbance can be plotted that includes the piecewise regression data points 1712 and an identified inflection point 1714. Accordingly, FIGS. 16-17 depict an example of finding the inflection point from step to step 7. From the filtered time series $CO_2$ disturbance of FIG. 16, May 24 and June 3 may be considered the outlier days since the ranges are outside the $85^{th}$ percentile during the testing period. FIG. 17 depicts the piecewise linear regression result of filtered and Pt derivative $CO_2$ disturbance. The knee point of filtered $CO_2$ disturbance is at $80.345^{th}$ percentile, and the knee point of Pt derivative $CO_2$ disturbance is at $92.2513^{th}$ percentile. As shown, data on indoor and outdoor $CO_2$ concentrations, outdoor airflow rate, and time stamps are used by BMS controller 366 to detect when a room is occupied. BMS controller 366 identifies patterns in the data, such as changes in $CO_2$ levels, to identify when the room is in use. By filtering and calculating the derivative of the $CO_2$ disturbance data, the algorithm is able to identify specific points in time when the room is occupied, and can be used to adjust the outdoor airflow rate and improve IAQ.

In some embodiments, performing a detection can further include (8) determining an occupied time range for a room using the filtered and $1^{st}$ derivative $CO_2$ disturbance data. For filtered $CO_2$ disturbance, inflection point 1704 can be used as a threshold (e.g., $CO_2$ disturbance threshold). With reference to graph 1800 of FIG. 18, the occupied time range can be determined, where the plotted line 1804 depicts the selected occupied time range based on the plotted filtered $CO_2$ disturbance 1802 going above and below the $CO_2$ disturbance threshold (plotted line 1806). For the $1^{st}$ derivative $CO_2$ disturbance, inflection point 1714 can be used as an absolute threshold (e.g., first derivative $CO_2$ disturbance threshold). For every day, select the first point greater than the absolute thresholds as the start time, and select the last peak time smaller than the negative absolute threshold as the end time. With reference to graph 1810 of FIG. 18, the occupied time range can be determined, where the plotted line 1814 depicts the selected occupied time range based on the plotted $1^{st}$ derivative $CO_2$ disturbance 1812 going above and below the absolute $1^{st}$ derivative $CO_2$ disturbance threshold (plotted lines 1816*a* and 1816*b*).

Figure 19:
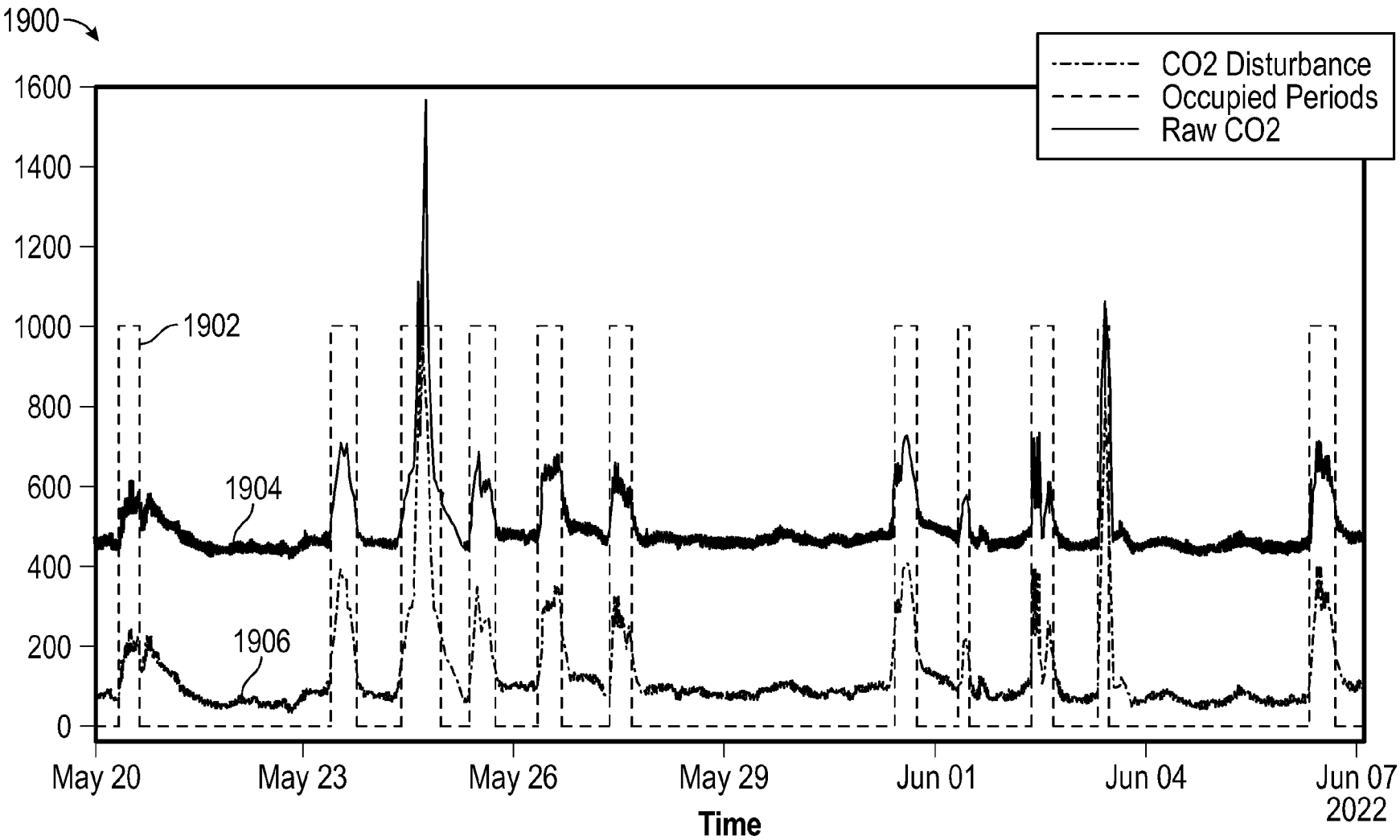
FIG. 19 depicts a graph 1900 of an occupied period during a testing period, according to some embodiments.

In some embodiments, performing a detection can further include (9) combining two selected occupied ranges. The combination only keeps the overlapped time range or period of the filtered and $1^{st}$ derivative $CO_2$ disturbance. For example, as shown with reference to FIG. 18, the combination of the two ranges of graphs 1800 and 1810 would include taking the start time of graph 1800 (plotted line 1804) and the end time of graph 1810 (plotted line 1814). In some embodiments, performing a detection can further include (10) combining periods based on if any occupied/unoccupied period is less than a valid single period (e.g., 30 minutes, 1 hour, 2 hours, 4 hours, 12 hours) (condition 1), and the shorter period is between the same occupied/unoccupied periods (condition 2). If the two conditions are satisfied, then the BMS controller 366 can make the shorter period the same as the adjacent periods. By combining the two selected occupied ranges and eliminating short periods, the algorithm is able to identify the true occupied time range, which can then be used to adjust the outdoor airflow rate and improve IAQ. Graph 1900 of FIG. 19 depicts the occupied period during the testing period. As shown, plotted line 1906 depicts the $CO_2$ disturbance, plotted line 1902 depicts the occupied period, and plotted line 1904 depicts the raw $CO_2$ disturbance.

In some embodiments, schedules for rooms can be recommended by the BMS controller 366 based on the occupied schedule determined across all zones. In general, a recommendation can include grouping rooms with similar schedules, then all days within the similar schedule can be grouped within the same schedule room, then finally a weekly schedule is recommended for all rooms. Accordingly, the schedule takes into account the occupied times for each room, as well as the schedules of similar rooms, in order to ensure that the recommended schedule is accurate and efficient. In some embodiments, by grouping rooms with similar schedules and identifying patterns within those schedules, the below described method provides recommendations that are tailored to the specific needs of each room.

In some embodiments, different room schedule clustering can be executed by BMS controller 366. In general, a plurality of area occupancy schedules that include the area occupancy schedule based on a plurality of clustering indexes can be clustered. In some embodiments, clustering can include (1) calculating a similar disturbance between two different room schedules (sometime referred to herein as "area occupancy schedules"). The similar disturbance can be at least one of a hamming distance, a $CO_2$ correlation, a cosine similarity, or a tanimoto coefficient between the area occupancy schedule and at least another area occupancy schedule. For example, a hamming distance between two different room schedules can be calculated, where this distance represents the similarity between two occupied schedules (Equation 19):

$$d_h = \sum_{i=1}^{n} |x_i - y_i|$$

where $d_h$ is the hamming distance, $x_i$ and $y_i$ are ith samples of the occupied status of room x and room y, respectively.

Figure 20:
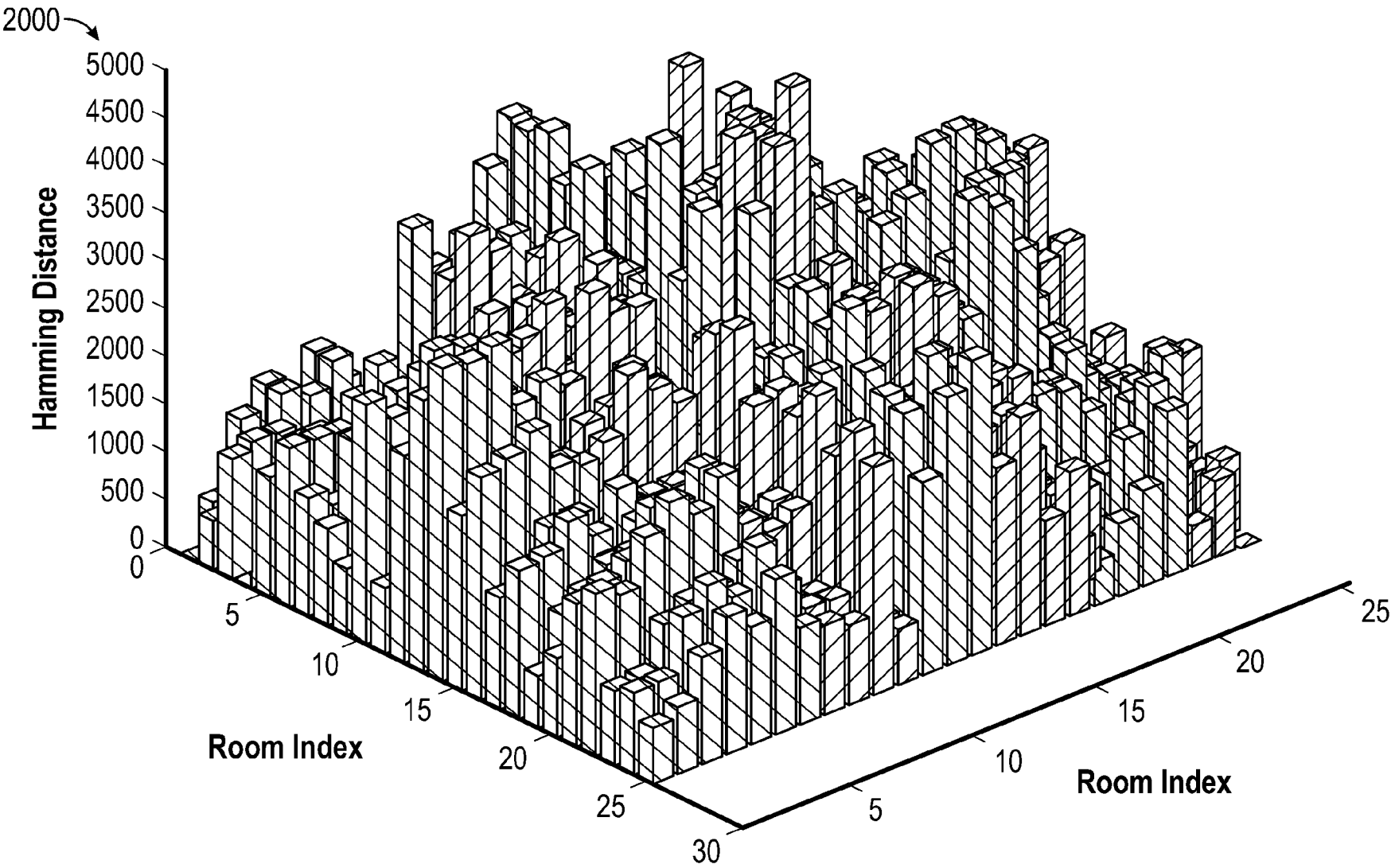
FIG. 20 depicts a hamming distance between different rooms, according to some embodiments.

Graph 2000 of FIG. 20 depicts the hamming distance between different rooms. In particular, hamming distance is a distance metric that measures the number of positions at which the corresponding elements are different. Alternatively, or in combination, another method is to compare the Pearson correlation of $CO_2$ concentration between two rooms. This measures the correlation between the $CO_2$ concentration in two rooms over time and can be used as a metric for similarity. Another method is to calculate the cosine similarity of two schedules. This method compares the similarity of two schedules by measuring the angle between the two schedules. A value of 1 indicates that the two schedules are identical, while a value of 0 indicates that the two schedules are completely different. Additionally, Tanimoto coefficients of two schedules can also be calculated. Tanimoto coefficient compares the similarity of two sets of binary data, in this case schedules, by measuring the ratio of the number of elements that are in both sets, to the number of elements that are in either set. Thus, multiple methods can be used to calculate the similarity between the occupied schedules of different rooms. By comparing the Pearson correlation of $CO_2$ concentration, cosine similarity of schedules, Tanimoto coefficients, and hamming distance, the algorithm can identify which rooms have similar schedules and make recommendations accordingly.

Figure 21:
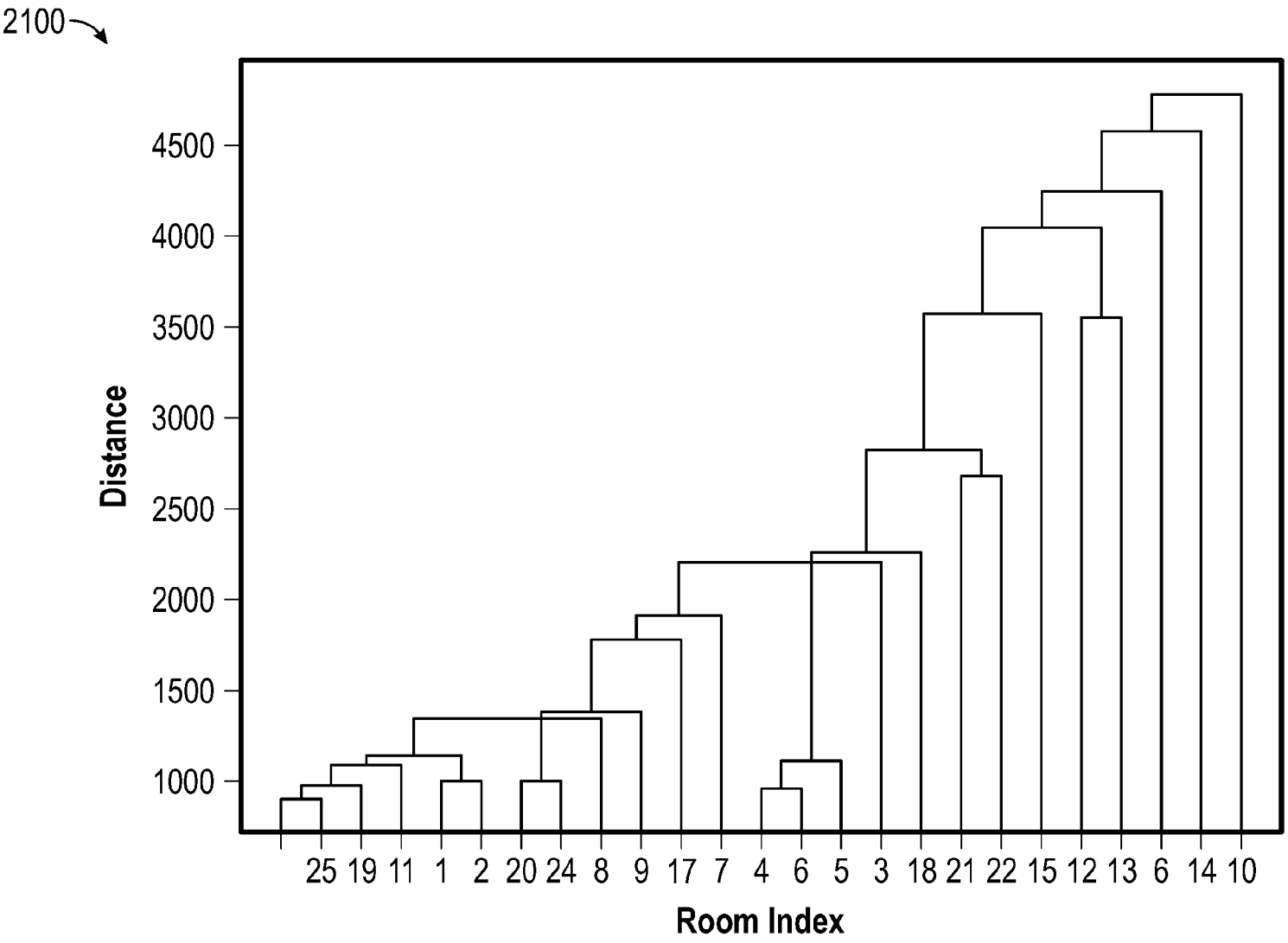
FIG. 21 depicts a dendrogram plot of a hierarchical binary cluster tree, according to some embodiments.
Figure 22:
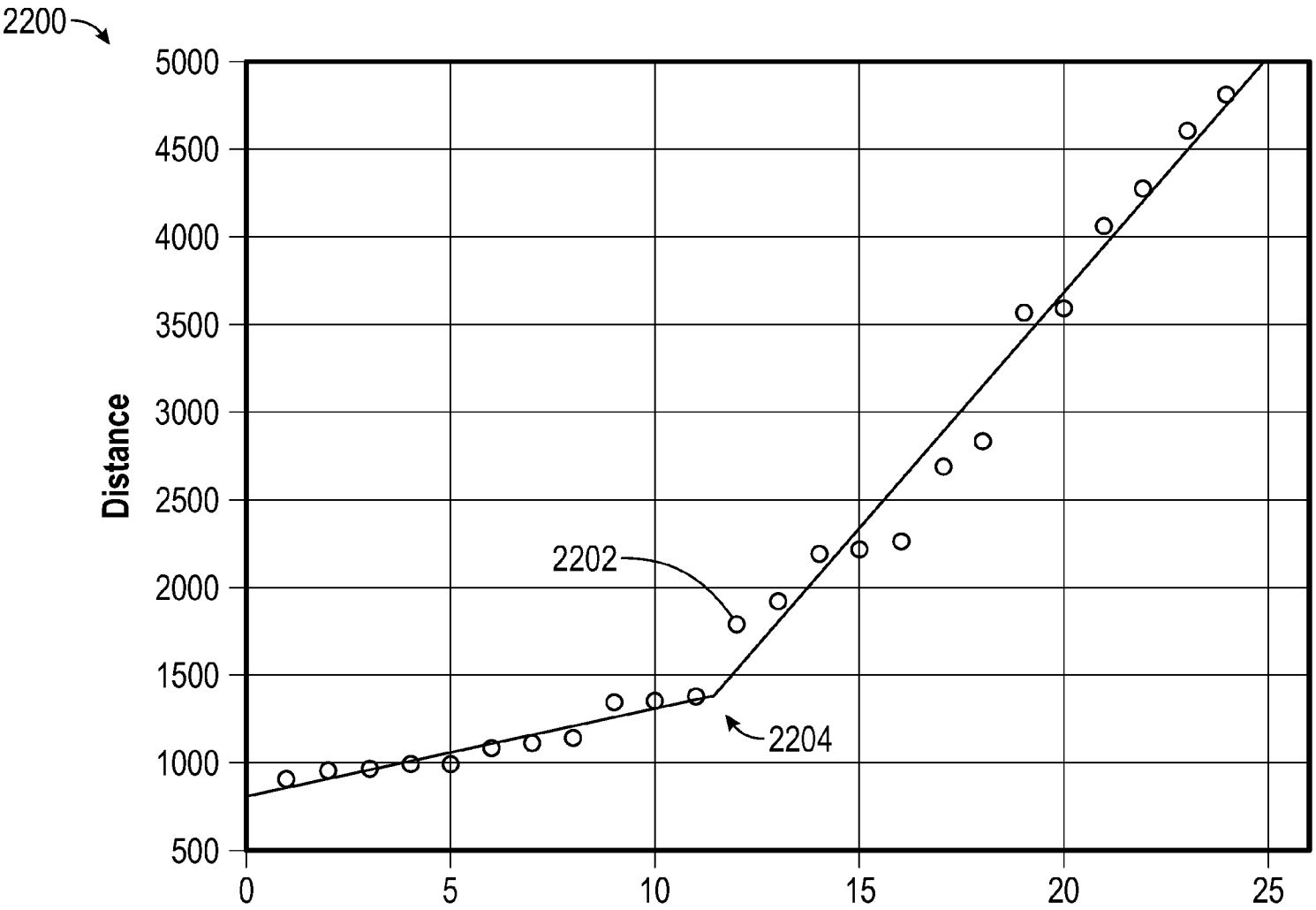
FIG. 22 depicts a graph of a cluster tree, according to some embodiments.

In some embodiments, clustering can further include (2) using single-linkage clustering to find a similar schedule across different regions. Single-linkage clustering is a method of clustering where the similarity between two clusters is defined as the minimum similarity between any two points in the two clusters. In this case, the step 2 finds similar schedules across different rooms by using the similarity measures calculated from the method discussed above, such as the Pearson correlation of $CO_2$ concentration, cosine similarity of schedules, Tanimoto coefficients, and hamming distance. The single-linkage clustering creates a hierarchical binary cluster tree, where each room is a leaf node, and each parent node represents a cluster of rooms with similar schedules. As the single-linkage clustering progresses, the clusters merge until all the rooms belong to one final cluster. The dendrogram plot 2100 of the hierarchical binary cluster tree is shown in FIG. 21. It is a graphical representation of the hierarchical binary cluster tree, where the y-axis shows the similarity measure and the x-axis shows the rooms. The dendrogram shows how the rooms are grouped into clusters based on the similarity measure. Thus, using single-linkage clustering to group rooms with similar schedules, enables the BMS controller 366 to identify similar patterns of occupancy and make recommendations accordingly.

In some embodiments, after using single-linkage clustering to group rooms with similar schedules, clustering can further include (3) using a piecewise regression model to find the knee point (or inflection point) of all the cluster tree distances. In some embodiments, piecewise regression is a technique used to analyze a dataset where the relationship between the independent and dependent variables is not linear throughout the data. The technique involves dividing the data into several segments and fitting a separate line to each segment. In this case, the knee point is the junction point between two regression lines. The BMS controller 366 uses piecewise regression to analyze the distances between the rooms in the cluster tree obtained from the single-linkage clustering. The knee point of the cluster tree distances is found by applying the same process explained earlier, first calculating the $1^{st}$ to $100^{th}$ percentile of the distances, then executing piecewise linear regression of the percentile data, the knee point is the junction point between two regression lines. For example, as shown with reference to FIG. 22, graph 2200 of the cluster tree can be plotted that includes the piecewise regression data points 2202 and an identified inflection point 2204.

In some embodiments, clustering can further include (4) using the knee point as the threshold to separate clusters. That is, the knee point (or inflection point) of the cluster tree distances represents a threshold (sometimes referred to herein as an "area cluster separation threshold") that separates the clusters of rooms with similar schedules from those with dissimilar schedules. This knee point is used to make a final recommendation for the room schedule, which is a schedule (e.g., daily, weekly, or monthly schedule) for all rooms in the same cluster. Thus, the BMS controller 366 uses piecewise regression to find the knee point of all the cluster tree distances after single-linkage clustering. This knee point is used to make a final recommendation for the room schedule, which is a schedule for all rooms in the same cluster. This provides improvement to current scheduling systems by identifying the threshold that separates the clusters of rooms with similar schedules from those with dissimilar schedules, thus making an improved final recommendation of schedule for the rooms.

Figure 23:
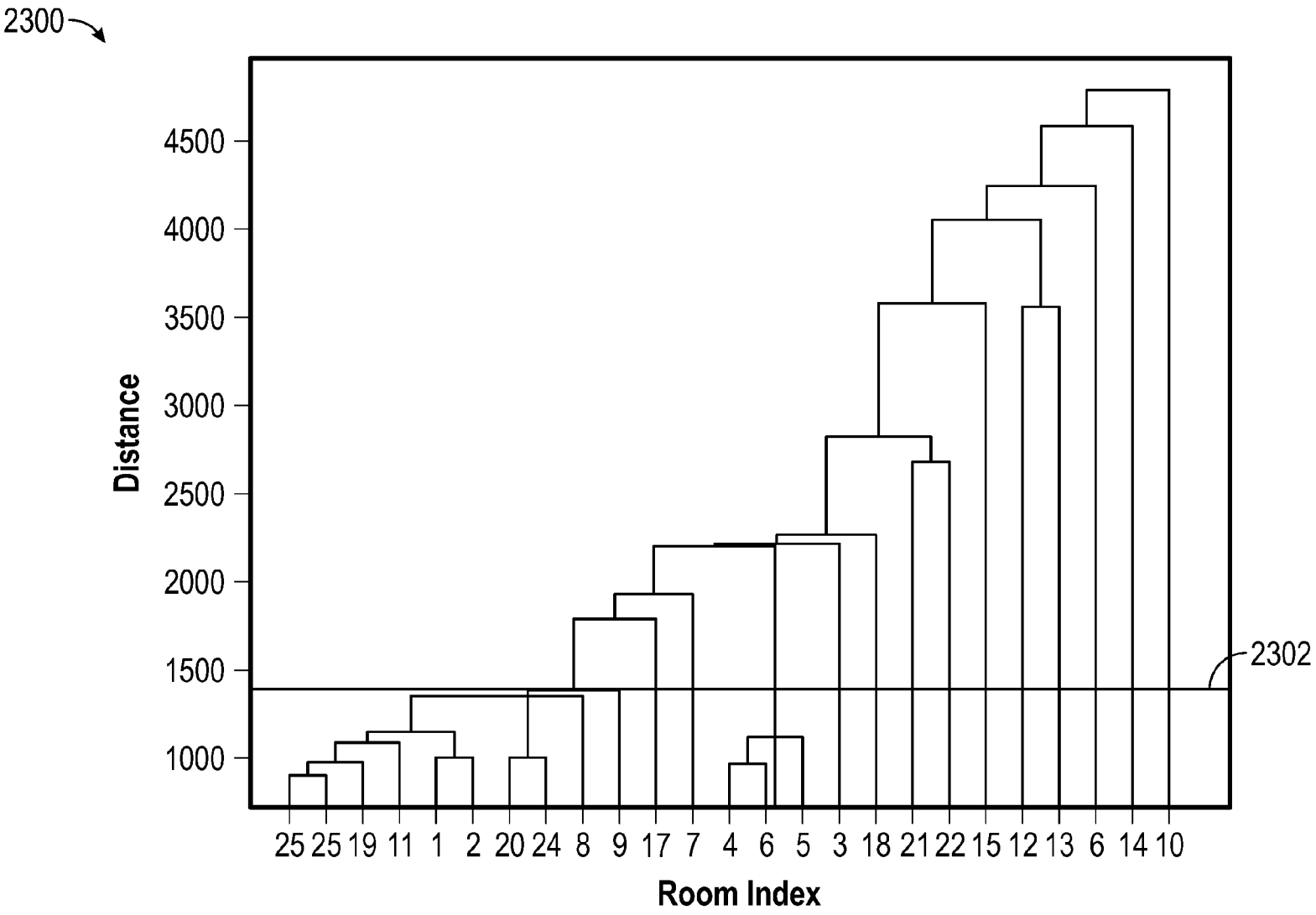
FIG. 23 depicts a dendrogram plot illustrating cluster separation, according to some embodiments.

By applying the threshold, the BMS controller 366 separates the rooms into different clusters based on their similarity in schedule. The knee point threshold (area cluster separation threshold 2302) is used to cut the dendrogram plot at a certain level, to form clusters of rooms with similar schedules. The dendrogram plot 2300 illustrating the clustering separation is shown in FIG. 23. It depicts how the rooms are separated into different clusters based on their similarity in schedule. In this example, the threshold (2302) separates the room into 14 clusters, meaning that the rooms are grouped into 14 clusters based on their similarity in schedule. Each cluster represents a group of rooms with similar schedules. Table 2400 of FIG. 24 depict the cluster indexes, where each cluster index includes one or more rooms grouped together. The final output is a recommended schedule for all rooms in the same cluster. Using the knee point as a threshold separates the clusters of rooms with similar schedules from those with dissimilar schedules, this helps to identify the threshold that separates the clusters of rooms with similar schedules from those with dissimilar schedules, thus making a final recommendation of schedule for the rooms based on the cluster they fall into. This regression model separates the rooms into different clusters based on their similarity in schedule, the final output is a recommended schedule for all rooms in the same cluster.

Figure 25:
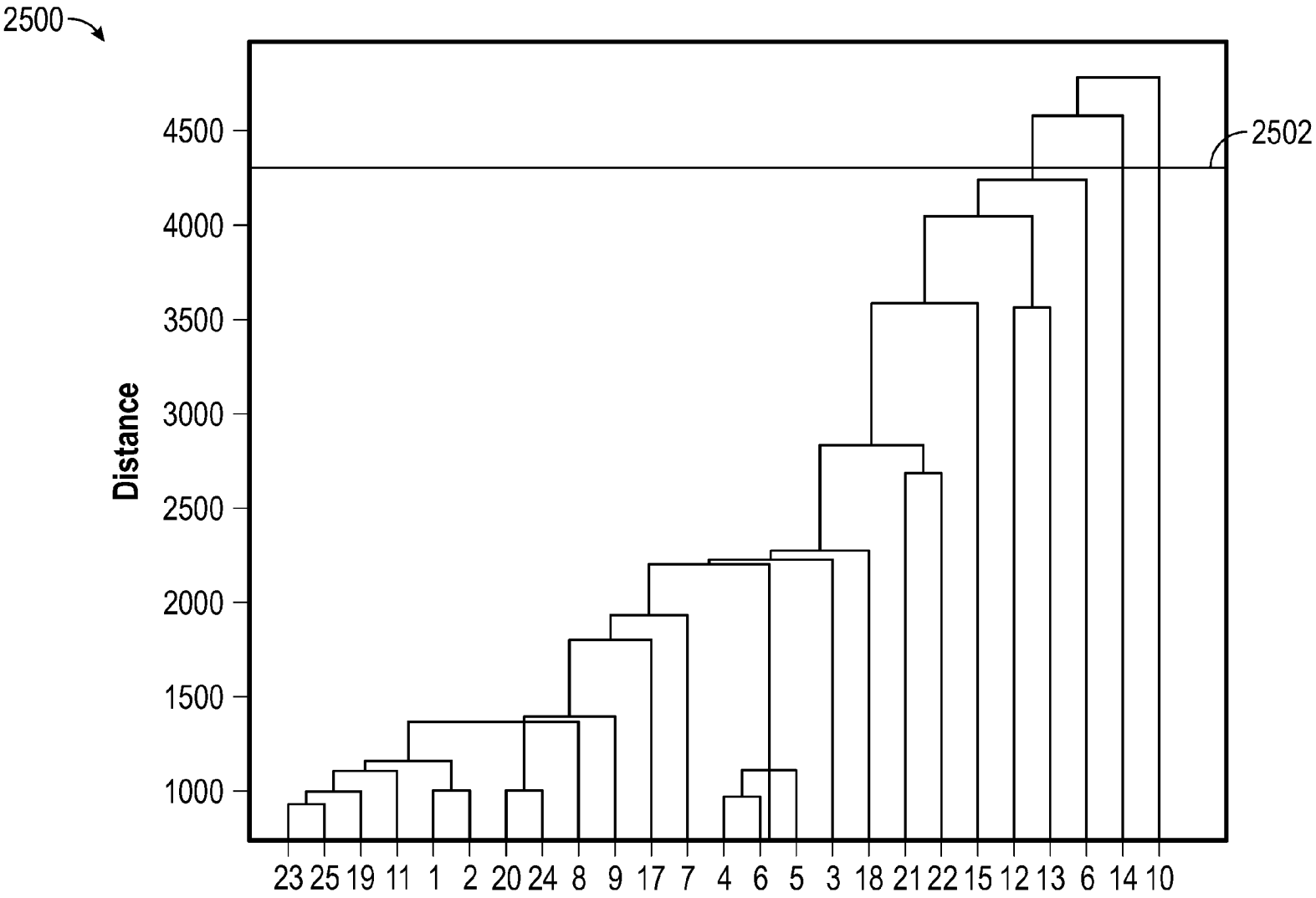
FIG. 25 depicts a dendrogram plot illustrating cluster separation, according to some embodiments.

In some embodiments, clustering can further include (5) limiting the number of clusters. In particular, after executing single-linkage clustering to group rooms with similar schedules, the BMS controller 366 executes a piecewise regression model to find the knee point of all the cluster tree distances. The knee point can be used as the threshold to separate the clusters into a manageable number. In this above application, the threshold separates the rooms into 14 clusters. However, in some embodiments, to minimize the number of manual schedule changes, it may be recommended to limit the maximum number of clusters (e.g., to three, four, or five). The dendrogram plot 2500 illustrating the updated clustering separation is shown in FIG. 25. In this example, the threshold (2502) separates the room into 3 clusters, meaning that the rooms are grouped into 3 clusters based on their similarity in schedule. Table 2600 of FIG. 26 depict the new cluster indexes, where each cluster index includes one or more rooms grouped together. It should be understood that the threshold 2502 can be moved to satisfy one or more equipment parameters of the HVAC system, energy constraints, and/or user preferences.

In some embodiments, once the rooms (or areas or spaces) have been grouped into clusters, the BMS controller 366 can recommend a weekly schedule for all the rooms in the same cluster. In some embodiments, BMS controller 366 can perform weekly schedule clustering by (1) (sometimes referred to as "step 1") identifying the three features for each day across all the rooms in the same cluster: occupied time, end occupied time, and total occupied hours. These features can be used to calculate the similarity between different days' schedules. The most commonly used similarity measure is Euclidean distance, however, other measures such as Hamming distance, Jaccard similarity, cosine similarity, can also be used.

Thus, the BMS controller 366 can further perform weekly schedule clustering by (2) calculating the Euclidean distance by taking the square root of the sum of the squares of the differences between each element of the two schedules. For example, the Euclidean distance between two days' schedules can be calculated using the following formula (Equation 20):

$$d_n = \sqrt{(t_{s,x} - t_{s,y})^2 + (t_{e,x} - t_{e,y})^2 + (T_{on,x} - T_{on,y})^2}$$

where $d_n$ is the Euclidean distance between two days, $t_{s,x}$ and $t_{s,y}$ is the start time of day x and y, respectively, $t_{e,x}$ and $t_{e,y}$ is the end time of day x and y, respectively, and $T_{on,x}$ and $T_{on,y}$ are the occupied hours of day x and y, respectively. This measure will give a value between 0 and 1, where 0 means that the days are identical and 1 means that they are completely different.

Figure 27:
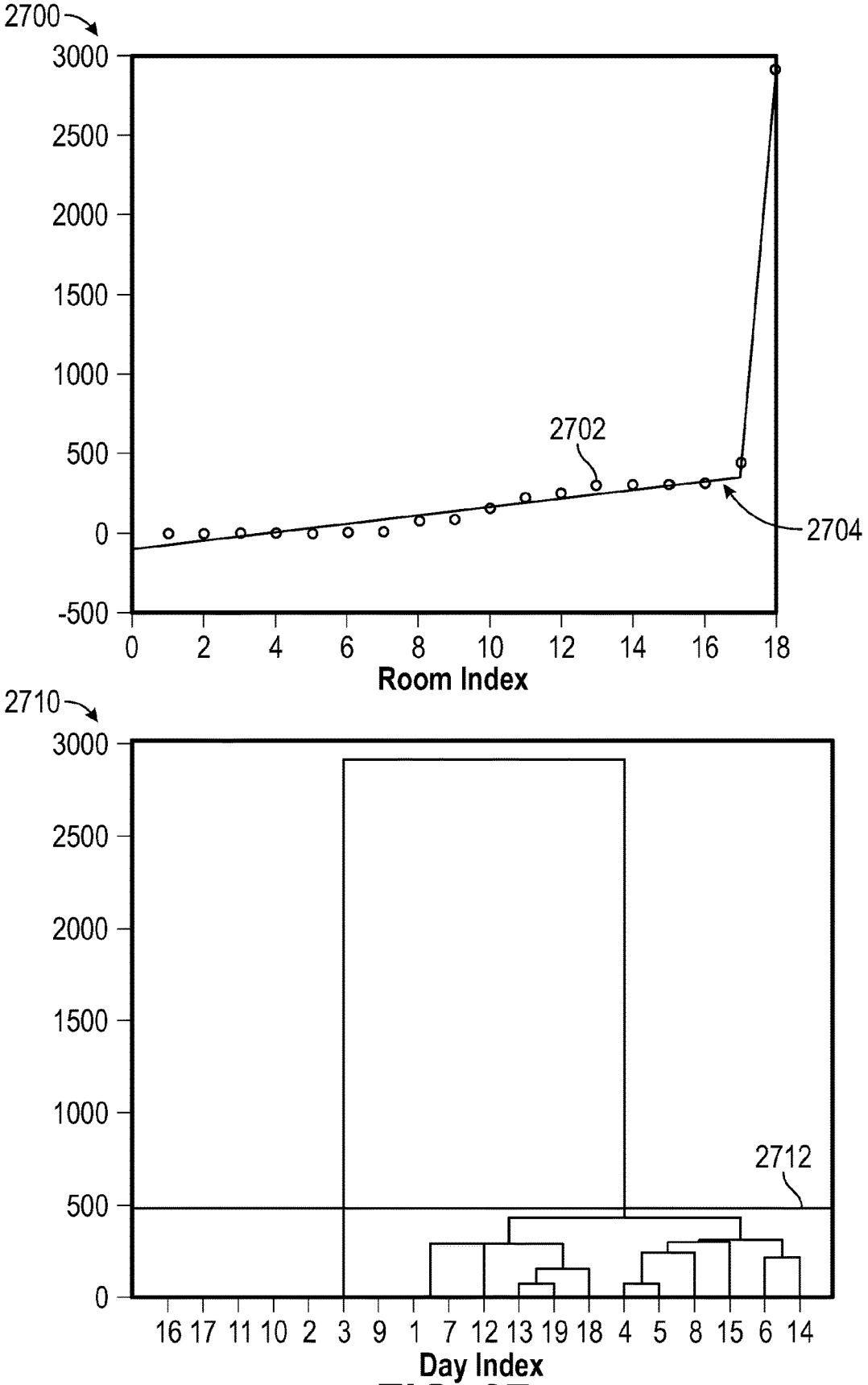
FIG. 27 depicts a graph of a cluster tree of weekly schedules, according to some embodiments.

Similar to above with respect to the clustering of group rooms with similar schedules the BMS controller 366 can further perform weekly schedule clustering by (3) using a piecewise regression model to find the knee point (or inflection point) of all the Euclidean distances, using the knee point as the threshold to separate clusters, and limiting the number of clusters. Additional details regarding step 3 of performing weekly schedule clustering are described above with reference to steps 3-5 of different room schedule clustering (FIGS. 20-26). For example, as shown with reference to FIG. 27, graph 2700 of the cluster tree of weekly schedules can be plotted that includes the piecewise regression data points 2702 and an identified inflection point 2704. The knee point threshold (schedule cluster separation threshold 2712) is used to cut the dendrogram plot at a certain level, to form clusters of weekly schedules of each room cluster (e.g., to obtain a weekly schedule). In the process described above, the first step is room clustering, which analyzes the schedule information for a specific testing period to calculate the distance between different rooms. Then, the weekly schedule clustering can be executed which occurs after room clustering and includes the analysis of daily information such as the start and end times of occupied periods and their duration. This information is then used to calculate the distance between different days and cluster the daily schedules. The result of this process is a weekday schedule that is derived from the clustered daily schedules. In general, the difference between room clustering and schedule clustering lies in the way in which the distances between the different elements are calculated. Room clustering calculates the distance between different rooms based on their schedules over the entire testing period, while schedule clustering calculates the distance between different days based on the start, end, and duration of each day's schedule. The dendrogram plot 2710 illustrating the clustering separation is shown in FIG. 27. Table 2800 of FIG. 28 depict the room clusters, where room cluster includes a weekly schedule for the plurality rooms of the cluster.

Accordingly, the clustering can occur on a room by room and schedule by schedule basis. For room clustering, it involves analyzing the schedule information for a specified testing period to determine the difference between various rooms. This information is used to calculate the distance between different rooms and cluster them based on their schedules over the entire testing period. For schedule clustering, which occurs after room clustering, it involves the analysis of daily information, such as the start and end times of occupied periods and their duration. This information can be used to calculate the distance between different days and cluster the daily schedules, leading to the development of a weekday schedule derived from the clustered daily schedules. The difference between room clustering and schedule clustering is the way in which the distances between different elements are calculated. Room clustering calculates the distances between different rooms based on their schedules over the entire testing period, while schedule clustering calculates the distances between different days based on the start, end, and duration of each day's schedule.

Furthermore, the process of finding the recommended weekly schedule for all rooms involves grouping all the rooms into clusters based on similarities in their occupied schedules, using single-linkage clustering and a knee point threshold (2704) to separate the clusters. For each cluster, the BMS controller 366 finds the three features: occupied time, end occupied time, and total occupied hours for every day. These features are used to calculate the Euclidean distance between each day within the same cluster. The BMS controller 366 then finds all the days that belong to the same day of the week, and the overall occupied schedule of that day of the week is calculated as the average of each day's schedule. The recommended schedule's start and end times are calculated to be around 15 minutes (or 30 minutes, or 1 hour). The recommended weekly schedule for all rooms is shown in table 2800, which is a summary of the occupied schedule for each day of the week for all the rooms in the same cluster.

Figure 29:
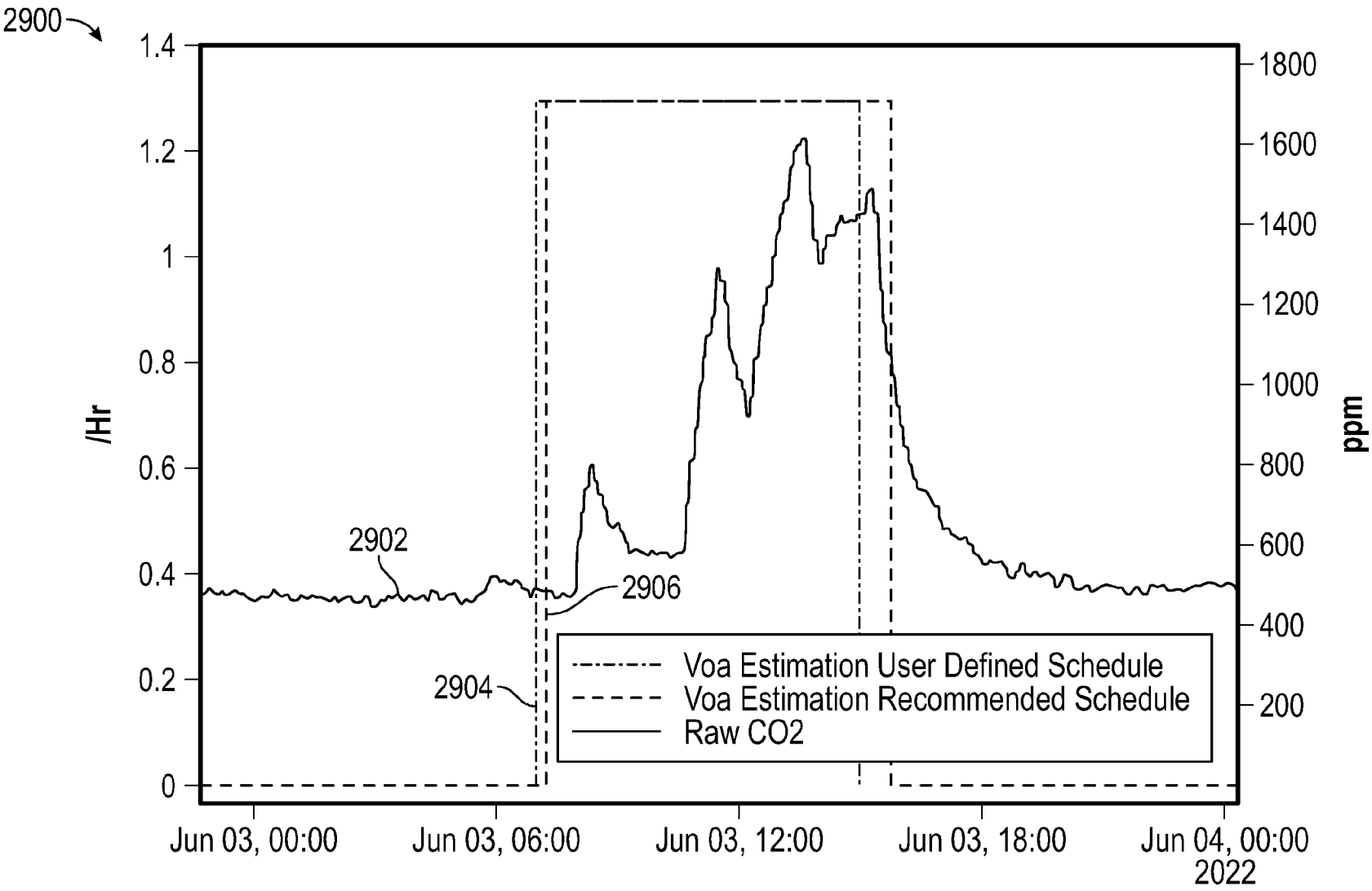
FIG. 29 depicts a difference in outdoor airflow rate between the user-defined schedule and the suggested schedule, according to some embodiments.

In some embodiments, the BMS controller 366 can further determine energy savings based on schedule recommendations and clustering. By selecting the user-defined schedule outdoor airflow rate and energy cost as the baseline, it allows for a comparison of the energy savings between the two schedules. Graph 2900 of FIG. 29 illustrates the difference in outdoor airflow rate between the user-defined schedule and the suggested schedule. Dotted line 2904 represents the outdoor airflow rate based on the user-defined schedule, which serves as the baseline. Dotted line 2906 represents the outdoor airflow rate based on the recommended schedule. Line 2902 represents the raw $CO_2$ level. As shown, the baseline outdoor airflow rate (2904) ends earlier than the $CO_2$ level goes down. This means that the outdoor airflow rate is not in sync with the changes in the $CO_2$ level. On the other hand, the recommended schedule (dotted line 2906) is better aligned with the changes in the $CO_2$ level, resulting in better IAQ and energy savings.

Figure 30:
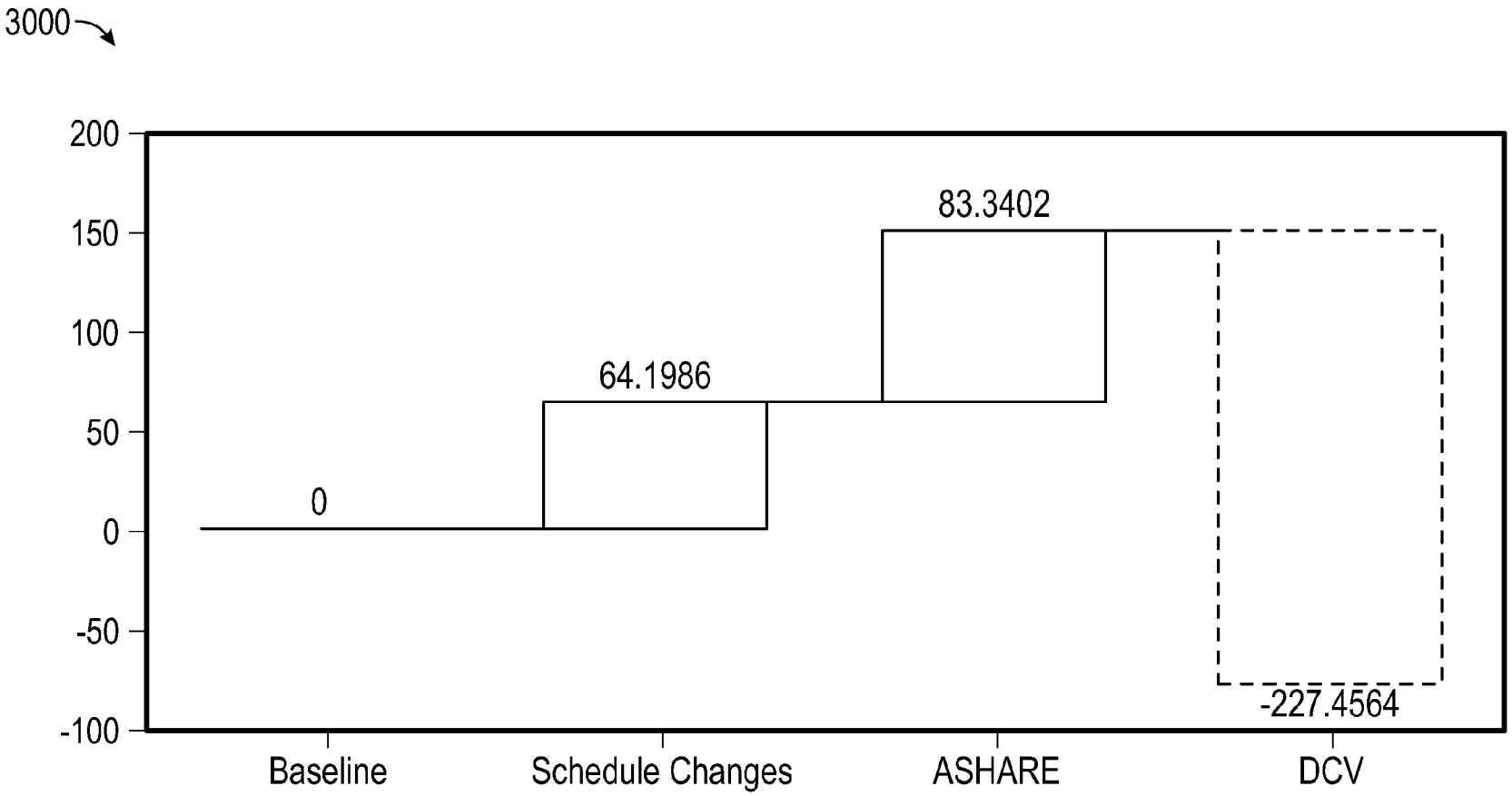
FIG. 30 depicts an example illustration of an energy savings graph, according to some embodiments.

Referring now to FIG. 30, an example illustration of an energy savings graph, according to some embodiments. In some embodiments, the energy savings can be recalculated based on the new schedule recommendation that was determined using the systems and methods describe above. The user-defined schedule outdoor airflow rate and energy cost are used as the baseline for comparison. In some embodiments, the recommended outdoor airflow rate values are the same as the baseline. FIG. 29 illustrates the difference in outdoor airflow rate between the user-defined schedule and the suggested schedule. The ASHRAE and DCV outdoor airflow rates are also recalculated based on the recommended schedule. From the energy savings calculations described above (e.g., Equations 10-16), the energy cost and savings can be determined. FIG. 30 is a waterfall chart 3000 that shows the energy savings across different ventilation control strategies. The baseline is the outdoor airflow rate based on the user-defined schedule. For example, changing the room schedules costs $64 dollars more than the baseline over the testing period (e.g., 15 days). Using the ASHRAE suggested outdoor airflow rate and the recommended schedule cost an additional $83 dollars, while using the demand-controlled ventilation (DCV) rate and the recommended schedule results in a savings of $227 dollars over the testing period (e.g., including the room and weekly schedule clustering).

In some embodiments, the outdoor airflow rate of a given zone can be categorized based on whether it is under-ventilated, meeting ASHRAE standards, or over-ventilated. The air quality is considered bad when the zone is under-ventilated (categorized as a red level), good when it meets ASHRAE standards (categorized as a green level), and potentially too fresh when it is over-ventilated (categorized as a yellow level). To categorize the outdoor airflow rate, the BMS controller 366 checks for the number of days that the schedule is more or less than the detected occupied hours and compares it to the ASHRAE suggested outdoor airflow rate. In some embodiments, zone is considered under-ventilated (red level) if there are more than two days that the schedule is one hour less than the detected occupied hours and the upper bound of the outdoor airflow rate is smaller than the ASHRAE suggested outdoor airflow rate. Conversely, a zone is considered over-ventilated (yellow level) if there are more than two days that the schedule is one hour more than the detected occupied hours and the lower bound of the outdoor airflow rate is greater than the ASHRAE suggested outdoor airflow rate. If a zone is not either under- or over-ventilated, it is considered to meet ASHRAE standards (green level).

Figure 31:
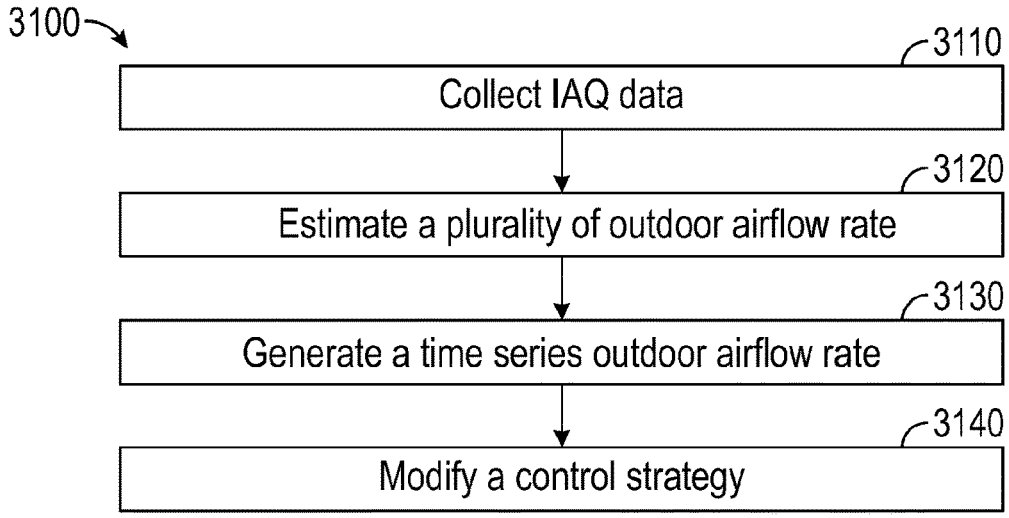
FIG. 31 depicts a flowchart for a method for controlling building equipment based on executing an IAQ ventilation analysis of a building, according to some embodiments.

Referring now to FIG. 31, a flowchart for a method 3100 for controlling building equipment based on an indoor air quality (IAQ) ventilation analysis of a building 10 is shown, according to some embodiments. BMS controller 366 can be configured to perform method 3100. Further, any computing device described herein can be configured to perform method 3100.

In broad overview of method 3100, at block 3110, the one or more processing circuits (e.g., BMS controller 366 in FIGS. 3 and 4) can collect IAQ data over a given time period. At block 3120, the one or more processing circuits can estimate a plurality of outdoor airflow rates. At block 3130, the one or more processing circuits can generate a time series outdoor airflow rate. At block 3140, the one or more processing circuits can modify a control strategy. Additional, fewer, or different operations may be performed depending on the particular arrangement. In some embodiments, some, or all operations of method 3100 may be performed by one or more processors executing on one or more computing devices, systems, or servers. In various embodiments, each operation may be re-ordered, added, removed, or repeated. Additionally, it is understood a future state can be a real-time state of the HVAC equipment (e.g., when a control strategy changes, the HVAC equipment changes to operate according to the control strategy) or a state in which the HVAC equipment will be operating in at a future time (e.g., according to a schedule).

At block 3110, the one or more processing circuits can collect IAQ data from one or more sensors within the building over a given time period. The data collection may be continuous, at periodic intervals, or otherwise timed to gather data over a duration of the time period. The sensors can include $CO_2$ sensors, temperature sensors, humidity sensors, and others that measure the various factors that contribute to overall air quality. The data from these sensors is then collected and processed by the one or more processing circuits. This allows for real-time monitoring of IAQ and the ability to quickly detect and respond to any changes or issues that may arise. Additionally, this data collection also allows for the analysis of long-term trends in IAQ, which can be used to identify patterns and make data-driven decisions to improve air quality in the building. In some embodiments, the area is an HVAC zone of the building, and wherein the IAQ data includes at least indoor $CO_2$ concentrations and outdoor $CO_2$ concentrations.

At block 3120, the one or more processing circuits can estimate a plurality of outdoor airflow rates for an area of the building during a plurality of transient periods using the IAQ data as input. In some embodiments, the outdoor airflow rate can be estimated and the transient periods can be determined based on Equations 1-5, as discussed above. In some embodiments, determining a transient period of the plurality of transient periods can be based on analyzing the IAQ data and identifying at least one of (1) a period of time longer than a minimum length of time (2) a peek-to-peek concentration change greater than a minimum peek-to-peek concentration change, (3) a decay rate greater than a minimum decay rate, and (4) a derivative peek in the first half of the period of time. In particular, determining a transient period within the plurality of transient periods can involve an analysis of the IAQ data collected by the one or more sensors within the building. This analysis can involve identifying certain characteristics of the data that indicate a transient period has occurred. For example, the analysis may involve identifying a period of time that is longer than a minimum length of time. This minimum length of time can be determined based on the specific application and the expected duration of transient events. Additionally, the analysis can involve identifying a peek-to-peek concentration change that is greater than a minimum peek-to-peek concentration change. This minimum peek-to-peek concentration change can be determined based on the specific application and the expected magnitude of transient events. Furthermore, the analysis can involve identifying a decay rate that is greater than a minimum decay rate. This minimum decay rate can be determined based on the specific application and the expected decay rate of transient events. Finally, the analysis can involve identifying a derivative peek in the first half of the period of time. This derivative peek can be used as an indication that a transient event has occurred. All these criteria combined can help to identify the transient period more accurately.

In some embodiments, determining the transient period is further based on detecting, from the one or more sensors, at least one occupant previously entered or previously left one or more areas of the building based on the collected IAQ data. Estimating an outdoor airflow rate can include analyzing a relationship between each of a plurality of possible outdoor airflow rates and a corresponding regression error of a plurality of regression errors of the regression model and selecting a possible outdoor airflow rate of the plurality of possible outdoor airflow rates as the estimated outdoor airflow rate for the transient period based on identifying a minimum regression error of the relationship. In some embodiments, the process of determining a transient period within the building's IAQ data is further based on detecting the presence or absence of occupants within one or more areas of the building. This is done by continuously collecting IAQ data from one or more sensors within the building and analyzing it to identify changes in concentration levels (e.g., $CO_2$ that correspond to the movement of people within the building. The process of determining the transient period includes identifying specific characteristics of the changes in concentration levels, such as a period of time that is longer than a minimum length, a peek-to-peek concentration change greater than a certain minimum change, a decay rate that is greater than a certain minimum rate, and a derivative peek in the first half of the period of time.

Once the transient period has been identified, the process of estimating the outdoor airflow rate for that period involves analyzing the relationship between different possible outdoor airflow rates and the corresponding regression errors of a regression model (which is estimated and analyzed above with reference to Equations 1-5). The regression model is used to predict the changes in concentration levels based on different possible outdoor airflow rates. By identifying the minimum regression error of the relationship between the possible outdoor airflow rates and the regression errors, the estimated outdoor airflow rate for the transient period can be selected. This estimated outdoor airflow rate can be used to improve energy efficiency and indoor air quality by adjusting the ventilation system to match the actual occupancy and ventilation needs of the building. In some embodiments, in response to the estimated outdoor airflow rate including an uncertainty above an uncertainty threshold, select a default outdoor airflow rate as the estimated outdoor airflow rate for the transient period. In particular, a high uncertainty with relation to the outdoor airflow rate would mean that it could be difficult to determine whether the outdoor airflow rate is under, meeting, or over one or more standards (e.g., ASHRAE). This could be due to a lack of clear data or conflicting IAQ data or other information, making it difficult to accurately estimate the outdoor airflow rate in the given zone.

At block 3130, the one or more processing circuits can generate a time series outdoor airflow rate comprising the plurality of estimated outdoor airflow rates. In general, the one or more processing circuits can take the estimated outdoor airflow rates for each of the transient periods and arrange them in a chronological order based on the time that the transient periods occurred. This creates a time series of the outdoor airflow rates, which can then be compared to the ventilation schedule that was input by the user or determined by the system. This comparison allows the system to identify any deviations or discrepancies between the actual outdoor airflow rates and the desired ventilation schedule. The time series outdoor airflow rate can be used to identify patterns and trends in the outdoor airflow rates over time, which can be used to make adjustments to the ventilation schedule to improve energy efficiency or IAQ. Additionally, the time series outdoor airflow rate can be used to detect any unexpected changes or anomalies in the outdoor airflow rates, which can be used to trigger alarms or notifications to alert the building's occupants or maintenance personnel.

In some embodiments, each data point indexed in time order of the time series outdoor airflow rate varies based on the IAQ data at a time in the time series outdoor airflow rate. In particular, the time series outdoor airflow rate is a representation of the outdoor airflow rate of the building over a certain period of time. Each data point in this time series is indexed in time order and corresponds to a specific time in the time series. The value of each data point in the time series outdoor airflow rate varies based on the IAQ data collected by the one or more sensors at that specific time. In other words, the time series outdoor airflow rate is a record of how the outdoor airflow rate changes over time, and these changes are directly linked to the IAQ data that is collected by the sensors at each point in time. This time series outdoor airflow rate can be used to analyze the overall ventilation performance of the building, identify any patterns or trends in the outdoor airflow rate, and make adjustments to the ventilation schedule. The one or more processing circuits can use the time series outdoor airflow rate, along with the IAQ data, to calculate a time series particle disturbance. This calculation is based on the relationship between the outdoor airflow rate and the particle concentration in the area of the building. An increase in a portion of the time series particle disturbance indicates an increase in the occupancy of the area, as more particles are being generated by the occupants. To better understand this relationship, the processing circuits can also use an occupancy dataset which contains information about the ages and metabolic rates of the occupants. The occupancy estimate and particle generation rate can be back-calculated based on this information. The back-calculation process takes into account the occupancy and metabolic rate of occupants, which affect the particle generation rate in the building. This information can be used to understand how the outdoor airflow rate affects the particle concentration and how it can be optimized to improve IAQ.

At block 3140, the one or more processing circuits can modify a control strategy for the area of the building based on the time series outdoor airflow rate and a ventilation schedule for the area of the building. In some embodiments, one or more instructions generated by the processing circuits are used to implement a control strategy that adjusts at least one control of the HVAC equipment. The control strategy is based on the time series outdoor airflow rate, which can be maintained during the ventilation schedule. The BMS uses the time series outdoor airflow rate to adjust the HVAC equipment, for example, by adjusting the airflow rate, temperature, and humidity, to ensure that the building's IAQ meets the desired standards. This includes maintaining the desired outdoor airflow rate, which is calculated using the IAQ data and occupancy estimates. The BMS continuously monitors the IAQ data, and adjusts the HVAC equipment in real-time to ensure that the ventilation schedule is followed, and the building's IAQ is maintained.

In some embodiments, the one or more processing circuits can use machine learning algorithms. The machine learning algorithms can be trained to predict occupancy based on historical IAQ data. In some embodiments, the one or more processing circuits can also use can use a combination of methods such as occupancy sensors and IAQ data to estimate occupancy. For example, the BMS can use occupancy sensors to detect the presence of occupants, and then use IAQ data to estimate the number of occupants in the area. In some embodiments, the one or more processing circuits can use predictive maintenance. In some embodiments, the one or more processing circuits can integrate data from other building systems such as lighting, security, and access control systems to optimize the HVAC controls and improve IAQ. For example, the BMS can use data from lighting systems to determine the occupancy of a space and adjust the ventilation accordingly.

In some embodiments, the one or more processors can determine an area occupancy schedule based on executing an occupancy schedule model, wherein the area occupancy schedule includes a plurality of occupied periods, and modifies the control strategy for the area of the building based on the area occupancy schedule. The one or more processors can be programmed to use a specific model to determine the schedule of when an area of the building is occupied, and based on this information, can modify the control strategy of the HVAC equipment in that specific area. This can include adjusting the temperature, outdoor airflow rate, or other settings of the HVAC equipment to better align with the occupancy schedule of the area. For example, if the area is unoccupied for a prolonged period of time, the HVAC equipment in that area can be turned off or set to a lower energy consumption mode to save energy. On the other hand, if the area is frequently occupied during certain times of the day, the HVAC equipment can be set to a higher energy consumption mode to ensure the comfort of the occupants.

In some embodiments, the one or more processors can execute the occupancy schedule model by (1) determining a time series $CO_2$ disturbance based on the time series outdoor airflow rate and the IAQ data, (2) filtering the time series $CO_2$ disturbance to generate a filtered time series $CO_2$ disturbance, (3) calculating a first derivative of the filtered time series $CO_2$ disturbance, (4) calculating a daily $CO_2$ disturbance range of the filtered time series $CO_2$ disturbance to determine one or more outlier days, (5) determining a first data point of the filtered time series $CO_2$ disturbance and a second data point of the filtered first derivative time series $CO_2$ disturbance, wherein the first data point of the filtered time series $CO_2$ disturbance is a $CO_2$ disturbance threshold, and wherein the second data point of the filtered first derivative time series $CO_2$ disturbance is a first derivative $CO_2$ disturbance threshold, wherein determining the first data point and the second data point is based on executing the regression model excluding the one or more outlier days, (6) identifying, using the filtered time series $CO_2$ disturbance, a first occupied time range for a day, the first occupied time range for the day includes a first start time from the filtered time series $CO_2$ disturbance that is greater than the $CO_2$ disturbance threshold and a first end time from the filtered time series $CO_2$ disturbance that is less than the $CO_2$ disturbance threshold, wherein the first end time is after the first start time, (7) identifying, using the filtered first derivative time series $CO_2$ disturbance, a second occupied time range for the day, the second occupied time range for the day includes a second start time from the filtered first derivative time series $CO_2$ disturbance that is greater than the first derivative $CO_2$ disturbance threshold and a second end time from the filtered first derivative time series $CO_2$ disturbance that is less than the first derivative $CO_2$ disturbance threshold, wherein the second end time is after the second start time, (8) combining the first occupied time range and the second occupied time range for the day based on overlapping occupied time ranges to create the area occupancy schedule, and (90 updating the ventilation schedule based on the combined occupied time ranges.

In some embodiments, determining a time series $CO_2$ disturbance based on the time series outdoor airflow rate and the IAQ data can be executed by analyzing the $CO_2$ concentrations within the area and determining the changes in concentration over time. In some embodiments, filtering the time series $CO_2$ disturbance to generate a filtered time series $CO_2$ disturbance eliminates any noise or irregular data points to determine the occupancy schedule more accurately. In some embodiment, calculating a first derivative of the filtered time series $CO_2$ disturbance enables the one or more processing circuits identify any changes in the rate of change of the $CO_2$ concentrations, which can indicate an occupied period. In some embodiments, outlier days are days that have an abnormal $CO_2$ disturbance range, which can indicate an error in the data. In some embodiments, determining a first data point and a second data point is completed by executing a regression model to identify the $CO_2$ disturbance threshold and the first derivative $CO_2$ disturbance threshold, which will be used to identify occupied periods. In some embodiments, identifying, using the filtered time series $CO_2$ disturbance, a first occupied time range for a day is completed by analyzing a period where the $CO_2$ concentrations are above the $CO_2$ disturbance threshold and below the threshold. In some embodiments, identifying a second occupied time range for the day is completed by analyzing for a period where the rate of change in $CO_2$ concentrations is above the first derivative $CO_2$ disturbance threshold and below the threshold. In some embodiments, updating the ventilation schedule ensures that the HVAC equipment is operating based on the determined occupancy schedule, increasing energy efficiency and improving air quality.

In some embodiments, the one or more processors can cluster a plurality of area occupancy schedules that includes the area occupancy schedule based on a plurality of clustering indexes, wherein the plurality of clustering indexes are determined based on (1) calculating a plurality of similar disturbances between the plurality of area occupancy schedules, (2) plotting the plurality of similar disturbances based on applying hierarchical clustering to the calculated plurality of similar disturbances, (3) determining a third data point of the plotted plurality of similar disturbances based on executing the regression model, wherein the third data point of the plotted plurality of similar disturbances is an area cluster separation threshold, (4) clustering each of the plurality of area occupancy schedules into one of the plurality of clustering indexes based on the area cluster separation threshold, and (5) in response to a number of the plurality of clustering indexes being above a scheduling threshold, re-clustering each of plurality of area occupancy schedules into one of the plurality of clustering indexes based on a maximum area cluster separation threshold.

In general, the one or more processors can use a method of clustering to group a plurality of area occupancy schedules that includes the area occupancy schedule generated earlier. This clustering process is based on a plurality of clustering indexes that are determined by analyzing similarity between the different area occupancy schedules. The first step in this process is to calculate a plurality of similar disturbances between the different area occupancy schedules. This is done by comparing the different schedules and identifying the similarities and differences between them. Next, the calculated similar disturbances are plotted using a hierarchical clustering method. Hierarchical clustering is a method of grouping similar data points together based on their similarity. The plotted similar disturbances are used to create a dendrogram, which is a tree-like diagram that shows the different clusters and the relationships between them. The next step is to determine a third data point of the plotted similar disturbances, which is referred to as the area cluster separation threshold. This threshold is determined by executing a regression model on the plotted similar disturbances. The regression model is used to identify the point at which the different clusters start to separate. Based on the area cluster separation threshold, each of the area occupancy schedules is then clustered into one of the plurality of clustering indexes. Each schedule is assigned to a cluster based on how closely it matches the schedules in that cluster. In some embodiments, if the number of clusters is above a scheduling threshold, the process is repeated using a maximum area cluster separation threshold. This ensures that the number of clusters is manageable and suitable for scheduling purposes. The re-clustered schedules are then used for further analysis and recommendations for scheduling.

In some embodiments, the one or more processors can determine a weekly schedule of each of the clustered plurality of area occupancy schedules for each of the plurality of clustering indexes, wherein the weekly schedule is determined based on (1) calculating each distance of a plurality of distances between each day of the clustered plurality of area occupancy schedules for one of the plurality of clustering indexes, (2) plotting the plurality of distances based on applying the hierarchical clustering to the calculated plurality of distances, (3) determining a fourth data point of the plotted plurality of distances based on executing the regression model, wherein the fourth data point of the plotted plurality of distances is a schedule cluster separation threshold, and (5) clustering each of the clustered plurality of area occupancy schedules into one of a plurality of schedule clustering indexes based on the schedule cluster separation threshold, and (6) modifying the control strategy for a plurality of areas of the building based on the clustered plurality of area occupancy schedules and the plurality of schedule clustering indexes.

In general, the one or more processors in the HVAC system are configured to determine a weekly schedule for each of the clustered area occupancy schedules, by calculating the distances between each day of the area occupancy schedule and then applying hierarchical clustering to the calculated distances. This generates a schedule cluster separation threshold, which is then used to cluster each of the area occupancy schedules into a schedule clustering index. Once the weekly schedule is determined, the system modifies the control strategy for different areas of the building based on the clustered area occupancy schedules and the schedule clustering indexes. This allows for more precise and efficient control of the HVAC system, leading to potential energy savings, improved air quality and better control of occupancy schedules.

In some embodiments, the processing circuit can identify zones within a building that may require attention or adjustments to improve indoor air quality (IAQ) and/or ventilation efficiency. One way to identify these zones is by conducting a peer analysis on IAQ data collected from various sensors in the building. This data can include various parameters such as $CO_2$ levels, temperature, humidity, volatile organic compounds (VOCs), particulate matter (e.g., PM2.5) and others. By comparing the data from different zones, it is possible to identify zones that have IAQ levels or outdoor airflow rates that deviate significantly from the average or other benchmark values.

Once the zones that require attention have been identified, the next step may be to perform rebalancing of the ventilation system to improve its efficiency. This can be done by adjusting the outdoor airflow rate, temperature, and humidity settings in these zones to optimize their performance. The features described above such as determining transient period, estimating outdoor airflow rate, generating time series outdoor airflow rate, updating the control strategy of HVAC equipment and others may be used to perform the rebalancing. This can help to improve the overall IAQ of the building and reduce energy consumption.

Figure 32:
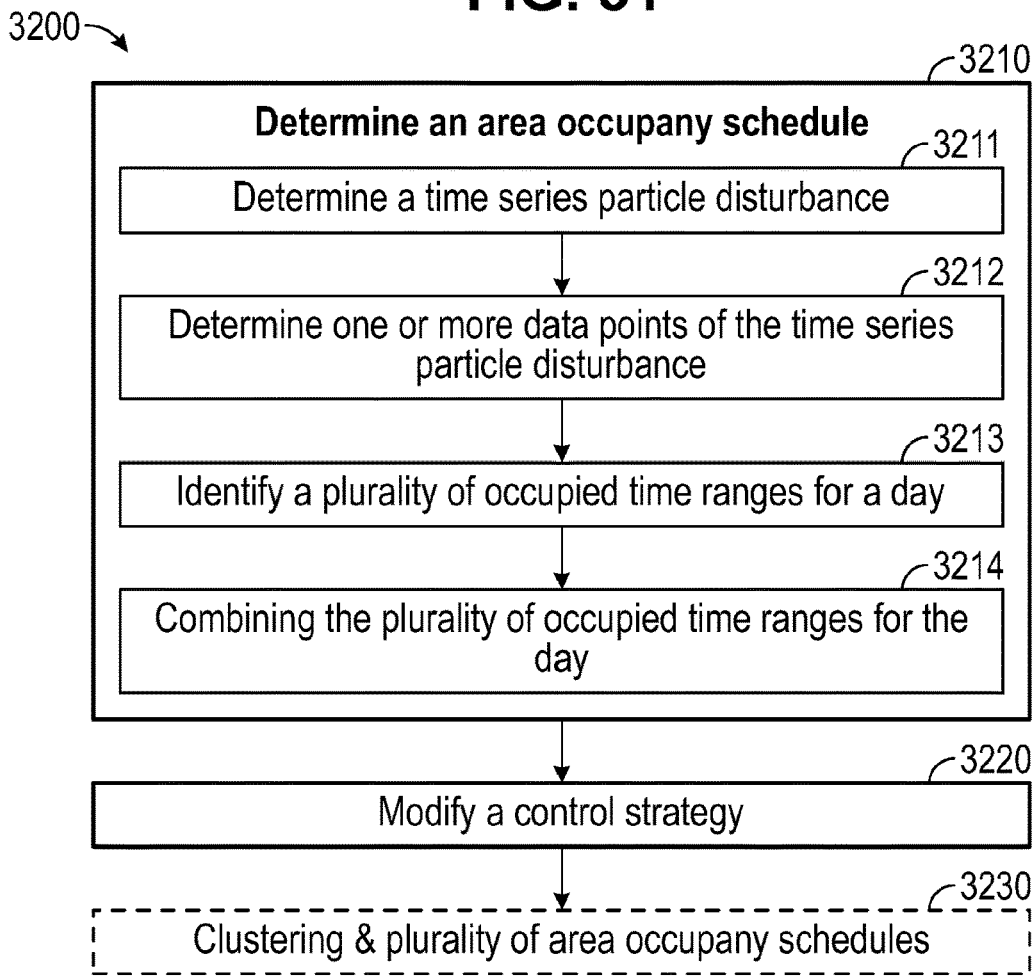
FIG. 32 depicts a flowchart for a method for controlling building equipment based on executing an IAQ ventilation analysis of a building, according to some embodiments.

Referring now to FIG. 32, a flowchart for a method 3200 for controlling building equipment based on an indoor air quality (IAQ) ventilation analysis of a building 10 is shown, according to some embodiments. BMS controller 366 can be configured to perform method 3200. Further, any computing device described herein can be configured to perform method 3200.

In broad overview of method 3200, at block 3210, the one or more processing circuits (e.g., BMS controller 366 in FIGS. 3 and 4) can determine a time series particle disturbance. At block 3220, the one or more processing circuits can modify a control strategy. At block 3230, the one or more processing circuits can cluster a plurality of area occupancy schedules. Additional, fewer, or different operations may be performed depending on the particular arrangement. In some embodiments, some, or all operations of method 3200 may be performed by one or more processors executing on one or more computing devices, systems, or servers. In various embodiments, each operation may be re-ordered, added, removed, or repeated. In some arrangements blocks can be optionally executed (e.g., blocks depicted as dotted lines) by the one or more processors.

At block 3210, the one or more processing circuits can determine an area occupancy schedule based on executing an occupancy schedule model, wherein the area occupancy schedule includes a plurality of occupied periods. In general, executing the occupancy schedule model includes (1) determining, by the processing circuit, a time series particle disturbance based on a time series outdoor airflow rate and IAQ data, (2) determining, by the processing circuit, one or more data points of the time series particle disturbance, wherein each of the one or more data points is a particle disturbance threshold, wherein determining the one or more data points is based on executing a regression model, (3) identifying, by the processing circuit using the time series particle disturbance, a plurality of occupied time ranges for a day, wherein each of the plurality of occupied time ranges includes a start time from that is greater than the particle disturbance threshold and an end time from that is less than the particle disturbance threshold, and (4) combining, by the processing circuit, the plurality of occupied time ranges for the day based on overlapping occupied time ranges to create the area occupancy schedule.

In some embodiments, the one or more processing circuits determine an area occupancy schedule by executing an occupancy schedule model. This model involves analyzing the IAQ data and determining a time series particle disturbance, which is a representation of the changes in particle concentration over time. The processing circuit then identifies certain data points in the time series particle disturbance, which are called particle disturbance thresholds. These thresholds are determined by executing a regression model on the time series particle disturbance data. In some embodiments, once the thresholds are identified, the processing circuit uses the time series particle disturbance data to identify periods of time when the particle concentration is above the threshold, indicating that the area is occupied. These periods of time are called occupied time ranges. The processing circuit then combines these occupied time ranges for each day based on overlapping periods, to create the area occupancy schedule. This schedule represents the times when the area is occupied over a period of time, and can be used to inform building control strategies such as adjusting outdoor airflow rates or turning lights on or off.

At block 3220, the one or more processing circuits can modify a control strategy for an area of the building based on the area occupancy schedule. Once the occupancy schedule model has been executed and an area occupancy schedule has been determined, the processing circuit can then modify the control strategy for the corresponding area of the building. These modifications may include adjusting various settings or parameters of the HVAC equipment such as outdoor airflow rate, temperature, humidity, etc., based on the determined occupied periods. The modifications may also include adjusting the operation of other building systems such as lighting and blinds, to ensure that they are in sync with the occupancy schedule. In some embodiments, the objective of these modifications is to ensure that the HVAC and other systems are operating in an energy-efficient and cost-effective manner, while also providing a comfortable and healthy indoor environment for the occupants. Additionally, the modifications may also include monitoring the performance of the HVAC equipment and making adjustments to ensure that the desired IAQ is maintained over time.

At block 3230, the one or more processing circuits can cluster a plurality of area occupancy schedules that includes the area occupancy schedule based on a plurality of clustering indexes. In general, the plurality of clustering indexes are determined based on (1) calculating, by the processing circuit, a plurality of similar disturbances between the plurality of area occupancy schedules, (2) plotting, by the processing circuit, the plurality of similar disturbances based on applying hierarchical clustering to the calculated plurality of similar disturbances, (3) determining, by the processing circuit, a third data point of the plotted plurality of similar disturbances based on executing the regression model, wherein the third data point of the plotted plurality of similar disturbances is an area cluster separation threshold, (4) clustering, by the processing circuit, each of the plurality of area occupancy schedules into one of the plurality of clustering indexes based on the area cluster separation threshold, and (5) in response to a number of the plurality of clustering indexes being above a scheduling threshold, re-clustering, by the processing circuit, each of plurality of area occupancy schedules into one of the plurality of clustering indexes based on a maximum area cluster separation threshold.

In some embodiments, the one or more processing circuits use clustering techniques to group similar area occupancy schedules together. The clustering is done by first calculating the similarity between different schedules by comparing the disturbances in each schedule. This is done by calculating at least one of (1) a hamming distance, (2) a $CO_2$ correlation, (3) a cosine similarity, or (4) a tanimoto coefficient between the area occupancy schedule and at least another area occupancy schedule. The similarity between different schedules is then plotted using hierarchical clustering techniques, which creates a cluster tree. A knee point is then determined from the plotted data using a regression model, which serves as the area cluster separation threshold. Each schedule is then grouped into one of the clustering indexes based on this threshold. However, in some embodiments, if the number of clusters exceeds a certain threshold, the schedules are re-clustered based on a maximum area cluster separation threshold. This is done to ensure that the number of clusters is manageable and the schedules are not too different from each other. The generated clusters are then used to modify the control strategy for the area of the building by adjusting the HVAC equipment based on the cluster they belong to.

In some embodiments, the one or more processing circuits can determine a weekly schedule of each of the clustered plurality of area occupancy schedules for each of the plurality of clustering indexes, wherein the weekly schedule is determined based on (1) calculating, by the processing circuit, each distance of a plurality of distances between each day of the clustered plurality of area occupancy schedules for one of the plurality of clustering indexes, (2) plotting, by the processing circuit, the plurality of distances based on applying the hierarchical clustering to the calculated plurality of distances, (3) determining, by the processing circuit, a fourth data point of the plotted plurality of distances based on executing the regression model, wherein the fourth data point of the plotted plurality of distances is a schedule cluster separation threshold, (4) clustering, by the processing circuit, each of the clustered plurality of area occupancy schedules into one of a plurality of schedule clustering indexes based on the schedule cluster separation threshold, and (5) modifying, by the processing circuit, the control strategy for a plurality of areas of the building based on the clustered plurality of area occupancy schedules and the plurality of room clustering indexes.

In some embodiments, the one or more processing circuits determine a weekly schedule of each of the clustered plurality of area occupancy schedules for each of the plurality of clustering indexes. This is done by first calculating each distance of a plurality of distances between each day of the clustered plurality of area occupancy schedules for one of the plurality of clustering indexes. These calculated distances are then plotted using hierarchical clustering. The processing circuit then determines a fourth data point of the plotted plurality of distances based on executing the regression model. This fourth data point is known as the schedule cluster separation threshold. Using this threshold, the processing circuit clusters, each of the clustered plurality of area occupancy schedules into one of a plurality of schedule clustering indexes. Finally, the processing circuit modifies the control strategy for a plurality of areas of the building based on the clustered plurality of area occupancy schedules and the plurality of room clustering indexes. This new schedule allows for more energy efficiency and better air quality management.

Figure 33:
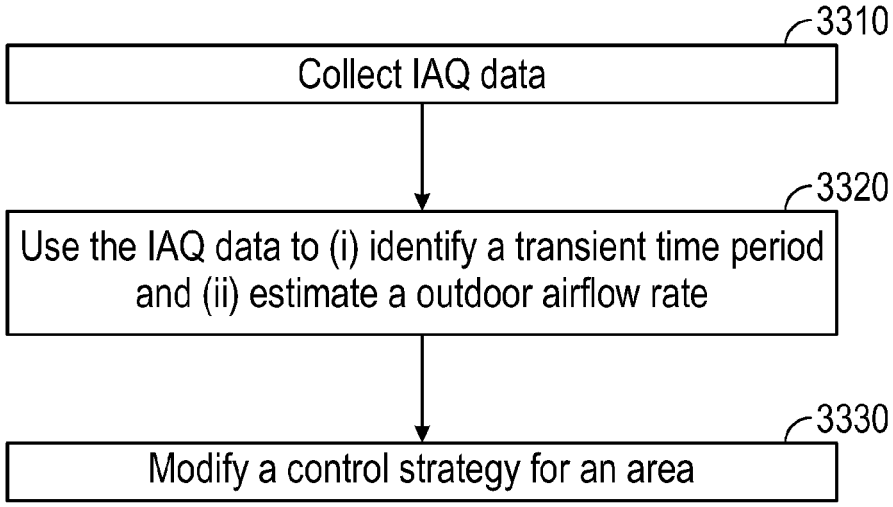
FIG. 33 depicts a flowchart for a method for controlling building equipment based on executing an IAQ ventilation analysis of a building, according to some embodiments.

Referring now to FIG. 33, a flowchart for a method 3300 for controlling building equipment based on an indoor air quality (IAQ) ventilation analysis of a building 10 is shown, according to some embodiments. BMS controller 366 can be configured to perform method 3300. Further, any computing device described herein can be configured to perform method 3300.

In broad overview of method 3300, at block 3310, the one or more processing circuits (e.g., BMS controller 366 in FIGS. 3 and 4) can collect IAQ data. At block 3320, the one or more processing circuits can use the IAQ data to (i) identify a transient time period and (ii) estimate an outdoor airflow rate. At block 3330, the one or more processing circuits can modify a control strategy. Additional, fewer, or different operations may be performed depending on the particular arrangement. In some embodiments, some, or all operations of method 3300 may be performed by one or more processors executing on one or more computing devices, systems, or servers. In various embodiments, each operation may be re-ordered, added, removed, or repeated. In some arrangements blocks can be optionally executed (e.g., blocks depicted as dotted lines) by the one or more processors. Method 3300 includes similar features and functionality as described in detail with reference to method 3100.

At block 3310, the one or more processing circuits can collect IAQ data from one or more sensors within the building. Block 3310 includes similar features and functionality as described in detail with reference to block 3110 of FIG. 31. In some embodiments, the sensors can measure different aspects of the IAQ such as temperature, humidity, $CO_2$ levels, volatile organic compounds (VOCs), particulate matter (e.g., PM2.5), and other data. The collected IAQ data can be used to monitor the overall air quality within the building and identify any potential issues that may arise. The collected data can be received, sent, or collected by the processing circuits for analysis and further action. The sensors can be placed in various locations such as in the HVAC system, in rooms or areas of the building, or in other locations that may be deemed necessary to monitor the indoor air quality.

At block 3320, the one or more processing circuits can use the IAQ data to (i) identify a transient time period and (ii) estimate an outdoor airflow rate for an area of the building during the transient time period. Block 3320 includes similar features and functionality as described in detail with reference to blocks 3120 and 3130 of FIG. 31. The processing circuit can use various algorithms, such as statistical analysis or machine learning, to identify the transient time periods by analyzing patterns and changes in the IAQ data (described above with reference to Equations 1-5). In some embodiments, once the transient time period has been identified, the processing circuit can then use the IAQ data to estimate an outdoor airflow rate for the area of the building during that transient time period. This can be done by analyzing the IAQ data to determine the concentration of various pollutants, such as $CO_2$, temperature, humidity, volatile organic compounds, and particulate matter, and comparing them to established standards and guidelines for IAQ. Based on the IAQ data, the processing circuit can estimate the outdoor airflow rate for maintaining healthy and comfortable air quality, improving energy consumption, etc. in the area of the building during the transient time period. In some embodiments, the estimation of the outdoor airflow rate can be done by using various model, such as linear regression, non-linear regression, or neural network (described above)

At block 3300, the one or more processing circuits can modify a control strategy for the area of the building in response to detecting a deviation between (i) the outdoor airflow rate estimated using the IAQ data and (ii) a ventilation schedule for the area of the building. Block 3330 includes similar features and functionality as described in detail with reference to blocks 3140 of FIG. 31. At block 3300, the one or more processing circuits can use the IAQ data collected at block 3310 to identify a deviation between the estimated outdoor airflow rate for an area of the building during a transient time period, as determined at block 3320, and the ventilation schedule for that area of the building. In response to detecting this deviation, the processing circuits can then modify the control strategy for the area of the building. In some embodiments, this may include adjusting the outdoor airflow rate, scheduling, or HVAC equipment operations to bring the estimated outdoor airflow rate closer to or equal to the scheduled outdoor airflow rate and ensure optimal indoor air quality. The specific actions taken to modify the control strategy may vary depending on the deviation detected, the area of the building, and other factors.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A building management system (BMS) for controlling building equipment based on an indoor air quality (IAQ) ventilation analysis of a building, the BMS comprising:

a controller comprising memory and one or more processors configured to:

collect IAQ data from one or more sensors within the building;

determine a transient period of a plurality of transient periods based on analyzing the IAQ data and identifying at least one of (1) a period of time longer than a minimum length of time (2) a peak-to-peak concentration change greater than a minimum peak-to-peak concentration change, (3) a decay rate greater than a minimum decay rate, and (4) a derivative peak in a first half of the period of time;

estimate a plurality of actual outdoor airflow rates for an area of the building during the plurality of transient periods using the IAQ data as input;

generate a time series actual outdoor airflow rate comprising the plurality of actual outdoor airflow rates estimated using the IAQ data; and modify a control strategy for the area of the building by operating HVAC equipment to control the time series actual outdoor airflow rate in accordance with a ventilation schedule for the area of the building.

2. The BMS of claim 1, wherein determining the transient period is further based on detecting, from the one or more sensors, at least one occupant previously entered or previously left one or more areas of the building based on the collected IAQ data.

3. The BMS of claim 1, the one or more processors further configured to:

determine an actual outdoor airflow rate of the plurality of actual outdoor airflow rates during the transient period based on:

analyzing a relationship between each of a plurality of possible outdoor airflow rates and a corresponding regression error of a plurality of regression errors of a regression model; and selecting a possible outdoor airflow rate of the plurality of possible outdoor airflow rates as the actual outdoor airflow rate for the transient period based on identifying a minimum regression error of the relationship.

4. The BMS of claim 3, the one or more processors further configured to:

in response to the actual outdoor airflow rate comprising an uncertainty above an uncertainty threshold, select a default outdoor airflow rate as the actual outdoor airflow rate for the transient period.

5. The BMS of claim 4, wherein the uncertainty is calculated based on:

defining an objective function based on mapping the plurality of actual outdoor airflow rates to a scaler value;

minimizing the objective function based on determining an outdoor airflow rate of the plurality of actual outdoor airflow rates that results in a minimum objective value; and determining a range of outdoor airflow rates less than a threshold based on the minimum objective value, wherein the range of outdoor airflow rates is centered around the minimum objective value, and wherein a width of the range is a measure of the uncertainty associated with the minimum objective value.

6. The BMS of claim 5, wherein an occupancy estimate and particle generation rate are back calculated based on:

calculating a time series particle disturbance based on the time series actual outdoor airflow rate and the IAQ data, wherein an increase in a portion of the time series particle disturbance indicates an increase in occupancy of the area of the building; and calculating a particle generation rate based on an occupancy dataset comprising occupant ages and occupant metabolic rates.

7. The BMS of claim 1, wherein modifying the control strategy causes the BMS to implement the control strategy to control HVAC equipment of the building, wherein the control strategy further comprises adjusting at least one control of the HVAC equipment based on one or more instructions, and wherein the one or more processors are further configured to:

calculate an operating cost of the time series actual outdoor airflow rate according to the ventilation schedule; and optimize the ventilation schedule based on either (1) maintaining the time series actual outdoor airflow rate to one or more HVAC standards or code and minimizing the operating cost, or (2) maximizing the time series actual outdoor airflow rate and maintaining the operating cost below a predefined threshold.

8. The BMS of claim 1, wherein the area is an HVAC zone of the building, and wherein the IAQ data comprises at least indoor $CO_2$ concentrations and outdoor $CO_2$ concentrations.

9. The BMS of claim 1, the one or more processors further configured to:

determine an area occupancy schedule based on executing an occupancy schedule model, wherein the area occupancy schedule comprises a plurality of occupied periods; and modify the control strategy for the area of the building based on the area occupancy schedule.

10. The BMS of claim 9, the one or more processors further configured to execute the occupancy schedule model by:

determining a time series $CO_2$ disturbance based on the time series actual outdoor airflow rate and the IAQ data;

filtering the time series $CO_2$ disturbance to generate a filtered time series $CO_2$ disturbance;

calculating a first derivative of the filtered time series $CO_2$ disturbance;

calculating a daily $CO_2$ disturbance range of the filtered time series $CO_2$ disturbance to determine one or more outlier days;

determining a first data point of the filtered time series $CO_2$ disturbance and a second data point of the filtered first derivative time series $CO_2$ disturbance, wherein the first data point of the filtered time series $CO_2$ disturbance is a $CO_2$ disturbance threshold, and wherein the second data point of the filtered first derivative time series $CO_2$ disturbance is a first derivative $CO_2$ disturbance threshold, wherein determining the first data point and the second data point is based on executing a regression model excluding the one or more outlier days;

identifying, using the filtered time series $CO_2$ disturbance, a first occupied time range for a day, the first occupied time range for the day comprises a first start time from the filtered time series $CO_2$ disturbance that is greater than the $CO_2$ disturbance threshold and a first end time from the filtered time series $CO_2$ disturbance that is less than the $CO_2$ disturbance threshold, wherein the first end time is after the first start time;

identifying, using the filtered first derivative time series $CO_2$ disturbance, a second occupied time range for the day, the second occupied time range for the day comprises a second start time from the filtered first derivative time series $CO_2$ disturbance that is greater than the first derivative $CO_2$ disturbance threshold and a second end time from the filtered first derivative time series $CO_2$ disturbance that is less than the first derivative $CO_2$ disturbance threshold, wherein the second end time is after the second start time;

combining the first occupied time range and the second occupied time range for the day based on overlapping occupied time ranges to create the area occupancy schedule; and updating the ventilation schedule based on the combined occupied time ranges.

11. The BMS of claim 10, the one or more processors further configured to:

cluster a plurality of area occupancy schedules that comprises the area occupancy schedule based on a plurality of clustering indexes, wherein the plurality of clustering indexes are determined based on:

calculating a plurality of similar disturbances between the plurality of area occupancy schedules;

plotting the plurality of similar disturbances based on applying hierarchical clustering to the calculated plurality of similar disturbances;

determining a third data point of the plotted plurality of similar disturbances based on executing the regression model, wherein the third data point of the plotted plurality of similar disturbances is an area cluster separation threshold;

clustering each of the plurality of area occupancy schedules into one of the plurality of clustering indexes based on the area cluster separation threshold; and in response to a number of the plurality of clustering indexes being above a scheduling threshold, re-clustering each of plurality of area occupancy schedules into one of the plurality of clustering indexes based on a maximum area cluster separation threshold.

12. The BMS of claim 11, the one or more processors further configured to:

determine a weekly schedule of each of the clustered plurality of area occupancy schedules for each of the plurality of clustering indexes, wherein the weekly schedule is determined based on:

calculating each distance of a plurality of distances between each day of the clustered plurality of area occupancy schedules for one of the plurality of clustering indexes;

plotting the plurality of distances based on applying the hierarchical clustering to the calculated plurality of distances;

determining a fourth data point of the plotted plurality of distances based on executing the regression model, wherein the fourth data point of the plotted plurality of distances is a schedule cluster separation threshold;

clustering each of the clustered plurality of area occupancy schedules into one of a plurality of schedule clustering indexes based on the schedule cluster separation threshold; and modify the control strategy for a plurality of areas of the building based on the clustered plurality of area occupancy schedules and the plurality of schedule clustering indexes.

13. A computer-implemented method for controlling building equipment based on an indoor air quality (IAQ) ventilation analysis of a building, the computer-implemented method comprising:

determining, by a processing circuit, an area occupancy schedule based on executing an occupancy schedule model, wherein the area occupancy schedule comprises a plurality of occupied periods, and wherein executing the occupancy schedule model comprises:

determining, by the processing circuit, a time series particle disturbance based on a time series outdoor airflow rate and IAQ data;

determining, by the processing circuit, one or more data points of the time series particle disturbance, wherein each of the one or more data points is a particle disturbance threshold, wherein determining the one or more data points is based on executing a regression model;

identifying, by the processing circuit using the time series particle disturbance, a plurality of occupied time ranges for a day, wherein each of the plurality of occupied time ranges comprises a start time from that is greater than the particle disturbance threshold and an end time from that is less than the particle disturbance threshold; and combining, by the processing circuit, the plurality of occupied time ranges for the day based on overlapping occupied time ranges to create the area occupancy schedule; and modifying, by the processing circuit, a control strategy for an area of the building by operating HVAC equipment to control the time series outdoor airflow rate based on the area occupancy schedule.

14. The computer-implemented method of claim 13, further comprising:

clustering, by the processing circuit, a plurality of area occupancy schedules that comprises the area occupancy schedule based on a plurality of clustering indexes, wherein the plurality of clustering indexes are determined based on:

calculating, by the processing circuit, a plurality of similar disturbances between the plurality of area occupancy schedules;

plotting, by the processing circuit, the plurality of similar disturbances based on applying hierarchical clustering to the calculated plurality of similar disturbances;

determining, by the processing circuit, a third data point of the plotted plurality of similar disturbances based on executing the regression model, wherein the third data point of the plotted plurality of similar disturbances is an area cluster separation threshold;

clustering, by the processing circuit, each of the plurality of area occupancy schedules into one of the plurality of clustering indexes based on the area cluster separation threshold; and in response to a number of the plurality of clustering indexes being above a scheduling threshold, re-clustering, by the processing circuit, each of plurality of area occupancy schedules into one of the plurality of clustering indexes based on a maximum area cluster separation threshold.

15. The computer-implemented method of claim 14, wherein calculating the plurality of similar disturbances comprises calculating at least one of (1) a hamming distance, (2) a $CO_2$ correlation, (3) a cosine similarity, or (4) a tanimoto coefficient between the area occupancy schedule and at least another area occupancy schedule.

16. The computer-implemented method of claim 14, further comprising:

determining, by the processing circuit, a weekly schedule of each of the clustered plurality of area occupancy schedules for each of the plurality of clustering indexes, wherein the weekly schedule is determined based on:

calculating, by the processing circuit, each distance of a plurality of distances between each day of the clustered plurality of area occupancy schedules for one of the plurality of clustering indexes;

plotting, by the processing circuit, the plurality of distances based on applying the hierarchical clustering to the calculated plurality of distances;

determining, by the processing circuit, a fourth data point of the plotted plurality of distances based on executing the regression model, wherein the fourth data point of the plotted plurality of distances is a schedule cluster separation threshold;

clustering, by the processing circuit, each of the clustered plurality of area occupancy schedules into one of a plurality of schedule clustering indexes based on the schedule cluster separation threshold; and modifying, by the processing circuit, the control strategy for a plurality of areas of the building based on the clustered plurality of area occupancy schedules and the plurality of schedule clustering indexes.

17. A building management system (BMS) for controlling building equipment based on an indoor air quality (IAQ) ventilation analysis of a building, the BMS comprising:

a controller comprising memory and one or more processors configured to:

collect IAQ data from one or more sensors within the building;

use the IAQ data to (i) identify a transient time period and (ii) estimate an actual outdoor airflow rate for an area of the building during the transient time period;

determine the transient period based on analyzing the IAQ data and identifying at least one of (1) a period of time longer than a minimum length of time (2) a peak-to-peak concentration change greater than a minimum peak-to-peak concentration change, (3) a decay rate greater than a minimum decay rate, and (4) a derivative peak in a first half of the period of time; and modify a control strategy for the area of the building in response to detecting a deviation between (i) the actual outdoor airflow rate estimated using the IAQ data and (ii) a ventilation schedule for the area of the building, wherein modifying the control strategy comprises operating HVAC equipment to control the actual outdoor airflow rate in accordance with the ventilation schedule.

18. The BMS of claim 17, the one or more processors further configured to:

determine the actual outdoor airflow rate during the transient period based on:

analyzing a relationship between each of a plurality of possible outdoor airflow rates and a corresponding regression error of a plurality of regression errors of a regression model; and selecting a possible outdoor airflow rate of the plurality of possible outdoor airflow rates as the actual outdoor airflow rate for the transient period based on identifying a minimum regression error of the relationship.

* * * * *